US012196074B2

(12) United States Patent
Thiruvenkatanathan

(10) Patent No.: US 12,196,074 B2
(45) Date of Patent: Jan. 14, 2025

(54) SYSTEMS AND METHODS FOR SAND INGRESS PREDICTION FOR SUBTERRANEAN WELLBORES

(71) Applicant: LYTT LIMITED, Middlesex (GB)

(72) Inventor: Pradyumna Thiruvenkatanathan, London (GB)

(73) Assignee: LYTT LIMITED, Middlesex (GB)

( * ) Notice: Subject to any disclaimer, the term of this patent is extended or adjusted under 35 U.S.C. 154(b) by 205 days.

(21) Appl. No.: 17/761,720

(22) PCT Filed: Sep. 20, 2019

(86) PCT No.: PCT/EP2019/075378

§ 371 (c)(1),
(2) Date: Mar. 18, 2022

(87) PCT Pub. No.: WO2021/052602

PCT Pub. Date: Mar. 25, 2021

(65) Prior Publication Data

US 2022/0349298 A1 Nov. 3, 2022

(51) Int. Cl.
*E21B 7/00* (2006.01)
*E21B 47/107* (2012.01)
(Continued)

(52) U.S. Cl.
CPC ..... *E21B 47/107* (2020.05); *E21B 47/135* (2020.05); *E21B 47/14* (2013.01); *E21B 49/008* (2013.01); *E21B 2200/20* (2020.05)

(58) Field of Classification Search
None
See application file for complete search history.

(56) References Cited

U.S. PATENT DOCUMENTS 3,563,311 A 2/1971 Stein
3,753,257 A 8/1973 Arnold
(Continued)

FOREIGN PATENT DOCUMENTS

CA 2760662 A1 12/2010
CA 2953938 A1 1/2016
(Continued)

OTHER PUBLICATIONS

International Search Report and Written Opinion dated Oct. 5, 2017, PCT Application No. PCT/EP2017/058300.
(Continued)

*Primary Examiner* — Brandi N Hopkins
*Assistant Examiner* — Nigel H Plumb
(74) *Attorney, Agent, or Firm* — CONLEY ROSE, P.C.

(57) ABSTRACT

A method of developing a predictive model for sand production from a wellbore includes receiving an indication of sand ingress at one or more production zones within a first wellbore using a sand monitoring system disposed within the first wellbore, detecting, using a pressure monitoring system, a pressure within the first wellbore while producing the one or more fluids and detecting the sand ingress, determining one or more geophysical properties of the one or more production zones of the first wellbore, and determining a model that correlates sand ingress at each of the one or more production zones with a plurality of variables. The sand ingress occurs while producing one or more fluids from the first wellbore.

28 Claims, 7 Drawing Sheets

(51) Int. Cl.

| | |
|---|---|
| ***E21B 47/135*** | (2012.01) |
| ***E21B 47/14*** | (2006.01) |
| ***E21B 49/00*** | (2006.01) |

(56) References Cited

U.S. PATENT DOCUMENTS

| | | | |
|---|---|---|---|
| 3,841,144 | A | 10/1974 | Baldwin |
| 3,854,323 | A | 12/1974 | Hearn et al. |
| 4,668,093 | A | 5/1987 | Cahill |
| 5,042,297 | A | 8/1991 | Lessi |
| 5,113,941 | A | 5/1992 | Donovan |
| 5,257,530 | A | 11/1993 | Beattie et al. |
| 5,812,493 | A | 9/1998 | Robein et al. |
| 5,825,017 | A | 10/1998 | Pryor |
| 5,971,095 | A | 10/1999 | Ozbek |
| 6,075,611 | A | 6/2000 | Dussan V. et al. |
| 6,151,556 | A | 11/2000 | Allen |
| 6,201,765 | B1 | 3/2001 | Ireson |
| 6,450,037 | B1 | 9/2002 | McGuinn et al. |
| 6,501,067 | B2 | 12/2002 | Jones et al. |
| 6,516,275 | B2 | 2/2003 | Lazaratos |
| 6,550,342 | B2 | 4/2003 | Croteau et al. |
| 6,555,807 | B2 | 4/2003 | Clayton et al. |
| 6,587,798 | B2 | 7/2003 | Kersey et al. |
| 6,601,458 | B1 | 8/2003 | Gysling et al. |
| 6,601,671 | B1 | 8/2003 | Zhao et al. |
| 6,651,007 | B2 | 11/2003 | Ozbek |
| 6,672,131 | B1 | 1/2004 | Aldal et al. |
| 6,738,715 | B2 | 5/2004 | Shatilo et al. |
| 6,751,559 | B2 | 6/2004 | Fookes et al. |
| 6,782,150 | B2 | 8/2004 | Davis et al. |
| 6,813,403 | B2 | 11/2004 | Tennyson |
| 6,829,538 | B2 | 12/2004 | de Kok |
| 6,837,098 | B2 | 1/2005 | Gysling et al. |
| 6,904,368 | B2 | 6/2005 | Reshef et al. |
| 6,933,491 | B2 | 8/2005 | Maida, Jr. |
| 6,995,352 | B2 | 2/2006 | Hay et al. |
| 7,028,543 | B2 | 4/2006 | Hardage et al. |
| 7,030,971 | B1 | 4/2006 | Payton |
| 7,072,044 | B2 | 7/2006 | Kringlebotn et al. |
| 7,088,639 | B2 | 8/2006 | Walls et al. |
| 7,130,496 | B2 | 10/2006 | Rogers |
| 7,219,762 | B2 | 5/2007 | James et al. |
| 7,355,923 | B2 | 4/2008 | Reshef et al. |
| 7,357,021 | B2 | 4/2008 | Blacklaw |
| 7,395,864 | B2 | 7/2008 | Ramachandran et al. |
| 7,398,697 | B2 | 7/2008 | Allen et al. |
| 7,404,456 | B2 | 7/2008 | Weaver et al. |
| 7,503,217 | B2 | 3/2009 | Johansen |
| 7,652,245 | B2 | 1/2010 | Crickmore et al. |
| 7,659,828 | B2 | 2/2010 | Wehrs et al. |
| 7,660,200 | B2 | 2/2010 | Tang |
| 7,872,736 | B2 | 1/2011 | Rogers et al. |
| 7,890,280 | B2 | 2/2011 | Fomme |
| 7,896,069 | B2 | 3/2011 | Dria et al. |
| 7,940,389 | B2 | 5/2011 | Rogers et al. |
| 7,946,341 | B2 | 5/2011 | Hartog et al. |
| 8,020,616 | B2 | 9/2011 | Greenaway |
| 8,023,829 | B2 | 9/2011 | Nash et al. |
| 8,131,121 | B2 | 3/2012 | Huffman |
| 8,200,049 | B2 | 6/2012 | Kaplan et al. |
| 8,245,780 | B2 | 8/2012 | Fidan et al. |
| 8,248,589 | B2 | 8/2012 | DeFreitas et al. |
| 8,264,676 | B2 | 9/2012 | Kanellopoulos et al. |
| 8,408,064 | B2 | 4/2013 | Hartog et al. |
| 8,520,197 | B2 | 8/2013 | Handerek |
| 8,534,114 | B2 | 9/2013 | Ellson |
| 8,564,786 | B2 | 10/2013 | Crickmore et al. |
| 8,576,386 | B2 | 11/2013 | Jones et al. |
| 8,605,542 | B2 | 12/2013 | Coates et al. |
| 8,614,795 | B2 | 12/2013 | Duncan et al. |
| 8,634,681 | B2 | 1/2014 | Rogers |
| 8,661,907 | B2 | 3/2014 | Davis et al. |
| 8,755,643 | B2 | 6/2014 | Nash et al. |
| 8,797,824 | B2 | 8/2014 | Crickmore et al. |
| 8,902,704 | B2 | 12/2014 | Zamow et al. |
| 8,923,663 | B2 | 12/2014 | Hill et al. |
| 8,941,821 | B2 | 1/2015 | Coupe et al. |
| 8,950,482 | B2 | 2/2015 | Hill et al. |
| 8,973,444 | B2 | 3/2015 | Hill et al. |
| 8,996,298 | B2 | 3/2015 | Yamada |
| 8,997,585 | B2 | 4/2015 | Hayward |
| 9,002,149 | B2 | 4/2015 | Rogers |
| 9,052,230 | B2 | 6/2015 | Kutlik et al. |
| 9,075,155 | B2 | 7/2015 | Luscombe et al. |
| 9,109,944 | B2 | 8/2015 | Den Boer et al. |
| 9,110,018 | B2 | 8/2015 | Handerek |
| 9,140,582 | B2 | 9/2015 | Farhadiroushan et al. |
| 9,140,815 | B2 | 9/2015 | Lopez et al. |
| 9,146,151 | B2 | 9/2015 | Kupershmidt |
| 9,228,889 | B2 | 1/2016 | McCann |
| 9,243,949 | B2 | 1/2016 | Crickmore et al. |
| 9,250,112 | B2 | 2/2016 | Godfrey |
| 9,250,120 | B2 | 2/2016 | Smith et al. |
| 9,255,836 | B2 | 2/2016 | Taverner et al. |
| 9,304,017 | B2 | 4/2016 | Handerek |
| 9,341,731 | B2 | 5/2016 | Biswas |
| 9,347,313 | B2 | 5/2016 | Wills et al. |
| 9,354,338 | B1 | 5/2016 | Psaila |
| 9,377,551 | B2 | 6/2016 | Hartog et al. |
| 9,377,559 | B2 | 6/2016 | Cooper |
| 9,388,685 | B2 | 7/2016 | Ravi et al. |
| 9,416,644 | B2 | 8/2016 | Mcewen-King et al. |
| 9,423,523 | B2 | 8/2016 | Mcewen-King |
| 9,429,466 | B2 | 8/2016 | Barfoot et al. |
| 9,430,507 | B2 | 8/2016 | Stowe et al. |
| 9,435,668 | B2 | 9/2016 | Lewis et al. |
| 9,435,902 | B2 | 9/2016 | Hill et al. |
| 9,453,821 | B2 | 9/2016 | Minto et al. |
| 9,459,329 | B2 | 10/2016 | Mcewen-King et al. |
| 9,465,126 | B2 | 10/2016 | Lewis et al. |
| 9,478,937 | B1 | 10/2016 | Kupershmidt et al. |
| 9,507,030 | B2 | 11/2016 | Godfrey |
| 9,512,711 | B2 | 12/2016 | Sobolewski et al. |
| 9,523,790 | B1 | 12/2016 | Valishin |
| 9,541,425 | B2 | 1/2017 | Farhadiroushan et al. |
| 9,557,195 | B2 | 1/2017 | Barfoot et al. |
| 9,561,812 | B2 | 2/2017 | Godfrey |
| 9,575,196 | B2 | 2/2017 | Ji et al. |
| 9,594,002 | B2 | 3/2017 | Godfrey et al. |
| 9,599,489 | B2 | 3/2017 | Nash et al. |
| 9,605,537 | B2 | 3/2017 | Hull et al. |
| 9,606,250 | B2 | 3/2017 | Hull et al. |
| 9,625,348 | B2 | 4/2017 | Hill et al. |
| 9,631,972 | B2 | 4/2017 | Hill et al. |
| 9,651,474 | B2 | 5/2017 | Farhadiroushan et al. |
| 9,651,709 | B2 | 5/2017 | Jaaskelainen |
| 9,677,956 | B2 | 6/2017 | Hill et al. |
| 9,702,244 | B2 | 7/2017 | Willis et al. |
| 9,719,846 | B2 | 8/2017 | Ellmauthaler et al. |
| 9,733,120 | B2 | 8/2017 | Stokely et al. |
| 9,739,645 | B2 | 8/2017 | Hill et al. |
| 9,746,393 | B2 | 8/2017 | Godfrey |
| 9,759,824 | B2 | 9/2017 | Lumens et al. |
| 9,766,371 | B2 | 9/2017 | Barfoot et al. |
| 9,778,097 | B2 | 10/2017 | McEwen-King |
| 9,784,642 | B2 | 10/2017 | Strong et al. |
| 9,788,469 | B2 | 10/2017 | Gimblet et al. |
| 9,797,239 | B2 | 10/2017 | Godfrey |
| 9,810,809 | B2 | 11/2017 | Farhadiroushan et al. |
| 9,816,853 | B2 | 11/2017 | Crickmore et al. |
| 9,823,114 | B2 | 11/2017 | Farhadiroushan et al. |
| 9,829,368 | B2 | 11/2017 | Kutlik et al. |
| 9,850,749 | B2 | 12/2017 | Finfer et al. |
| 9,869,795 | B2 | 1/2018 | Jaaskelainen |
| 9,880,047 | B2 | 1/2018 | Martin et al. |
| 9,896,929 | B2 | 2/2018 | Farhadiroushan et al. |
| 9,909,903 | B2 | 3/2018 | Lewis et al. |
| 9,945,215 | B2 | 4/2018 | Godfrey |
| 9,945,979 | B2 | 4/2018 | Stokely et al. |
| 9,983,293 | B2 | 5/2018 | Farhadiroushan et al. |
| 9,989,388 | B2 | 6/2018 | Farhadiroushan et al. |
| 10,018,036 | B2 | 7/2018 | Ellmauthaler et al. |
| 10,031,044 | B2 | 7/2018 | Kumar et al. |

(56) References Cited

U.S. PATENT DOCUMENTS 10,067,030 B2 9/2018 Hartog et al.
10,101,182 B2 10/2018 Barfoot
10,120,104 B2 11/2018 Roy et al.
10,139,268 B2 11/2018 Nunes et al.
10,145,821 B2 12/2018 Farhadiroushan et al.
10,151,626 B2 12/2018 Godfrey et al.
10,175,374 B2 1/2019 Dusterhoft et al.
10,180,515 B2 1/2019 Ellmauthaler et al.
10,197,693 B2 2/2019 Kalyanraman et al.
10,198,946 B2 2/2019 Crickmore et al.
10,215,017 B2 2/2019 Hull et al.
10,221,681 B2 3/2019 McEwen-King et al.
10,234,345 B2 3/2019 Hull et al.
10,247,584 B2 4/2019 Crickmore et al.
10,260,937 B2 4/2019 Dankers et al.
10,267,141 B2 4/2019 Nunes et al.
10,274,381 B2 4/2019 Kulkarni et al.
10,275,402 B2 4/2019 Guerriero et al.
10,281,341 B2 5/2019 Hull et al.
10,310,113 B2 6/2019 Sun et al.
10,317,262 B2 6/2019 Kippersund et al.
10,379,239 B2 8/2019 Udengaard
10,393,921 B2 8/2019 Cuny et al.
10,401,519 B2 9/2019 Willis et al.
10,416,328 B2 9/2019 Walters et al.
10,422,365 B2 9/2019 Hull et al.
10,422,901 B2 9/2019 Walters et al.
10,429,530 B2 10/2019 Rickett et al.
10,444,388 B2 10/2019 Dusterhoft et al.
10,444,391 B2 10/2019 Ellmauthaler et al.
10,444,393 B2 10/2019 Cheng et al.
10,458,224 B2 10/2019 Dickenson et al.
10,481,579 B1 11/2019 Putman et al.
10,520,625 B2 12/2019 Walters et al.
10,578,757 B2 3/2020 Dong et al.
10,890,730 B2 1/2021 Petersen
10,975,687 B2 4/2021 Langnes et al.
11,053,791 B2 7/2021 Langnes et al.
11,098,576 B2 8/2021 Cerrahoglu et al.
11,162,353 B2 11/2021 Thiruvenkatanathan
11,199,084 B2 12/2021 Langnes et al.
11,199,085 B2 12/2021 Langnes et al.
11,215,049 B2 1/2022 Langnes et al.
11,333,636 B2 5/2022 Langnes et al.
2001/0037883 A1 11/2001 Veneruso et al.
2002/0125009 A1 9/2002 Wetzel et al.
2002/0139929 A1 10/2002 Mullins et al.
2002/0195246 A1 12/2002 Davidson
2003/0010126 A1 1/2003 Romanet et al.
2003/0014199 A1 1/2003 Toomey
2003/0029241 A1 2/2003 Mandal
2004/0059505 A1 3/2004 Gallagher
2004/0252748 A1 12/2004 Gleitman
2005/0100172 A1 5/2005 Schliep et al.
2005/0246111 A1 11/2005 Gysling et al.
2006/0113089 A1 6/2006 Henriksen et al.
2006/0165239 A1 7/2006 Langner et al.
2006/0165344 A1 7/2006 Mendez et al.
2007/0047867 A1 3/2007 Goldner
2007/0163780 A1 7/2007 Onodera et al.
2007/0199696 A1 8/2007 Walford
2007/0215345 A1 9/2007 Lafferty et al.
2007/0234789 A1 10/2007 Glasbergen et al.
2007/0247631 A1 10/2007 Paulson
2007/0253561 A1 11/2007 Williams et al.
2008/0065362 A1 3/2008 Lee et al.
2008/0137475 A1 6/2008 Maisons
2008/0154510 A1 6/2008 Scott
2008/0232748 A1 9/2008 Nash
2008/0314142 A1 12/2008 Davies
2009/0010104 A1 1/2009 Leaney
2009/0055098 A1* 2/2009 Mese ..... E21B 43/00 703/10
2009/0202192 A1 8/2009 Taverner et al.
2009/0213692 A1 8/2009 Martinez et al.
2010/0163223 A1 7/2010 Brown
2010/0243241 A1 9/2010 Hampton et al.
2010/0258304 A1 10/2010 Hegeman
2010/0268489 A1 10/2010 Lie et al.
2011/0011577 A1 1/2011 Dusterhoft et al.
2011/0030467 A1 2/2011 Bakulin
2011/0042071 A1 2/2011 Hsu et al.
2011/0085415 A1 4/2011 Morton et al.
2011/0094741 A1 4/2011 Vigneaux et al.
2011/0110191 A1 5/2011 Williams-Stroud et al.
2011/0139538 A1 6/2011 Hill et al.
2011/0149688 A1 6/2011 Hill et al.
2011/0188346 A1 8/2011 Hull
2011/0255077 A1 10/2011 Rogers
2011/0301882 A1 12/2011 Andersen
2011/0315369 A1 12/2011 Holderman et al.
2012/0020184 A1 1/2012 Wilson et al.
2012/0043079 A1 2/2012 Wassouf et al.
2012/0057432 A1 3/2012 Hill et al.
2012/0092960 A1 4/2012 Gaston et al.
2012/0096922 A1 4/2012 Ellson
2012/0111560 A1 5/2012 Hill et al.
2012/0137781 A1 6/2012 Hill et al.
2012/0152024 A1 6/2012 Johansen
2012/0155218 A1 6/2012 Beasley et al.
2012/0201096 A1 8/2012 Valero et al.
2012/0257475 A1 10/2012 Luscombe et al.
2012/0290213 A1 11/2012 Huo et al.
2012/0298421 A1 11/2012 Coates et al.
2013/0139600 A1 6/2013 Mcewen-King et al.
2013/0151203 A1 6/2013 Mcewen-King et al.
2013/0166227 A1 6/2013 Hermann et al.
2013/0167628 A1 7/2013 Hull et al.
2013/0170519 A1 7/2013 Alliot
2013/0298665 A1 11/2013 Minchau
2013/0299165 A1 11/2013 Crow
2013/0319121 A1 12/2013 Hill et al.
2014/0025319 A1 1/2014 Farhadiroushan et al.
2014/0036627 A1 2/2014 Hull et al.
2014/0036628 A1 2/2014 Hill et al.
2014/0044222 A1 2/2014 Kim et al.
2014/0069173 A1 3/2014 Roy et al.
2014/0086009 A1 3/2014 Yoneshima
2014/0110124 A1 4/2014 Goldner et al.
2014/0150523 A1 6/2014 Stokely et al.
2014/0150548 A1 6/2014 Childers et al.
2014/0204368 A1 7/2014 Lewis et al.
2014/0216151 A1 8/2014 Godfrey et al.
2014/0334253 A1 11/2014 Lumens et al.
2014/0362668 A1 12/2014 Mcewen-King
2015/0000415 A1 1/2015 Kelley
2015/0085610 A1 3/2015 Raum et al.
2015/0144333 A1 5/2015 Lee et al.
2015/0146759 A1 5/2015 Johnston
2015/0234526 A1 8/2015 Chalubert et al.
2015/0235544 A1 8/2015 Hernandez et al.
2015/0308191 A1 10/2015 Zhan et al.
2015/0308909 A1 10/2015 Carneal et al.
2016/0123798 A1 5/2016 Godfrey et al.
2016/0138386 A1 5/2016 Stokley et al.
2016/0146962 A1 5/2016 Hayward
2016/0201453 A1 7/2016 Kaiser et al.
2016/0223389 A1 8/2016 Farhadiroushan et al.
2016/0259079 A1 9/2016 Wilson et al.
2016/0265345 A1 9/2016 Panhuis et al.
2016/0281494 A1 9/2016 Shirdel et al.
2016/0312552 A1 10/2016 Early et al.
2016/0312604 A1 10/2016 Hull et al.
2016/0320232 A1 11/2016 Nunes et al.
2016/0327419 A1 11/2016 Hellevang et al.
2016/0342569 A1 11/2016 Al Marzouqi
2016/0356665 A1 12/2016 Felemban et al.
2016/0369590 A1 12/2016 Tonkin et al.
2016/0369607 A1 12/2016 Roy et al.
2017/0010385 A1 1/2017 Englich et al.
2017/0016312 A1 1/2017 Clarke et al.
2017/0039826 A1 2/2017 Cojocaur
2017/0045410 A1 2/2017 Crickmore et al.
2017/0052049 A1 2/2017 Crickmore et al.

(56) References Cited

U.S. PATENT DOCUMENTS

| | | | |
|---|---|---|---|
| 2017/0052050 | A1 | 2/2017 | Crickmore et al. |
| 2017/0074998 | A1 | 3/2017 | McColpin et al. |
| 2017/0074999 | A1 | 3/2017 | Walters et al. |
| 2017/0075001 | A1 | 3/2017 | McColpin et al. |
| 2017/0075002 | A1 | 3/2017 | Ranjan et al. |
| 2017/0075003 | A1 | 3/2017 | Dusterhoft et al. |
| 2017/0075004 | A1 | 3/2017 | Mccolpin et al. |
| 2017/0075005 | A1 | 3/2017 | Ranjan et al. |
| 2017/0082766 | A1 | 3/2017 | Milne et al. |
| 2017/0090054 | A1 | 3/2017 | Willis et al. |
| 2017/0119255 | A1 | 5/2017 | Mahajan et al. |
| 2017/0123089 | A1 | 5/2017 | Walters et al. |
| 2017/0153154 | A1 | 6/2017 | Hull et al. |
| 2017/0205253 | A1 | 7/2017 | Handerek |
| 2017/0234999 | A1 | 8/2017 | Dykstra et al. |
| 2017/0241830 | A1 | 8/2017 | Jaaskelainen |
| 2017/0241831 | A1 | 8/2017 | Jaaskelainen |
| 2017/0275986 | A1 | 9/2017 | Nunes et al. |
| 2017/0292862 | A1 | 10/2017 | Godfrey |
| 2017/0315261 | A1 | 11/2017 | Bartling et al. |
| 2017/0342814 | A1 | 11/2017 | Krueger et al. |
| 2017/0343389 | A1 | 11/2017 | Parker et al. |
| 2017/0350234 | A1 | 12/2017 | Xia et al. |
| 2017/0363756 | A1 | 12/2017 | El Allouche et al. |
| 2017/0371057 | A1 | 12/2017 | Mateeva et al. |
| 2018/0010443 | A1 | 1/2018 | Lu et al. |
| 2018/0024260 | A1 | 1/2018 | Hornman et al. |
| 2018/0031413 | A1 | 2/2018 | Stokely et al. |
| 2018/0045543 | A1 | 2/2018 | Farhadiroushan et al. |
| 2018/0045768 | A1 | 2/2018 | Godfrey et al. |
| 2018/0058196 | A1 | 3/2018 | Jaaskelainen et al. |
| 2018/0066490 | A1 | 3/2018 | Kjos |
| 2018/0087372 | A1 | 3/2018 | Stokely et al. |
| 2018/0094952 | A1 | 4/2018 | Handerek |
| 2018/0112519 | A1 | 4/2018 | Duan et al. |
| 2018/0112520 | A1 | 4/2018 | Duan |
| 2018/0112523 | A1 | 4/2018 | Yang et al. |
| 2018/0136354 | A1 | 5/2018 | Haldorsen |
| 2018/0172860 | A1 | 6/2018 | Wilson et al. |
| 2018/0180658 | A1 | 6/2018 | Godfrey |
| 2018/0203144 | A1 | 7/2018 | Karrenbach et al. |
| 2018/0222498 | A1 | 8/2018 | Kelley |
| 2018/0224572 | A1 | 8/2018 | Farhadiroushan et al. |
| 2018/0230797 | A1 | 8/2018 | Seshadri et al. |
| 2018/0231658 | A1 | 8/2018 | Jalilian et al. |
| 2018/0238167 | A1 | 8/2018 | Ravi et al. |
| 2018/0252097 | A1 | 9/2018 | Skinner et al. |
| 2018/0259662 | A1 | 9/2018 | Srinivasan |
| 2018/0266854 | A1 | 9/2018 | Moore et al. |
| 2018/0267201 | A1 | 9/2018 | Lewis |
| 2018/0284752 | A1 | 10/2018 | Cella et al. |
| 2018/0292569 | A1 | 10/2018 | LeBlanc et al. |
| 2018/0320827 | A1 | 11/2018 | Hull et al. |
| 2018/0340801 | A1 | 11/2018 | Kelley et al. |
| 2018/0342156 | A1 | 11/2018 | Martin et al. |
| 2018/0354534 | A1 | 12/2018 | Cole |
| 2018/0356210 | A1 | 12/2018 | Moore et al. |
| 2019/0003499 | A1 | 1/2019 | Logan et al. |
| 2019/0003903 | A1 | 1/2019 | Godfrey |
| 2019/0025094 | A1 | 1/2019 | Lewis et al. |
| 2019/0026634 | A1 | 1/2019 | Homeyer et al. |
| 2019/0033898 | A1 | 1/2019 | Shah et al. |
| 2019/0064030 | A1 | 2/2019 | Sundermann |
| 2019/0072379 | A1 | 3/2019 | Jalilian et al. |
| 2019/0113641 | A1 | 4/2019 | Fang et al. |
| 2019/0120044 | A1 | 4/2019 | Langnes et al. |
| 2019/0137045 | A1 | 5/2019 | Jalilian et al. |
| 2019/0169985 | A1 | 6/2019 | Dickenson et al. |
| 2019/0186958 | A1 | 6/2019 | Godfrey |
| 2019/0197846 | A1 | 6/2019 | Englund |
| 2019/0225250 | A1 | 7/2019 | Esprey et al. |
| 2019/0257169 | A1 | 8/2019 | Grimsbo et al. |
| 2019/0257699 | A1 | 8/2019 | Handerek et al. |
| 2019/0277135 | A1 | 9/2019 | Zha |
| 2019/0323863 | A1 | 10/2019 | Shatalin et al. |
| 2019/0324444 | A1 | 10/2019 | Cella et al. |
| 2019/0331819 | A1 | 10/2019 | Wu et al. |
| 2019/0338621 | A1 | 11/2019 | Jin et al. |
| 2019/0339688 | A1 | 11/2019 | Cella et al. |
| 2019/0345803 | A1 | 11/2019 | Madasu et al. |
| 2019/0353814 | A1 | 11/2019 | Cha et al. |
| 2019/0375213 | A1 | 12/2019 | Theopold et al. |
| 2019/0390546 | A1 | 12/2019 | Langnes et al. |
| 2020/0018149 | A1 | 1/2020 | Luo et al. |
| 2020/0024942 | A1 | 1/2020 | Lolla et al. |
| 2020/0032639 | A1 | 1/2020 | Langnes et al. |
| 2020/0032645 | A1 | 1/2020 | LeBlanc et al. |
| 2020/0048999 | A1 | 2/2020 | Langnes et al. |
| 2020/0056907 | A1 | 2/2020 | Godfrey |
| 2020/0057220 | A1 | 2/2020 | Hull et al. |
| 2020/0070862 | A1 | 3/2020 | Bilodeau et al. |
| 2020/0072993 | A1 | 3/2020 | Wilson et al. |
| 2020/0081145 | A1 | 3/2020 | Padhi et al. |
| 2020/0088022 | A1 | 3/2020 | Shen et al. |
| 2020/0102821 | A1 | 4/2020 | Willis et al. |
| 2020/0124489 | A1 | 4/2020 | Godfrey |
| 2020/0131900 | A1 | 4/2020 | Leblanc et al. |
| 2020/0158594 | A1 | 5/2020 | Dankers et al. |
| 2020/0172130 | A1 | 6/2020 | Esprey |
| 2020/0173273 | A1 | 6/2020 | Thiruvenkatanathan |
| 2020/0173818 | A1 | 6/2020 | Handerek et al. |
| 2020/0174149 | A1 | 6/2020 | Thiruvenkatanathan |
| 2020/0182047 | A1 | 6/2020 | Langnes et al. |
| 2020/0184556 | A1 | 6/2020 | Cella |
| 2020/0190971 | A1 | 6/2020 | Thiruvenkatanathan |
| 2020/0200000 | A1 | 6/2020 | Langnes et al. |
| 2020/0200943 | A1 | 6/2020 | Adeyemi et al. |
| 2020/0233107 | A1 | 7/2020 | Constantinou et al. |
| 2020/0256834 | A1 | 8/2020 | Langnes et al. |
| 2020/0291772 | A1 | 9/2020 | Thiruvenkatanathan et al. |
| 2020/0309982 | A1 | 10/2020 | Jin et al. |
| 2021/0047916 | A1 | 2/2021 | Thiruvenkatanathan et al. |
| 2021/0073314 | A1 | 3/2021 | Ray et al. |
| 2021/0087923 | A1 | 3/2021 | Thiruvenkatanathan |
| 2021/0087925 | A1 | 3/2021 | Heidari et al. |
| 2021/0115767 | A1 | 4/2021 | Tajallipour et al. |
| 2021/0115785 | A1 | 4/2021 | Cerrahoglu et al. |
| 2021/0115786 | A1 | 4/2021 | Cerrahoglu et al. |
| 2021/0148199 | A1 | 5/2021 | Thiruvenkatanathan |
| 2021/0189874 | A1 | 6/2021 | Jaaskelainen et al. |
| 2021/0231830 | A1 | 7/2021 | Nitsche et al. |
| 2021/0397994 | A1 | 12/2021 | Cerrahoglu et al. |

FOREIGN PATENT DOCUMENTS

| | | | |
|---|---|---|---|
| CA | 2866274 | A1 | 3/2016 |
| CN | 101769442 | A | 7/2010 |
| CN | 102226390 | A | 10/2011 |
| CN | 203561437 | U | 4/2014 |
| CN | 105676267 | A | 6/2016 |
| CN | 205746047 | U | 11/2016 |
| CN | 108918405 | A | 11/2018 |
| CN | 109000157 | A | 12/2018 |
| CN | 110231409 | A | 9/2019 |
| CN | 209858753 | U | 12/2019 |
| EP | 2418466 | A2 | 2/2012 |
| EP | 3006908 | A1 | 4/2016 |
| EP | 3032441 | A2 | 6/2016 |
| EP | 3073051 | A1 | 9/2016 |
| EP | 3314308 | A1 | 5/2018 |
| EP | 3440314 | A2 | 2/2019 |
| GB | 1299843 | A | 12/1972 |
| GB | 2354782 | A | 4/2001 |
| GB | 2359834 | A | 9/2001 |
| GB | 2522061 | A | 7/2015 |
| GB | 2555550 | A | 5/2018 |
| GB | 2555637 | A | 5/2018 |
| GB | 18203315 | | 12/2018 |
| IN | 105135219 | A | 12/2015 |
| JP | 5518424 | B2 | 6/2014 |
| NL | 9000577 | A | 10/1990 |
| RU | 2007101037 | A | 7/2008 |
| WO | 9721116 | A1 | 6/1997 |
| WO | 2004031738 | A1 | 4/2004 |

(56) References Cited

FOREIGN PATENT DOCUMENTS

| | | | | |
|---|---|---|---|---|
| WO | 2007024763 | A2 | 3/2007 | |
| WO | 2008147953 | A1 | 12/2008 | |
| WO | 2009048340 | A2 | 4/2009 | |
| WO | 2009086279 | A2 | 7/2009 | |
| WO | 2009109747 | A1 | 9/2009 | |
| WO | 2010099484 | A2 | 9/2010 | |
| WO | 2012011831 | A1 | 1/2012 | |
| WO | 2013114135 | A2 | 8/2013 | |
| WO | 2015011394 | A1 | 1/2015 | |
| WO | 2015025216 | A2 | 2/2015 | |
| WO | 2015060981 | A1 | 4/2015 | |
| WO | 2015170113 | A1 | 11/2015 | |
| WO | 2015170116 | A1 | 11/2015 | |
| WO | 2016010550 | A1 | 1/2016 | |
| WO | 2016020654 | A1 | 2/2016 | |
| WO | 2016108914 | A1 | 7/2016 | |
| WO | 2016115030 | A1 | 7/2016 | |
| WO | 2016207341 | A1 | 12/2016 | |
| WO | 2017009606 | A1 | 1/2017 | |
| WO | 2017044923 | A1 | 3/2017 | |
| WO | 2017064472 | A1 | 4/2017 | |
| WO | 2017078536 | A1 | 5/2017 | |
| WO | 2017109467 | A1 | 6/2017 | |
| WO | 2017156339 | A1 | 9/2017 | |
| WO | 2017174746 | A1 | 10/2017 | |
| WO | 2017174750 | A2 | 10/2017 | |
| WO | 2017203271 | A1 | 11/2017 | |
| WO | 2017214729 | A1 | 12/2017 | |
| WO | 2018044309 | A1 | 3/2018 | |
| WO | 2018057029 | A1 | 3/2018 | |
| WO | 2018088994 | A1 | 5/2018 | |
| WO | 2018136050 | A1 | 7/2018 | |
| WO | 2018154275 | A1 | 8/2018 | |
| WO | 2018178279 | A1 | 10/2018 | |
| WO | 2018195661 | A1 | 11/2018 | |
| WO | 2019005050 | A1 | 1/2019 | |
| WO | 2019027466 | A1 | 2/2019 | |
| WO | WO-2019038401 | A1 * | 2/2019 | ..... E21B 43/04 |
| WO | 2019072899 | A2 | 4/2019 | |
| WO | 2019094140 | A1 | 5/2019 | |
| WO | 2019094474 | A1 | 5/2019 | |
| WO | 2019136556 | A1 | 7/2019 | |
| WO | 2019139564 | A1 | 7/2019 | |
| WO | 2020109426 | A2 | 6/2020 | |
| WO | 2020109427 | A2 | 6/2020 | |
| WO | 2020119957 | A1 | 6/2020 | |
| WO | 2020182312 | A1 | 9/2020 | |
| WO | 2020260928 | A1 | 12/2020 | |
| WO | 2021034300 | A1 | 2/2021 | |
| WO | 2021037586 | A1 | 3/2021 | |
| WO | 2021052604 | A1 | 3/2021 | |
| WO | 2021052605 | A1 | 3/2021 | |
| WO | 2021052607 | A1 | 3/2021 | |
| WO | 2021073740 | A1 | 4/2021 | |
| WO | 2021073741 | A1 | 4/2021 | |
| WO | 2021073763 | A1 | 4/2021 | |
| WO | 2021073776 | A1 | 4/2021 | |
| WO | 2021093974 | A1 | 5/2021 | |
| WO | 2021093976 | A1 | 5/2021 | |
| WO | 2021148141 | A1 | 7/2021 | |
| WO | 2021151504 | A1 | 8/2021 | |
| WO | 2021151521 | A1 | 8/2021 | |
| WO | 2021249643 | A1 | 12/2021 | |
| WO | 2021254632 | A1 | 12/2021 | |
| WO | 2021254633 | A1 | 12/2021 | |
| WO | 2021254799 | A1 | 12/2021 | |

OTHER PUBLICATIONS

International Preliminary Report on Patentability dated Oct. 18, 2018, PCT Application No. PCT/EP2017/058300.
Office Action dated Jan. 7, 2022, U.S. Appl. No. 16/091,519, filed Oct. 4, 2018.
Office Action dated Dec. 12, 2020, EG Application No. PCT1590/2018.
Office Action dated Apr. 22, 2020, EA Application No. 201892228.
Office Action dated Nov. 23, 2020, EA Application No. 201892228.
Office Action dated Jun. 28, 2021, EA Application No. 201892228.
Notification on Intention to Grant dated Mar. 5, 2022, EA Application No. 201892228.
EP Rule 161(1) and 162 EPC Communication dated Jul. 12, 2018, EP Application No. 17715935.7.
Intention to Grant dated Dec. 12, 2019, EP Application No. 17715935.7.
Decision to Grant dated May 8, 2020, EP Application No. 17715935.7.
Office Action dated Dec. 29, 2019, U.S. Appl. No. 16/563,544, filed Sep. 16, 2019.
Notice of Allowance dated Apr. 22, 2020, U.S. Appl. No. 16/563,544, filed Sep. 16, 2019.
European Search Report dated Aug. 10, 2020, EP Application No. 20170700.7.
European Office Action dated Feb. 22, 2022, EP Application No. 20170700.7.
International Search Report and Written Opinion dated Sep. 22, 2017, PCT Application No. PCT/ EP2017/058292.
International Preliminary Report on Patentability dated Oct. 18, 2018, PCT Application No. PCT/EP2017/058292.
Restriction Requirement dated Dec. 15, 2020, U.S. Appl. No. 16/291,929, filed Oct. 5, 2018.
Office Action dated Mar. 30, 2021, U.S. Appl. No. 16/291,929, filed Oct. 5, 2018.
Notice of Allowance dated Aug. 6, 2021, U.S. Appl. No. 16/291,929, filed Oct. 5, 2018.
Notice of Acceptance dated Mar. 24, 2022, AU Application No. 2017246520, filed on Oct. 3, 2018.
CA Examination Report dated Feb. 16, 2022, CA Application No. 3,020,007.
Office Action dated Aug. 1, 2021, EG Application No. 1588/2018.
Office Action dated Mar. 23, 2020, EA Application No. 201892227.
Office Action dated Nov. 16, 2020, EA Application No. 201892227.
Office Action dated Jun. 17, 2021, EA Application No. 201892227.
Notification on Intention to Grant dated Mar. 5, 2022, EA Application No. 201892227.
EP Rule 161(1) and 162 EPC Communication dated Nov. 29, 2018, EP Application No. 17715932.4.
Intention to Grant dated Sep. 26, 2019, EP Application No. 17715932.4.
Decision to Grant dated Feb. 2, 2020, EP Application No. 17715932.4.
Office Action dated Dec. 4, 2019, U.S. Appl. No. 16/563,689, filed Sep. 6, 2019.
Notice of Allowance dated May 20, 2020, U.S. Appl. No. 16/563,689, filed Sep. 6, 2019.
Corrected Notice of Allowability dated Jun. 19, 2020, U.S. Appl. No. 16/563,689, filed Sep. 6, 2019.
Notice of Allowance dated Apr. 21, 2021, U.S. Appl. No. 16/563,689, filed Sep. 6, 2019.
Notice of Allowance dated Aug. 23, 2021, U.S. Appl. No. 16/563,689, filed Sep. 6, 2019.
European Search Report dated Apr. 22, 2020, for European Application No. 20154638.9.
European Article 94(3) dated Jun. 8, 2020, EP Application No. 20154638.9.
Intention to Grant dated Feb. 25, 2021, EP Application No. 20154638.9.
Decision to Grant dated Jul. 15, 2021, EP Application No. 20154638.9.
International Search Report and Written Opinion dated Jun. 29, 2018, PCT Application No. PCT/EP2018/058174.
International Preliminary Report on Patentability dated Oct. 10, 2019, PCT Application No. PCT/EP2018/058174.
Office Action dated Jan. 24, 2020, U.S. Appl. No. 16/566,711, filed Sep. 10, 2019.
Final Office Action dated Aug. 4, 2020, U.S. Appl. No. 16/566,711, filed Sep. 10, 2019.

(56) References Cited

OTHER PUBLICATIONS

Advisory Action dated Oct. 16, 2020, U.S. Appl. No. 16/566,711, filed Sep. 10, 2019.
Advisory Action dated Aug. 25, 2020, U.S. Appl. No. 16/698,335, filed Nov. 11, 2019.
Office Action dated Dec. 3, 2020, U.S. Appl. No. 16/698,335, filed Nov. 11, 2019.
Final Office Action dated Jun. 15, 2021, U.S. Appl. No. 16/698,335, filed Nov. 11, 2019.
GCC Examination Report dated Nov. 17, 2020, GCC Application No. 2019/38718.
GCC Examination Report dated Jan. 6, 2021, GCC Application No. 2019/38718.
European Article 94(3) Examination Report dated Nov. 11, 2021, EP Application No. 19809084.7.
International Search Report and Written Opinion dated Jan. 27, 2020, PCT Application No. PCT/EP2019/056425.
International Preliminary Report on Patentability date Sep. 23, 2021, PCT Application No. PCT/EP2019/056425.
Office Action dated Nov. 5, 2021, U.S. Appl. No. 16/817,559, filed Mar. 12, 2021.
GCC Examination Report date Jul. 26, 2021, GCC Application No. 2020/39381.
EP Rule 161(1) and 162 EPC Communication date Oct. 21, 2021, EP Application No. 19712714.5.
International Search Report and Written Opinion dated Feb. 28, 2020, PCT Application No. PCT/IB2019/055355.
International Preliminary Report on Patentability dated Jan. 6, 2022, PCT Application No. PCT/IB2019/055355.
EP Rule 161(1) and 162 EPC Communication date Feb. 4, 2022, EP Application No. 19765548.3.
International Search Report and Written Opinion dated Jun. 16, 2020, PCT Application No. PCT/EP2019/075385.
International Preliminary Report on Patentability dated Mar. 31, 2022, PCT Application No. PCT/EP2019/075385.
Office Action dated Jan. 12, 2022, U.S. Appl. No. 17/025,874, filed Sep. 18, 2020.
International Preliminary Report on Patentability dated Mar. 31, 2022, PCT Application No. PCT/EP2019/075378.
International Search Report and Written Opinion dated Jun. 17, 2020, PCT Application No. PCT/US2019/046759.
International Preliminary Report on Patentability dated March 3, 3022, PCT Application No. PCT/US2019/046759.
International Search Report and Written Opinion dated May 12, 2020, PCT Application No. PCT/EP2019/072891.
International Search Report and Written Opinion dated Nov. 6, 2020, PCT Application No. PCT/EP2020/072811.
International Preliminary Report on Patentability dated Mar. 10, 2022, PCT Application No. PCT/EP2020/072811.
International Search Report and Written Opinion dated Jul. 9, 2020, PCT Application No. PCT/EP2019/078195.
International Preliminary Report on Patentability dated Apr. 28, 2022, PCT Application No. PCT/EP2019/078195.
Office Action dated Jan. 7, 2021, U.S. Appl. No. 17/071,031, filed Oct. 15, 2020.
Notice of Allowance dated Apr. 22, 2021, U.S. Appl. No. 17/071,031, filed Oct. 15, 2020.
International Search Report and Written Opinion dated Jun. 16, 2020, PCT Application No. PCT/EP2019/075387.
International Preliminary Report on Patentability dated Mar. 31, 2022, PCT Application No. PCT/EP2019/075387.
International Search Report and Written Opinion dated Jun. 16, 2020, PCT Application No. PCT/EP2019/075382.
International Preliminary Report on Patentability dated Mar. 31, 2022, PCT Application No. PCT/EP2019/075382.
Partial International Search Report Search Report dated Sep. 10, 2020, PCT Application No. PCT/ EP2019/085454.
International Search Report Search Report dated Nov. 6, 2020, PCT Application No. PCT/EP2019/085454.
International Preliminary Report on Patentability dated Apr. 28, 2022, PCT Application No. PCT/EP2019/085454.
GCC Examination Report dated Dec. 1, 2021, for GCC Application No. GC2020-40675.
International Search Report and Written Opinion dated Jul. 9, 2020, PCT Application No. PCT/EP2019/078197.
International Preliminary Report on Patentability dated Apr. 28, 2022, PCT Application No. PCT/EP2019/078197.
Office Action dated Jan. 14, 2021, U.S. Appl. No. 17/071,021, filed Oct. 20, 2020.
Final Office Action dated May 11, 2021, U.S. Appl. No. 17/071,021, filed Oct. 20, 2020.
Advisory Action dated Jul. 28, 2021, U.S. Appl. No. 17/071,021, filed Oct. 20, 2020.
Final Office Action dated Dec. 7, 2021, U.S. Appl. No. 17/071,021, filed Oct. 20, 2020.
Advisory Action dated Mar. 2, 2022, U.S. Appl. No. 17/071,021, filed Oct. 20, 2020.
Notice of Allowance dated Apr. 6, 2022, U.S. Appl. No. 17/071,021, filed Oct. 20, 2020.
International Search Report and Written Opinion dated May 29, 2020, PCT Application No. PCT/EP2019/082809.
International Preliminary Report on Patentability dated Jun. 10, 2021, PCT Application No. PCT/EP2019/082809.
Office Action dated Mar. 12, 2020, U.S. Appl. No. 16/698,407, filed Nov. 27, 2019.
Final Office Action dated Jun. 30, 2020, U.S. Appl. No. 16/698,407, filed Nov. 27, 2019.
Office Action dated Mar. 22, 2021, U.S. Appl. No. 16/698,407, filed Nov. 27, 2019.
Final Office Action dated Jun. 29, 2021, U.S. Appl. No. 16/698,407, filed Nov. 27, 2019.
Office Action dated Nov. 15, 2021, U.S. Appl. No. 16/698,407, filed Nov. 27, 2019.
Final Office Action dated Apr. 4, 2022, U.S. Appl. No. 16/698,407, filed Nov. 27, 2019.
Examination Report dated Jul. 15, 2020, GCC Application No. GC 2019-38726.
Examination Report dated Dec. 6, 2020, GCC Application No. GC 2019-38726.
Examination Report/Notice of Allowance dated Jun. 9, 2021, GCC Application No. GC 2019-38726.
Office Action dated Mar. 15, 2022, EA Application No. 202191441.
EP Rule 161(1) and 162 EPC Communication dated Jul. 6, 2021, EP Application No. 21194305.5.
European Extended Search Report dated Nov. 23, 2021, EP Application No. 21194305.5.
International Search Report and Written Opinion dated Jul. 24, 2020, PCT Application No. PCT/EP2019/081542.
Office Action dated Dec. 30, 2020, U.S. Appl. No. 17/091,940, filed Nov. 6, 2020.
Final Office Action dated Apr. 7, 2021, U.S. Appl. No. 17/091,940, filed Nov. 6, 2020.
Notice of Allowance dated Jun. 29, 2021, U.S. Appl. No. 17/091,940, filed Nov. 6, 2020.
Examination Report dated Oct. 17, 2021, GC Application No. 2020-40879.
International Search Report and Written Opinion dated Jul. 24, 2020, PCT Application No. PCT/EP2019/081545.
International Search Report and Written Opinion dated Feb. 3, 2021, PCT Application No. PCT/EP2020/066171.
Office Action dated Sep. 21, 2021, U.S. Appl. No. 17/330,117, filed May 12, 2021.
Final Office Action dated Jan. 7, 2022, U.S. Appl. No. 17/330,117, filed May 12, 2021.
Partial International Search Report dated Oct. 20, 2020, PCT Application No. PCT/EP2020/051814.
International Search Report and Written Opinion dated Dec. 11, 2020, PCT Application No. PCT/EP2020/051814.
Partial International Search Report dated Oct. 16, 2020, PCT Application No. PCT/EP2020/051817.
International Search Report and Written Opinion dated Dec. 20, 2020, PCT Application No. PCT/EP2020/051817.

(56) References Cited

OTHER PUBLICATIONS

International Preliminary Report on Patentability dated Apr. 28, 2022, PCT Application No. PCT/EP2020/051817.
GCC Examination Report dated Oct. 13, 2021, GCC Application No. 2020/40676.
International Search Report and Written Opinion dated Oct. 14, 2020, PCT Application No. PCT/EP2020/052445.
International Search Report and Written Opinion dated Dec. 9, 2020, PCT Application No. PCT/EP2020/067043.
International Search Report and Written Opinion dated Mar. 15, 2021, PCT Application No. PCT/EP2020/067045.
International Search Report and Written Opinion dated Sep. 14, 2021, PCT Application No. PCT/ EP2021/065081.
Office Action dated Dec. 29, 2021, U.S. Appl. No. 17/351,217.
International Search Report and Written Opinion dated Mar. 12, 2021, PCT Application No. PCT/EP2020/067044.
Abdelgaward, Ahemd, "Distributed Sand Monitoring Framework Using Wireless Sensor Networks," School of Engineering Technology, Central Michigan University, Mount Pleasant, MI 48859, US, Oct. 2013, vol. 1 Is. 1, pp. 1-10.
Abukhamsin, Ahmed Yasin, et al., "In Flow Profiling and Production Optimization in Smart Wells Using Di stri but ed Acoustic and Temperature Measurements," Jun. 1, 2017 (Jun. 1, 2017), XP055604495, Retrieved from the Internet: URL: https://pangea.stanford.edu/ERE/pdf/pereports/PhD/Abukhamsin2016.pdf [retrieved on Jul. 11, 2019-] paragraphs [0001], [0002], [0004].
Ansari, Rafay et al., "Advanced Petrophysical Surveillance Improves the Understanding of Well Behavior in Unconventional Reservoirs," Society of Petroleum Engineers (SPE-170878-MS), The Netherlands, Oct. 27-29, 2014.
Bakku, Sudhish K., et al., "Vertical Seismic Profiling Using Distributed Acoustic Sensing in a Hydrofrac Treatment Well," SEG Technical Program Expanded Abstracts Denver 2014 ISSN (print): 1052-3812, ISSN (online): 1949-4645, https://doi.org/10.1190/segam2014-1559.1.
Broesch, James "Digital Signal Processing: Instant Access," Chapter 7, www.newnespress.com.
Brown, Gerald K., "External Acoustic Sensors and Instruments for the Detection of Sand in Oil and Gas Wells," Offshore Technology Conference, May 5-8, 1997, Houston, Texas, US, OTC-8478-MS, https://doi.org/10.4043/8478-MS.
Brown, Gerald K., et al., "Solids and Sand Monitoring—An Overview," Corrosion Mar. 26-31, 2000, Orlando, Florida, US, NACE International, NACE-00091.
Cannon, Robert Thayer, et al., "Distributed Acoustic Sensing: State of the Art," SPE Digital Energy Conference, Mar. 5-7, 2013, The Woodlands, Texas, US, SPE-163688-MS, https://doi.org/10.2118/163688-MS.
Chen, Jianyou, et al., "Distributed acoustic sensing coupling noise removal based on sparse optimization," Society of Exploration Geophysicists and American Association of Petroleum Geologists, vol. 7, Issue 2, May 2019, pp. 1M-T563, ISSN (print): 2324-8858, ISSN (online): 2324-8866, https://doi.org/10.1190/INT-2018-0080.1.
Chhantyal, Khim et al., "Upstream Ultrasonic Level Based Soft Sensing of Volumetric Flow of Non-Newtonian Fluids in Open Venturi Channels," IEEE Sensors Journal, vol. 18, No. 12, Jun. 15, 2018.
Clam+A663:F708pOn DSP-06 Particle Monitor, Aug. 2009.
ClampOn SandQ® Monitor, Aug. 2014.
Conway, Chris, et al., "An introduction to fiber optic Intelligent Distributed Acoustic Sensing (iDAS) technology for power industry applications," 9th International Conference on Insulated Power Cables, Jicable15—Versailles Jun. 21-25, 2015, A3.4.
Correa, Julia, et al., "3D vertical seismic profile acquired with distributed acoustic sensing on tubing installation: A case study from the CO2CRC Otway Project," Interpretation-a Journal of Subsurface Characterization, 7(1), ISSN 2324-8858, Feb. 1, 2019, DOI 10.1190/INT-2018-0086.1, https://escholarship.org/uc/item/2br8g398.
De la Cruz Salas, Luis M., "Computational Methods for Oil Recovery", Instituto de Geofisica Universidad Nacional Autonoma de Mexico, Jan. 2011, Slides 1-97 (Year: 2011).
Elichev, et al., "Understanding Well Events with Machine Learning," Society of Petroleum Engineers, SPE-196861-MS, pp. 1-12, 2019.
Finfer, D.C., et al., "Borehole Flow Monitoring using a Non-intrusive Passive Distributed Acoustic Sensing (DAS)," Society of Petroleum Engineers, SPE-170844-MS, SPE Annual Technical Conference and Exhibition held in Amsterdam, The Netherlands, Oct. 27-29, 2014.
Folkestad, Trond, et al., "Acoustic measurements detect sand in North Sea flow lines," Oil and Gas Journal; (USA), Journal vol. 88:35; Journal ID: ISSN 0030-1388.
Gardner, Neil, et al., "Distributed Fiber-Optic Technologies Drive New Intervention Applications," SPE JPT-7975, vol. 67 | Issue: 1, Jan. 1, 2015.
Hildebrandt Marcel et al., "A Recommender System for Complex Real-World Applications with Nonlinear Dependencies and Knowledge Graph Context", May 25, 2019 (May 25, 2019), Advances in Databases and Information Systems; [Lecture Notes in Computer Science; Lect.Notes Computer], Springer International Publishing, Cham, pp. 179-193, ISBN: 9783319104034.
Hill, David, Permanent real-time full wellbore flow monitoring using distributed fiber-optic sensing, OptaSense, 2015.
Hofman, Joachim, et al., "Analysis of the acoustic response in water and sand of different fiber optic sensing cables," SPIE Sensing Technology + Applications, 2015, Baltimore, Maryland, U.S., Proceedings vol. 9491, Sensors for Extreme Harsh Environments II; 94910E (2015) https://doi.org/10.1117/12.2178282.
Hull, John William, et al., "Well-Integrity Monitoring and Analysis Using Distributed Fiber-Optic Acoustic Sensors," IADC/SPE Drilling Conference and Exhibition, Feb. 2-4, 2010, New Orleans, Louisiana, US, SPE-128304-MS, https://doi.org/10.2118/128304-MS.
Isensys, "Sand Alert—Fixed and Portable Sand Monitoring," Isensys LLP, Sep. 2016, www.isensys.co.uk.
Johannessen, Kjetil, et al., "Distributed Acoustic Sensing—A New Way of Listening to Your Well/Reservoir," SPE Intelligent Energy International, Mar. 27-29, 2012, Utrecht, NL, SPE-149602-MS, https://doi.org/10.2118/149602-MS.
Lashgari, Hamid R., et al., "A Four-Phase Chemical/Gas Model in an Implicit-Pressure/ Explicit-Concentration Reservoir Simulator," SPE J. 21 (2016): 1086-1105 (Year: 2016).
Li, Meng, et al., "Current and Future Applications of Distributed Acoustic Sensing as a New Reservoir Geophysics Tool," The Open Petroleum Engineering Journal, 2015, 8, (Suppl 1: M3) 272-281.
Ma, King, et al. "Deep Learning on Temporal-Spectral Data for Anomaly Detection," Department of Electrical and Computer Engineering, University of Calgary, Proc. of SPIE vol. 10190, 2017.
Martin, Shawn, "Can Oil Well Monitoring Systems Withstand Stimulation Treatments," Feb. 26, 2015, https://insights.globalspec.com/article/601/can-oil-well-monitoring-systems-withstand-stimulation-treatments [retrieved on Aug. 18, 2020].
Martinez, Roberto Jr., "Diagnosis of Fracture Flow Conditions With Acoustic Sensing," SPE Hydraulic Fracturing Technology Conference, Feb. 4-6, The Woodlands, Texas, US, Publication Date 2014.
Miller, Douglas E., et al., "Vertical Seismic Profiling Using a Fiber-optic Cable as a Distributed Acoustic Sensor," 74th EAGE Conference Exhibition incorporating SPE EUROPEC 2012, Copenhagen, Denmark, Jun. 4-7, 2012.
Mohd Daud, Farik, et al., "Successful Application of Ultrasound Technology to Detect Sand Producing Intervals in the Wellbore," International Petroleum Technology Conference, Nov. 15-17, 2011, Bangkok, Thailand, IPTC-14737-MS, https://doi.org/10.2523/IPTC-14737-MS.
Molenaar, Mathieu, et al., "Downhole tests show benefits of distributed acoustic sensing," Oil and Gas Journal 109 (1):82-85, Jan. 2011.
Molenaar, Menno M., et al., "First Downhole Application of Distributed Acoustic Sensing for Hydraulic-Fracturing Monitoring and Diagnostics," SPE Drilling Completion, vol. 27, Is. 1, Mar. 2012, SPE-140561-PA, https://doi.org/10.2118/140561-PA.

(56) References Cited

OTHER PUBLICATIONS

Mullens, Stephen, et al., "Fiber-Optic Distributed Vibration Sensing Provides Technique for Detecting Sand Production," Offshore Technology Conference, May 3-6, 2010, Houston, Texas, US, OTC-20429-MS, https://doi.org/10.4043/20429-MS.
Naldrett, G., et al., "Production Monitoring Using Next-Generation Distributed Sensing Systems," Petrophysics, vol. 59, No. 4 (Aug. 2018); pp. 496-510; 16 Figures. DOI: 10.30632/PJV59V4-2018a5.
One Petro Search Results, Jul. 22, 2021, 10 pp. (Year: 2021).
Paleja, Rakesh, et al., "Velocity Tracking for Flow Monitoring and Production Profiling Using Distributed Acoustic Sensing," SPE Annual Technical Conference and Exhibition, Sep. 28-30, 2015, Houston, Texas, US, SPE-174823-MS, https://doi.org/10.2118/174823-MS.
Roxar sand monitor, https://www.emerson.com/en-us/automation/roxar.
Roxar, "Sand Monitor, Non-intrusive acoustic sensor," Draft 1-120209, Sundheim-Madison Feb. 2009.
Saeed, et al., "Event Detection for Managed-Pressure Drilling: A New Paradigm," Society of Petroleum Engineers, SPE 158491, pp. 1-12, 2012.
Schultz, Whitney H., "Time-Lapse Multicomponent Geophone and DAS VSP Processing and Analysis, " Colorado School of Mines, Geo-Physics Department, 2019.
Silixa, "Fracture Monitoring," https://silixa.com/solutions/oil-and-gas-downhole/frac-services/fracture-monitoring/.
Silixa, "Well Integrity," https://silixa.com/solutions/oil-and-gas-downhole/permanent-reservoir-and-well-surveillance/well-integrity/.
Silkina, Tatiana, "Application of Distributed Acoustic Sensing to Flow Regime Classification," Natural Gas Technology, Norwegian University of Science and Technology, Jun. 2014.
Stokely, Christopher L., "Acoustics-Based Flow Monitoring During Hydraulic Fracturing," SPE-179151-MS, Society of Petroleum Engineers, SPE Hydraulic Fracturing Technology Conference, Feb. 9-11, 2016, The Woodlands, Texas, USA, https://doi.org/10.2118/179151-MS.
Susilo, Yoliandri, et al., "Significant Increase in Sand Control Reliability of Open Hole Gravel Pack Completions in ACG Field—Azerbaijan," SPE European Formation Damage Conference Exhibition, Jun. 5-7, 2013, Noordwijk, NL, SPE-165206-MS, https://doi.org/10.2118/165206-MS.
Thiruvenkatanathan Prad: "Seeing the LYTT: Real time flow profiling in hydrocarbon wells", Jun. 11, 2020 (Jun. 11, 2020). pp. 1-3, XP055776735, Retrieved from the Internet: URL:https://www.lytt.com/blog/the-new-tool-that-is-lytting-up-inflow-profiling [retrieved—on Feb. 16, 2021], p. 1 p. 2.
Van der Horst, Juun, et al., "Fibre Optic Sensing For Improved Wellbore Production Surveillance," International Petroleum Technology Conference, Jan. 19-22, 2014, Doha, Qatar, IPTC-17528-MS, https://doi.org/10.2523/IPTC-17528-MS.
Wang, Fang, et al., "Pipeline Leak Detection by Using Time-Domain Statistical Features," IEEE Sensors Journal, vol. 17, No. 19, Oct. 2017.
Wang, Kai, et al., "Vibration Sensor Approaches for the Monitoring of Sand Production in Bohai Bay," Hindawi Publishing Corporation, Shock and Vibration, vol. 2015, Article ID 591780, http://dx.doi.org/10.1155/2015/591780.
Williams, J., "Distributed acoustic sensing for pipeline monitoring," Pipeline and Gas Journal Jul. 2012, vol. 239 No. 7.
World first installation of a fibre optic acoustic sensor for reservoir monitoring, Oil and Gas Product News, Oct. 30, 2009.
WorldOil.com, "Adelous unveils distributed acoustic sensor solution for upstream oil gas," May 28, 2015. https://www.worldoil.com/news/2015/5/28/adelos-unveils-distributed-acoustic-sensor-solution-for-upstream-oil-gas.
Xiao, J., et al., "Dynamic Water Injection Profiling in Intelligent Wells Using Distributed Acoustic Sensor with Multimode Optical Fibers," SPE Annual Technical Conference and Exhibition, Sep. 28-30, 2015, Houston, Texas, US, SPE-174865-MS, https://doi.org/10.2118/174865-MS.
Xiao, J.J., et al., "Intelligent Distributed Acoustic Sensing for In-well Monitoring," SPE Saudi Arabia Section Technical Symposium and Exhibition, Apr. 21-24, 2014, Al-Khobar, SA, SPE-172197-MS, https://doi.org/10.2118/172197-MS.
Notice of Allowance dated Dec. 11, 2020, U.S. Appl. No. 16/566,711, filed Sep. 10, 2019.
European Article 94(3) Examination Report dated Jan. 15, 2020, for European Application No. 18714513.1.
European Article 94(3) Examination Report dated Jul. 29, 2020, for European Application No. 18714513.1.
Intention to Grant dated Feb. 23, 2021, for European Application No. 18714513.1.
Decision to Grant dated Jun. 24, 2021, for European Application No. 18714513.1.
European Search Report dated Dec. 4, 2019, for European Application No. 19198488.9.
European Article 94(3) Examination Report dated Feb. 3, 2020, , for European Application No. 19198488.9.
Intention to Grant dated Aug. 10, 2020, for European Application No. 19198488.9.
Intention to Grant dated Feb. 3, 2021, for European Application No. 19198488.9.
Intention to Grant dated Nov. 23, 2021, for European Application No. 19198488.9.
Decision to Grant dated Apr. 7, 2022, for European Application No. 19198488.9.
Eurasian Office Action dated Sep. 3, 2020, for Eurasian Application No. 201992243/31.
Eurasian Notice of Allowance dated Apr. 29, 2021, for Eurasian Application No. 201992243/31.
TT Invitation to Amend dated Nov. 5, 2021, for Eurasian Application No. 201992243/31.
International Search Report and Written Opinion dated Nov. 28, 2018, PCT Application No. PCT/ EP2018/072811.
International Preliminary Report on Patentability dated Mar. 5, 2020, PCT Application No. PCT/EP2018/072811.
Office Action dated Apr. 29, 2021, U.S. Appl. No. 16/639,774, filed Feb. 18, 2020.
Notice of Allowance dated Aug. 10, 2021, U.S. Appl. No. 16/639,774, filed Feb. 18, 2020.
Eurasian Office Action dated Nov. 20, 2020, EA Application No. 2020090528.
Eurasian Office Action dated May 27, 2021, EA Application No. 2020090528.
Notice of Acceptance dated Dec. 15, 2021, EA Application No. 2020090528.
EP Rule 161(1) and 162 EPC Communication dated Apr. 7, 2020, EP Application No. 18765814.1.
Intention to Grant dated Mar. 16, 2021, EP Application No. 18765814.1.
Decision to Grant dated Sep. 9, 2021, EP Application No. 18765814.1.
International Search Report and Written Opinion dated Feb. 14, 2020, PCT Application No. PCT/EP2019/057149.
International Preliminary Report on Patentability dated Jun. 24, 2021, PCT Application No. PCT/EP2019/057149.
Office Action dated Mar. 4, 2020, U.S. Appl. No. 16/710,237, filed Dec. 11, 2019.
Final Office Action dated Sep. 3, 2020, U.S. Appl. No. 16/710,237, filed Dec. 11, 2019.
Office Action dated Feb. 11, 2021, U.S. Appl. No. 16/710,237, filed Dec. 11, 2019.
Office Action dated Jul. 22, 2021, U.S. Appl. No. 16/710,237, filed Dec. 11, 2019.
Office Action dated Apr. 26, 2022, U.S. Appl. No. 16/710,237, filed Dec. 11, 2019.
GCC Examination Report dated Jan. 30, 2021, GCC Application No. 2019/38809.
EP Rule 161(1) and 162 EPC Communication dated Jul. 20, 2021, EP Application No. 19714346.4.

(56) References Cited

OTHER PUBLICATIONS

International Search Report and Written Opinion dated Jun. 4, 2019, PCT Application No. PCT/EP2018/077568.
International Preliminary Report on Patentability dated Apr. 23, 2020, PCT Application No. PCT/EP2018/077568.
Office Action dated Aug. 25, 2021, U.S. Appl. No. 16/755,211, filed Apr. 10, 2020.
Notice of Allowance dated Jan. 21, 2022, U.S. Appl. No. 16/755,211, filed Apr. 10, 2020.
Eurasian Office Action dated Jan. 27, 2021, EA Application No. 202090867.
Eurasian Office Action dated Sep. 3, 2021, EA Application No. 202090867.
Eurasian Office Action dated Jan. 25, 2022, EA Application No. 202090867.
EP Rule 161(1) and 162 EPC Communication dated May 19, 2020, EP Application No. 18788701.3.
International Search Report and Written Opinion dated Sep. 9, 2020, PCT Application No. PCT/EP2018/082985.
International Search Report and Written Opinion dated May 29, 2020, PCT Application No. PCT/EP2019/082808.
International Preliminary Report on Patentability dated Jun. 10, 2020, PCT Application No. PCT/EP2019/082808.
Office Action dated Feb. 24, 2020, U.S. Appl. No. 16/698,335, filed Nov. 11, 2019.
Final Office Action dated Jun. 24, 2020, U.S. Appl. No. 16/698,335, filed Nov. 11, 2019.
PCT/EP2019/075378 International Search Report and Written Opinion dated Jun. 16, 2020 (14 p.).
Tiffin, David L. et al., "Drawdown Guidelines for Sand Control Completions," Oct. 5, 2003, SPE 84495 (10 p.).

* cited by examiner

SYSTEMS AND METHODS FOR SAND INGRESS PREDICTION FOR SUBTERRANEAN WELLBORES

CROSS-REFERENCE TO RELATED APPLICATIONS

This application is a 35 U.S.C. § 371 national stage application of PCT/EP2019/075378 filed Sep. 20, 2019 and entitled "Systems and Methods for Sand Ingress Prediction for Subterranean Wellbores," which is hereby incorporated herein by reference in its entirety for all purposes.

STATEMENT REGARDING FEDERALLY SPONSORED RESEARCH OR DEVELOPMENT

Not applicable.

BACKGROUND

To obtain hydrocarbons from subterranean formations, wellbores are drilled from the surface to access the hydrocarbon-bearing formation. After drilling a wellbore to the desired depth, a production string is installed in the wellbore to produce the hydrocarbons from one or more production zones of the formation to the surface. In some wellbores, fine particulate matter (which is generally referred to herein as "sand") may be produced along with other fluids (e.g., hydrocarbon liquids, gas, water, etc.). The sand may cause plugging and erosion or wear within the well. Thus, it is desirable to prevent sand from advancing into the wellbore (e.g., with a screen or other suitable device or completion method), or to minimize (or prevent entirely) the production of sand from the subterranean formation.

BRIEF SUMMARY

In an embodiment, a method of developing a predictive model for sand production from a wellbore comprises receiving an indication of sand ingress at one or more production zones within a first wellbore using a sand monitoring system disposed within the first wellbore, detecting, using a pressure monitoring system, a pressure within the first wellbore while producing the one or more fluids and detecting the sand ingress, determining one or more geophysical properties of the one or more production zones of the first wellbore, and determining a model that correlates sand ingress at each of the one or more production zones with a plurality of variables. The sand ingress occurs while producing one or more fluids from the first wellbore. The plurality of variables include at least two of: a production rate of the one or more fluids from the first wellbore, a pressure within the first wellbore, a rate of change of the pressure within the first wellbore, a flux of the one or more fluids through the production face of the wellbore, or an acceleration of the one or more fluids between a reservoir and an interior of the wellbore at the production face of the wellbore, or one or more of the geophysical properties of the first wellbore.

In an embodiment, a system for operating a wellbore comprises: a memory storing an analysis program, and a processor. The processor is configured to execute the analysis program to: receive, from a monitoring assembly, a sensor signal, receive, from the monitoring assembly, an indication of the pressure within at least one production zone of the at least one production zone in the first wellbore, receive an indication of sand ingress into the first wellbore using the sensor signal, receive one or more geophysical properties for the at least one production zone, and determine a model that correlates sand ingress at the at least one production zone with a plurality of variables. The sensor signal is generated while producing one or more fluids from at least one production zone within a first wellbore, and the monitoring assembly is configured to detect one or more values related to the first wellbore. The first wellbore comprises the at least one production zone capable of producing one or more fluids. The plurality of variables include at least two of: a production rate of the one or more fluids from the first wellbore, a pressure within the first wellbore, a rate of change of the pressure within the first wellbore, a flux of the one or more fluids through the production face of the wellbore, or an acceleration of the one or more fluids between a reservoir and an interior of the wellbore at the production face of the wellbore, or the one or more of the geophysical properties of the at least one production zone.

In an embodiment, a method of predicting sand production from a wellbore comprises: detecting a production rate of one or more fluids from at least one production zone within a first wellbore, detecting, using a pressure monitoring system, a pressure within the first wellbore while producing the one or more fluids from at least one production zone within the first wellbore, determining one or more geophysical properties of the at least one production zone of the first wellbore, and predicting, using a sand prediction model, sand ingress within the at least one production zone in the first wellbore. The sand prediction model correlates sand ingress at the at least one production zone with a plurality of variables. The plurality of variables include at least two of: a production rate of the one or more fluids from the first wellbore, a pressure within the first wellbore, a rate of change of the pressure within the first wellbore, a flux of the one or more fluids through the production face of the at least one production zone of the first wellbore, an acceleration of the one or more fluids between a reservoir and an interior of the wellbore at the production face of the at least one production zone of the first wellbore, or one or more of the geophysical properties of the at least one production zone of the first wellbore. The sand prediction model is based on at least: sand ingress detected in a second wellbore having one or more production zones, a detected pressure within the one or more production zones of the second wellbore, and one or more geophysical properties of the second wellbore.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various exemplary embodiments, reference will now be made to the accompanying drawings in which.

DETAILED DESCRIPTION

Figure 1:
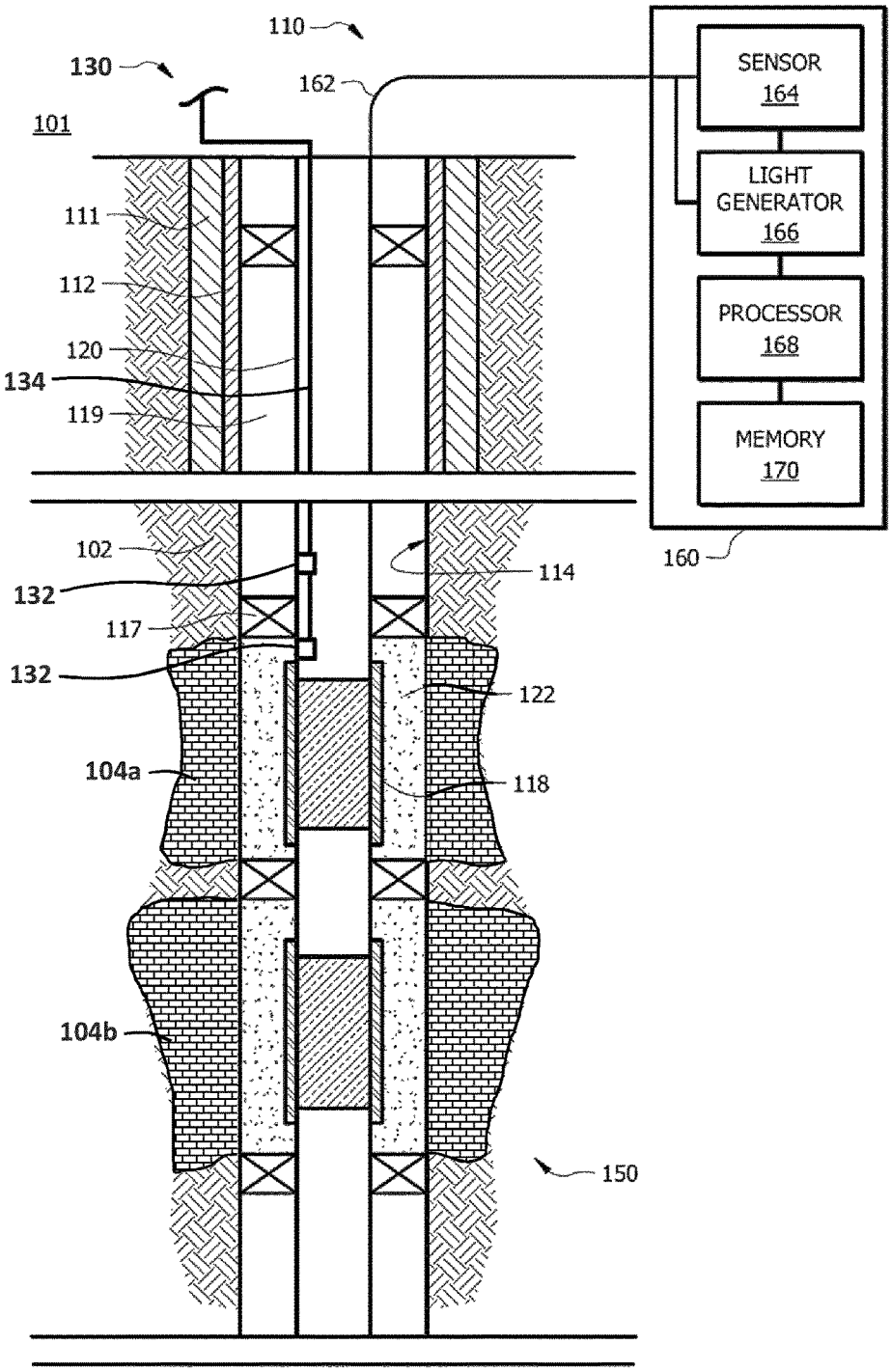
FIG. 1 is a schematic, cross-sectional illustration of a downhole wellbore environment according to some embodiments.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," "upstream," or "above" meaning toward the surface of the wellbore and with "down," "lower," "downward," "downstream," or "below" meaning toward the terminal end of the well, regardless of the wellbore orientation. Reference to inner or outer will be made for purposes of description with "in," "inner," or "inward" meaning towards the central longitudinal axis of the wellbore and/or wellbore tubular, and "out," "outer," or "outward" meaning towards the wellbore wall. As used herein, the term "longitudinal" or "longitudinally" refers to an axis substantially aligned with the central axis of the wellbore tubular, and "radial" or "radially" refer to a direction perpendicular to the longitudinal axis. The various characteristics mentioned above, as well as other features and characteristics described in more detail below, will be readily apparent to those skilled in the art with the aid of this disclosure upon reading the following detailed description of the embodiments, and by referring to the accompanying drawings.

As utilized herein, a 'fluid inflow event' includes fluid inflow (e.g., any fluid inflow regardless of composition thereof), gas phase inflow, aqueous phase inflow, and/or hydrocarbon phase inflow. The fluid can comprise other components such as solid particulate matter in some embodiments, as discussed in more detail herein.

As previously described, sand may be produced from one or more production zones of a subterranean reservoir along with other fluids through a hydrocarbon producing wellbore, and the produced sand may lead to a host of problems and complications. As a result, it may be desirable to limit or prevent the production of sand during operations.

One method of limiting or reducing sand production from a wellbore (or a production zone within a wellbore), may be to manipulate a drawdown pressure within the wellbore. As used herein, the term "drawdown pressure" refers to the pressure differential between the pressure of a subterranean formation and the pressure of a wellbore extending through the formation (this is sometimes also referred to as the "pressure drawdown"). To allow production fluids to enter the wellbore for production to the surface, the drawdown pressure is set such that the pressure within the wellbore is generally less than the pressure of the formation. Thus, the drawdown pressure drives formation fluids from the subterranean formation into the wellbore during production operations, and one would normally expect the drawdown pressure to be proportional (or at least related to) to the flow rate of production fluids into the wellbore. Accordingly, as the drawdown pressure increases (i.e., the pressure differential between the formation and wellbore increases) the flow rate of formation fluids into the wellbore from the formation should also increase. As described herein, the drawdown pressure may be influenced or managed by the actuation of choke valves or other pressure adjustment devices (e.g., pumps, valves, etc.).

In some circumstances, a rate of sand production may be influenced by adjusting the drawdown pressure within the wellbore during operations. For instance, one might lower a drawdown pressure so as to limit or at least reduce the sand production rate into a given wellbore. In addition, the rate of change for the pressure drawdown may also affect a rate of sand production during operations. Specifically, if a drawdown pressure is changed relatively rapidly (e.g., increased), then a force on the production face of one or more production zones within the wellbore may increase such that sand is more readily mobilized and flowed into the wellbore along with other production fluids (e.g., oil, gas, water, etc.). This effect can be thought of as shocking the formation and thereby releasing sand into the wellbore. The force on the production face of a wellbore may be measured or characterized by one or more of a rate of pressure change in the production zone, a flux of the one or more fluids through the production face of the wellbore, or an acceleration of the one or more fluids between a reservoir and an interior of the wellbore at the production face of the wellbore. Thus, as used herein, the "force on the production face" of a production zone of a wellbore may refer to any of these above-listed parameters. In addition, as will be described in more detail below some or all of these parameters characterizing the force on the production face may be influenced or may directly result from the drawdown pressure (and specifically changes in the drawdown pressure) during production operations. Accordingly, in at least some of the embodiments described herein, the force on the production face of a production zone of a wellbore may be assessed and monitored via one or more pressure measurements (e.g., a wellbore pressure, drawdown pressure, formation pressure, etc.).

Thus, precise and timely control of the drawdown pressure (e.g., via a choke or other suitable pressure adjustment devices as previously described above) may be called for to prevent or at least minimize a rate of sand ingress into a subterranean wellbore so as to avoid the above-described difficulties and failures. However, it can be difficult to precisely determine how to adjust a drawdown pressure to limit sand production while still maintaining an acceptable flow of hydrocarbon fluids. Specifically, in many circumstances, a wellbore operator may determine a rate of sand production based on an amount of sand that is produced at the surface. However, the sand produced at the surface does not always accurately correlate with an actual ingress rate of sand from the formation into the wellbore. For instance, sand that is produced from a formation may accumulate within the wellbore, and subsequent production of sand may simply correspond with a flowing of previously produced and accumulated sand out of the wellbore. Thus, an operator may correlate a current drawdown pressure (or recent drawdown pressure change) with observed surface sand production that may not actually directly result from formation sand production. Further, a delay is introduced between the time the sand is produced from the formation and the time the sand is observed on the surface based on a fluid flow rate, which can make a correlation between the drawdown pressure and the sand production rate when the drawdown pressure is being changed. As a result, in an effort to limit perceived sand ingress, a wellbore operator may overly reduce the drawdown pressure so that production from the wellbore is substantially reduced or substantially eliminated, or may overly increase drawdown pressure so that sand ingress is increased.

Accordingly, embodiments disclosed herein include systems and methods for detecting and/or characterizing sand ingress and/or sand flow within a subterranean wellbore, so that a wellbore operator may more effectively prevent or minimize sand production into the wellbore during operations. In some embodiments, utilizing the systems and methods described herein, an operating envelope may be developed to define operating parameters of the wellbore (e.g., a rate of pressure change in the production zone, a flux of the one or more fluids through the production face of the wellbore, or an acceleration of the one or more fluids between a reservoir and an interior of the wellbore at the production face of the wellbore, etc.) so as to limit or even avoid sand ingress during operations. In some embodiments, a distributed acoustic sensor (DAS) may be utilized to detect the sand ingress, and/or sand transport within a wellbore. In some embodiments, the determined operating envelope may be applied to one or more production zones in the same or other wellbores that have corresponding geophysical properties. In some embodiments, the sand ingress predictions can be used across or between reservoirs to enable production control (e.g., production rate control with an appropriate sand control, etc.) for wellbores that have not previously been monitored. In some embodiments, a sand ingress location, timing, and/or amount may be predicted so as to inform a production, completion, and/or drilling plan for a wellbore (e.g., such as an existing wellbore or a planned wellbore yet to be drilled and/or completed).

Referring now to FIG. 1, where a schematic, cross-sectional illustration of a downhole wellbore operating environment 101 according to some embodiments is shown. More specifically, environment 101 includes a wellbore 114 traversing a subterranean formation 102, casing 112 lining at least a portion of wellbore 114, and a tubular 120 extending through wellbore 114 and casing 112. A plurality of completion assemblies such as spaced screen elements or assemblies 118 may be provided along tubular 120 at one or more production zones 104*a*, 104*b* within the subterranean formation 102. In particular, two production zones 104*a*, 104*b* are depicted within subterranean formation 102 of FIG. 1; however, the precise number and spacing of the production zones 104*a*, 104*b* may be varied in different embodiments. The production zones 104*a*, 104*b* may be layers, zones, or strata of formation 102 that contain hydrocarbon fluids (e.g., oil, gas, condensate, etc.) therein.

In addition, a plurality of spaced zonal isolation devices 117 and gravel packs 122 may be provided between tubular 120 and the sidewall of wellbore 114 at or along the interface of the wellbore 114 with the production zones 104*a*, 104*b*. In some embodiments, the operating environment 101 includes a workover and/or drilling rig positioned at the surface and extending over the wellbore 114. While FIG. 1 shows an example completion configuration in FIG. 1, it should be appreciated that other configurations and equipment may be present in place of or in addition to the illustrated configurations and equipment.

In general, the wellbore 114 can be formed in the subterranean formation 102 using any suitable technique (e.g., drilling). The wellbore 114 can extend substantially vertically from the earth's surface over a vertical wellbore portion, deviate from vertical relative to the earth's surface over a deviated wellbore portion, and/or transition to a horizontal wellbore portion. In general, all or portions of a wellbore may be vertical, deviated at any suitable angle, horizontal, and/or curved. In addition, the wellbore 114 can be a new wellbore, an existing wellbore, a straight wellbore, an extended reach wellbore, a sidetracked wellbore, a multilateral wellbore, and other types of wellbores for drilling and completing one or more production zones. As illustrated, the wellbore 114 includes a substantially vertical producing section 150 which includes the production zones 104*a*, 104*b*. In this embodiment, producing section 150 is an open-hole completion (i.e., casing 112 does not extend through producing section 150). Although section 150 is illustrated as a vertical and open-hole portion of wellbore 114 in FIG. 1, embodiments disclosed herein can be employed in sections of wellbores having any orientation, and in open or cased sections of wellbores. The casing 112 extends into the wellbore 114 from the surface and can be secured within the wellbore 114 with cement 111.

The tubular 120 may comprise any suitable downhole tubular or tubular string (e.g., drill string, casing, liner, jointed tubing, and/or coiled tubing, etc.), and may be inserted within wellbore 114 for any suitable operation(s) (e.g., drilling, completion, intervention, workover, treatment, production, etc.). In the embodiment shown in FIG. 2, the tubular 120 is a completion assembly string. In addition, the tubular 120 may be disposed within in any or all portions of the wellbore 114 (e.g., vertical, deviated, horizontal, and/or curved section of wellbore 114).

In this embodiment, the tubular 120 extends from the surface to the production zones 104*a*, 104*b* and generally provides a conduit for fluids to travel from the formation 102 (particularly from production zones 104*a*, 104*b*) to the surface. A completion assembly including the tubular 120 can include a variety of other equipment or downhole tools to facilitate the production of the formation fluids from the production zones. For example, zonal isolation devices 117 can be used to isolate the production zones 104*a*, 104*b* within the wellbore 114. In this embodiment, each zonal isolation device 117 comprises a packer (e.g., production packer, gravel pack packer, frac-pac packer, etc.). The zonal isolation devices 117 can be positioned between the screen assemblies 118, for example, to isolate different gravel pack zones or intervals along the wellbore 114 from each other. In general, the space between each pair of adjacent zonal isolation devices 117 defines a production interval, and each production interval may corresponding with one of the production zones 104*a*, 104*b* of subterranean formation 102.

The screen assemblies 118 provide sand control capability. In particular, the sand control screen elements 118, or other filter media associated with wellbore tubular 120, can be designed to allow fluids to flow therethrough but restrict and/or prevent particulate matter of sufficient size from flowing therethrough. The screen assemblies 118 can be of the type known as "wire-wrapped", which are made up of a wire closely wrapped helically about a wellbore tubular, with a spacing between the wire wraps being chosen to allow fluid flow through the filter media while keeping particulates that are greater than a selected size from passing between the wire wraps. Other types of filter media can also be provided along the tubular 120 and can include any type of structures commonly used in gravel pack well completions, which permit the flow of fluids through the filter or screen while restricting and/or blocking the flow of particulates (e.g. other commercially-available screens, slotted or perforated liners or pipes; sintered-metal screens; sintered-sized, mesh screens; screened pipes; prepacked screens and/or liners; or combinations thereof). A protective outer shroud having a plurality of perforations therethrough may be positioned around the exterior of any such filter medium.

The gravel packs 122 are formed in the annulus 119 between the screen elements 118 (or tubular 120) and the sidewall of the wellbore 114 in an open hole completion. In general, the gravel packs 122 comprise relatively coarse granular material placed in the annulus to form a rough screen against the ingress of sand into the wellbore while also supporting the wellbore wall. The gravel pack 122 is optional and may not be present in all completions.

In some embodiments, one or more of the completion assemblies can comprise flow control elements such as sliding sleeves, chokes, valves, or other types of flow control devices that can control the flow of a fluid from an individual production zone or a group of production zones. The force on the production face can then vary based on the type of completion within the wellbore and/or each production zone (e.g., in a sliding sleeve completion, open hole completion, gravel pack completion, etc.). In some embodiments, a sliding sleeve or other flow controlled production zone can experience a force on the production face the is relatively uniform within the production zone, and the force on the production face can be different between each production zone. For example, a first production zone can have a specific flow control setting that allows the pressure and rate of change of pressure within the first zone to be different than a second production zone. Thus, the choice of completion type (e.g., which can be specified in a completion plan) can depend on the need for or the ability to provide a different force on the production face within different production zones. This can allow for improved production using the processes described herein at one or more production zones within the wellbore.

A pressure monitoring system 130 may be installed (e.g., partially installed) within wellbore 114. Pressure monitoring system 130 may include one (or a plurality of) pressure sensors 132 disposed in various locations within wellbore 114 and configured to measure or detect a pressure therein. For instance, in some embodiments, pressure monitoring systems 130 may comprise a plurality of distributed pressure sensors within the wellbore 114 (e.g., sensors similar to pressure sensor 132). In some embodiments, the pressure sensors may comprise a fiber optic based distributed pressure sensor or sensors capable of determining the pressure within one or more locations (e.g., one or more production zones, etc.) within the wellbore. In some embodiments, a pressure sensor of the pressure monitoring system 130 (e.g., pressure sensor 132) may be configured to measure or detect one or more of a pressure of the formation (e.g., such as a pressure of the production zones 104*a*, 104*b*, etc.), a pressure of production tubing (e.g., production tubing 120), or a pressure within the gravel pack 122, etc. As will be described in more detail below, in some embodiments, pressure monitoring system 130 may be used to determine a drawdown pressure of the wellbore (which is defined above). In addition, the pressure measurements from the pressure monitoring system 130 may be used to determine, infer, estimate, etc. one or more of the above described parameters that characterize the force on the production face of a production zone (e.g., production zones 104*a*, 104*b*) of the wellbore 114.

Referring still to FIG. 1, a DAS system 110 can be coupled to tubular 120. As described herein, DAS system 110 may be utilized to detect or monitor sand ingress and/or sand transport within the wellbore 114. While described with respect to a DAS system, other monitoring systems (e.g., acoustic monitoring systems whether or not based on fiber optic sensors) including any point or distributed downhole monitoring systems can also be used within the wellbore, as described in more detail herein. The various monitoring systems (e.g., acoustic monitoring systems) may be referred to herein as a "sand detection system," and/or a "sand monitoring system."

Figure 2A:
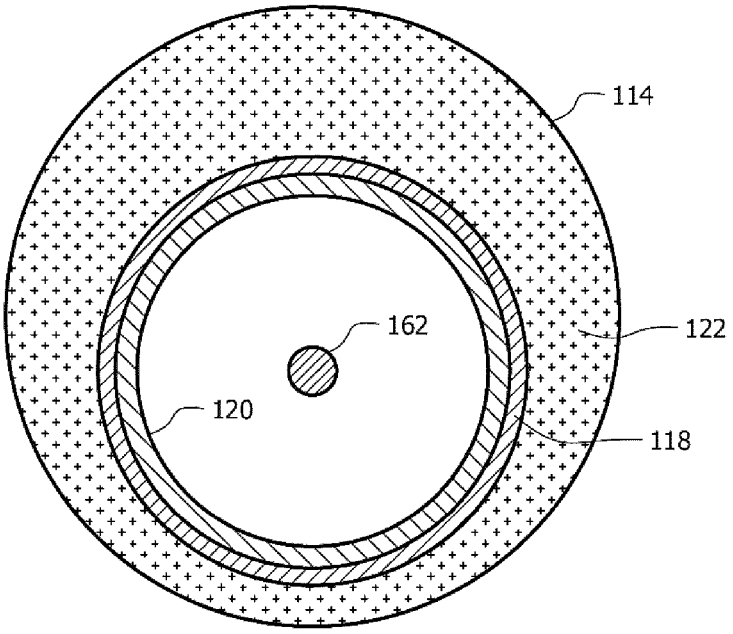
FIGS. 2A and 2B are a schematic, cross-sectional views of embodiments of a well with a wellbore tubular having an optical fiber inserted therein according to some embodiments.
Figure 2B:
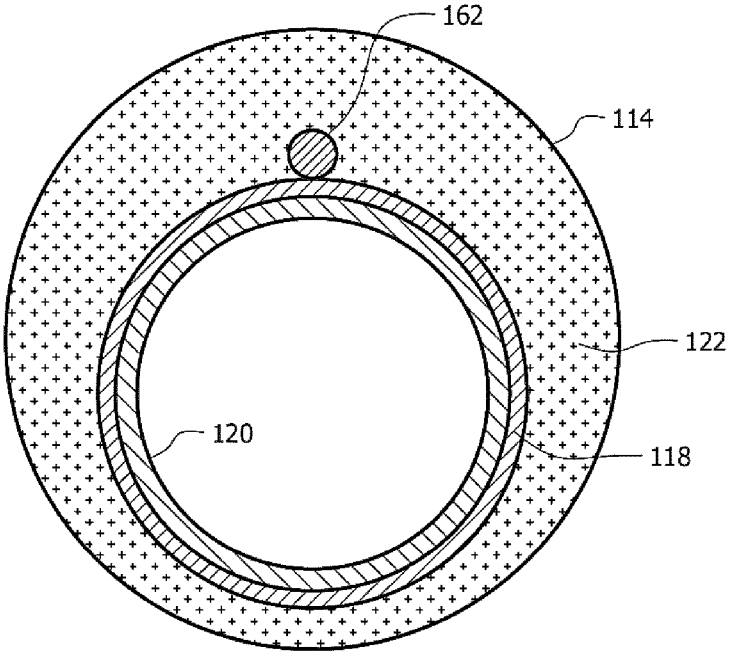

DAS system 110 comprises an optical fiber 162 that is coupled to and extends along tubular 120. In cased completions, the optical fiber 162 can be installed between the casing and the wellbore wall within a cement layer and/or installed within the casing or production tubing. Referring briefly to FIGS. 2A and 2B, optical fiber 162 of DAS system 110 may be coupled to an exterior of tubular 120 (e.g., such as shown in FIG. 2B) or an interior of tubular (e.g., such as shown in FIG. 2A). When the optical fiber 162 is coupled to the exterior of the tubular 120, as depicted in the embodiment of FIG. 2B, the optical fiber 162 can be positioned within a control line, control channel, or recess in the tubular 120. In some embodiments an outer shroud contains the tubular 120 and protects the optical fiber 162 during installation. A control line or channel can be formed in the shroud and the optical fiber 162 can be placed in the control line or channel (not specifically shown in FIGS. 2A and 2B).

Referring again to FIG. 1, generally speaking, during operations an optical backscatter component of light injected into the optical fiber 162 may be used to detect acoustic perturbations (e.g., dynamic strain) along the length of the fiber 162. The light can be generated by a light generator or source 166 such as a laser, which can generate light pulses. The light used in the system is not limited to the visible spectrum, and light of any frequency can be used with the systems described herein. Accordingly, the optical fiber 162 acts as the sensor element with no additional transducers in the optical path, and measurements can be taken along the length of the entire optical fiber 162. The measurements can then be detected by an optical receiver such as sensor 164 and selectively filtered to obtain measurements from a given depth point or range, thereby providing for a distributed measurement that has selective data for a plurality of zones (e.g., production zones 104*a*, 104*b*) along the optical fiber 162 at any given time. For example, time of flight measurements of the backscattered light can be used to identify individual zones or measurement lengths of the fiber optic 162. In this manner, the optical fiber 162 effectively functions as a distributed array of microphones spread over the entire length of the optical fiber 162, which typically across production zones 104*a*, 104*b* within the wellbore 114, to detect downhole acoustic signals.

The light backscattered up the optical fiber 162 as a result of the optical backscatter can travel back to the source, where the signal can be collected by a sensor 164 and processed (e.g., using a processor 168). In general, the time the light takes to return to the collection point is proportional to the distance traveled along the optical fiber 162, thereby allowing time of flight measurements of distance along the optical fiber. The resulting backscattered light arising along the length of the optical fiber 162 can be used to characterize the environment around the optical fiber 162. The use of a controlled light source 166 (e.g., having a controlled spectral width and frequency) may allow the backscatter to be collected and any disturbances along the length of the optical fiber 162 to be analyzed. In general, any acoustic or dynamic strain disturbances along the length of the optical fiber 162 can result in a change in the properties of the backscattered light, allowing for a distributed measurement of both the acoustic magnitude (e.g., amplitude), frequency and, in some cases, of the relative phase of the disturbance. Any suitable detection methods including the use of highly coherent light beams, compensating interferometers, local oscillators, and the like can be used to produce one or more signals that can be processed to determine the acoustic signals or strain impacting the optical fiber along its length.

An acquisition device 160 may be coupled to one end of the optical fiber 162 that comprises the sensor 164, light generator 166, a processor 168, and a memory 170. As discussed herein, the light source 166 can generate the light (e.g., one or more light pulses), and the sensor 164 can collect and analyze the backscattered light returning up the optical fiber 162. In some contexts, the acquisition device 160 (which comprises the light source 166 and the sensor 164 as noted above), can be referred to as an interrogator. The processor 168 may be in signal communication with the sensor 164 and may perform various analysis steps described in more detail herein. While shown as being within the acquisition device 160, the processor 168 can also be located outside of the acquisition device 160 including being located remotely from the acquisition device 160. The sensor 164 can be used to obtain data at various rates and may obtain data at a sufficient rate to detect the acoustic signals of interest with sufficient bandwidth. While described as a sensor 164 in a singular sense, the sensor 164 can comprise one or more photodetectors or other sensors that can allow one or more light beams and/or backscattered light to be detected for further processing. In an embodiment, depth resolution ranges in a range of from about 1 meter to about 10 meters, or less than or equal to about 10, 9, 8, 7, 6, 5, 4, 3, 2, or 1 meter can be achieved. Depending on the resolution needed, larger averages or ranges can be used for computing purposes. When a high depth resolution is not needed, a system may have a wider resolution (e.g., which may be less expensive) can also be used in some embodiments. Data acquired by the DAS system 110 (e.g., via fiber 162, sensor 164, etc.) may be stored on memory 170.

While the system 101 described herein can be used with a DAS system (e.g., DAS system 110) to acquire an acoustic signal for a location or depth range in the wellbore 114, in general, any suitable acoustic signal acquisition system can be used in performing embodiments of method 10 (see e.g., FIG. 1). For example, various microphones, geophones, hydrophones, or other sensors can be used to provide an acoustic signal at a given location based on the acoustic signal processing described herein. Further, an optical fiber comprising a plurality of point sensors such as Bragg gratings can also be used. As described herein, a benefit of the use of the DAS system 110 is that an acoustic signal can be obtained across a plurality of locations and/or across a continuous length of the wellbore 114 rather than at discrete locations.

During operations, the fluid flowing into the tubular 120 may comprise hydrocarbon fluids, such as, for instance hydrocarbon liquids (e.g., oil) or gases (e.g., natural gas such as methane, ethane, etc.). However, the fluid flowing into the tubular may also comprise other components, such as, for instance water, steam, carbon dioxide, and/or various multiphase mixed flows. In addition, as previously mentioned above, in some embodiments, the fluid flowing into the tubular 120 may also include sand. The fluid flow can further be time varying such as including slugging, bubbling, or time altering flow rates of different phases. The amounts or flow rates of these components can vary over time based on conditions within the formation 102 and the wellbore 114. Likewise, the composition of the fluid flowing into the tubular 120 sections throughout the length of the entire production string (e.g., including the amount of sand contained within the fluid flow) can vary significantly from section to section at any given time.

Fluid can be produced into the wellbore 114 and into the completion assembly string. As the fluid enters the wellbore 114, it may create acoustic sounds that can be detected using an acoustic sensor such as a DAS system (e.g., fiber 162). Accordingly, the flow of the various fluids into the wellbore 114 and/or through the wellbore 114 can create vibrations or acoustic sounds that can be detected using DAS system 110. Each type of event such as the different fluid flows and fluid flow locations can produce an acoustic signature with unique frequency domain features.

As used herein, various frequency domain features can be obtained from the acoustic signal, and in some contexts, the frequency domain features can also be referred to herein as spectral features or spectral descriptors. The frequency domain features are features obtained from the frequency domain analysis of the acoustic signals obtained within the wellbore. The frequency domain features can be derived from the full spectrum of the frequency domain of the acoustic signal such that each of the frequency domain features can be representative of the frequency spectrum of the acoustic signal. Further, a plurality of different frequency domain features can be obtained from the same acoustic signal, where each of the different frequency domain features is representative of frequencies across the same frequency spectrum of the acoustic signal as the other frequency domain features. For example, the frequency domain features (e.g., each frequency domain feature) can be statistical shape measurement or spectral shape function of the spectral power measurement across the same frequency bandwidth of the acoustic signal. Further, as used herein, frequency domain features can also refer to features or feature sets derived from one or more frequency domain features, including combinations of features, mathematical modifications to the one or more frequency domain features, rates of change of the one or more frequency domain features, and the like.

Specific spectral signatures can be determined for each event by considering one or more frequency domain features of the acoustic signal obtained from the wellbore. More specifically, each event can have a characteristic set of frequency domain features, or combinations thereof (e.g., an acoustic or spectral signature), that fall within certain thresholds as defining the event. The resulting spectral signatures can then be used along with processed acoustic signal data to detect and/or characterize an event at a depth range of interest by matching the detected frequency domain features to the acoustic signature(s). The events can include various fluid and/or particulate flows (e.g., sand) and/or inflows as described herein. The spectral signatures can be determined by considering the different types of flow occurring within a wellbore and characterizing the frequency domain features for each type of flow. In some embodiments, various combinations and/or transformations of the frequency domain features can be used to characterize each type of flow. Further, in some embodiments, the frequency domain features may further be used to classify a flow rate of each identified type of flow.

Figure 3:
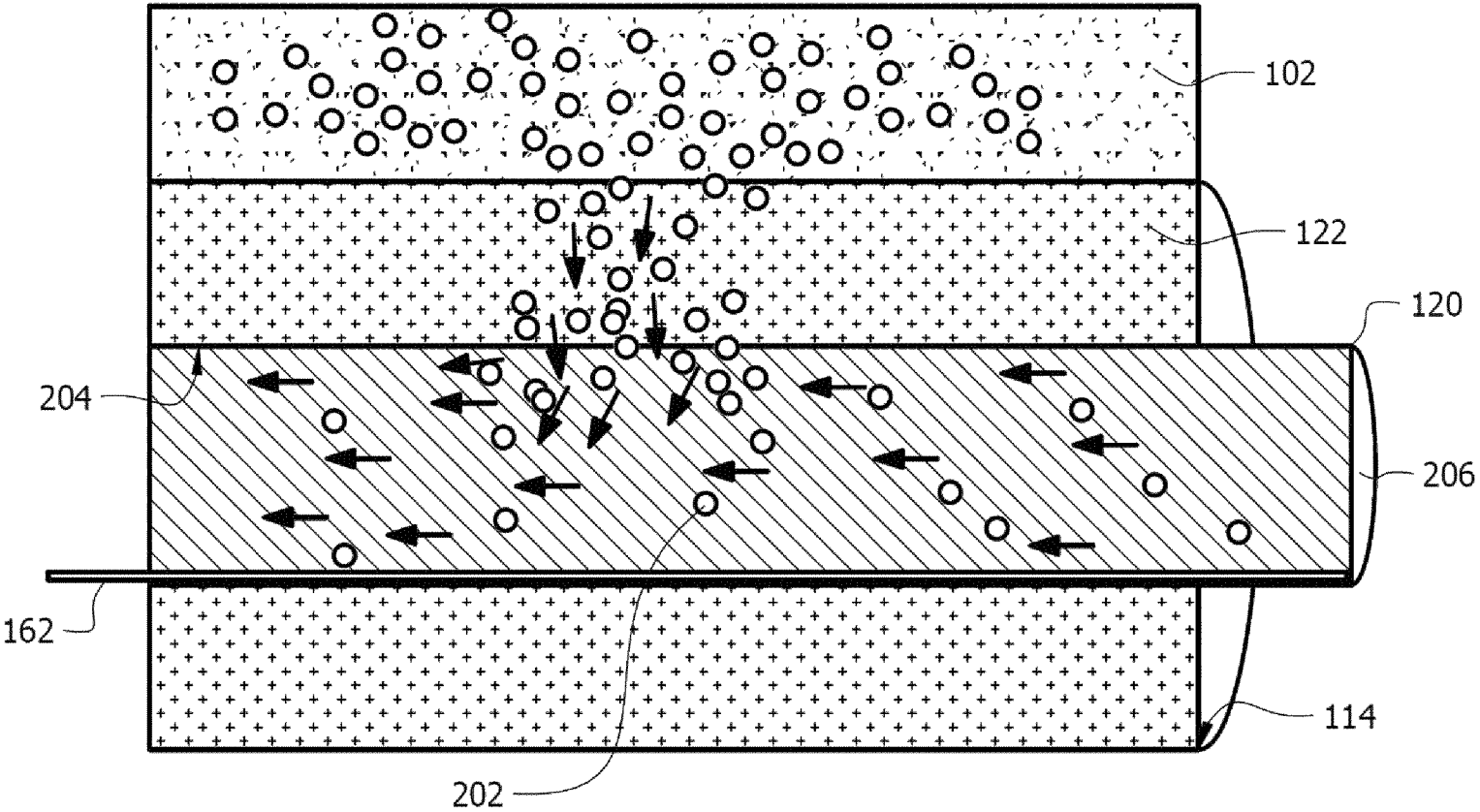
FIG. 3 is a schematic view of an embodiment of a wellbore tubular with fluid inflow and sand ingress according to some embodiments.

For example, as schematically illustrated in FIG. 3, sand 202 can flow from the formation 102 into the wellbore 114 and then into the tubular 120. As the sand 202 flows into the tubular 120, it can collide against the inner surface 204 of the tubular 120, and with the fiber 162 (e.g., in cases where the fiber 162 is placed within the tubular 120), in a random fashion. Without being limited by this or any particular theory, the intensity of the collisions depends on the effective mass and the rate of change in the velocity of the impinging sand particles 202, which can depend on a number of factors including, without limitation, the direction of travel of the sand 202 in the wellbore 114 and/or tubular 120. The resulting random impacts can produce a random, broadband acoustic signal that can be captured on the optical fiber 162 coupled (e.g., strapped) to the tubular 120. The random excitation response tends to have a broadband acoustic signal with excitation frequencies extending up to the high frequency bands, for example, up to and beyond about 5 kHz depending on the size of the sand particles 202. In general, larger particle sizes may produce higher frequencies. The intensity of the acoustic signal may be proportional to the concentration of sand 202 generating the excitations such that an increased broad band power intensity can be expected at increasing sand 202 concentrations. In some embodiments, the resulting broadband acoustic signals that can be identified can include frequencies in the range of about 5 Hz to about 10 kHz, frequencies in the range of about 5 Hz to about 5 kHz or about 50 Hz to about 5 kHz, or frequencies in the range of about 500 Hz to about 5 kHz. Any frequency ranges between the lower frequencies values (e.g., 5 Hz, 50 Hz, 500 Hz, etc.) and the upper frequency values (e.g., 10 kHz, 7 kHz, 5 kHz, etc.) can be used to define the frequency range for a broadband acoustic signal.

The sand particles 202 entering the wellbore 114 can be carried within a carrier fluid 206, and the carrier fluid 206 can also generate high intensity acoustic background noise when entering the wellbore 114 due to the turbulence associated with the fluid flowing into the tubular 120. This background noise generated by the turbulent fluid flow is generally expected to be predominantly in a lower frequency region. For example, the fluid inflow acoustic signals can be between about 0 Hz and about 500 Hz, or alternatively between about 0 Hz and about 200 Hz. An increased power intensity can be expected at low frequencies resulting from increased turbulence in the carrier fluid flow. The background noises can be detected as superimposed signals on the broad-band acoustic signals produced by the sand 202 when the sand ingress occurs.

A number of acoustic signal sources can also be considered along with the types of acoustic signals these sources generate. In general, a variety of signal sources can be considered including fluid flow with or without sand 202 through the formation 102, fluid flow with or without sand 202 through a gravel pack 122, fluid flow with or without sand 202 within or through the tubular 120 and/or sand screen 118, fluid flow with sand 202 within or through the tubular 120 and/or sand screen 118, fluid flow without sand 202 into the tubular 120 and/or sand screen 118, gas/liquid inflow, hydraulic fracturing, fluid leaks past restrictions (e.g., gas leaks, liquid leaks, etc.) mechanical instrumentation and geophysical acoustic noises and potential point reflection noise within the fiber caused by cracks in the fiber optic cable/conduit under investigation.

For the flow of fluid 206, with the potential for sand 202 to be carried with the flowing fluid 206, in the formation 102, the likelihood that any resulting acoustic signal would be captured by the optical fiber 162 is considered low. Further, the resulting acoustic signal would likely be dominated by low frequencies resulting from turbulent fluid flow. Similarly, the fluid flowing within the gravel pack 122 would likely flow with a low flow speed and therefore limit the generation and intensity of any acoustic signals created by the sand 202. Thus, the acoustic response would be expected to occur in the lower frequency range.

For the flow of fluid 206 with or without sand 202 through a gravel pack 122, the likelihood that any resulting acoustic signal would be captured by the acoustic sensor is also considered low. Further, the resulting acoustic signal would likely be dominated by low frequencies resulting from turbulent fluid flow.

For the flow of fluid 206 with or without sand 202 within or through the tubular 120, the likelihood of capturing an acoustic signal is considered high due to the proximity of the source of the acoustic signals to the optical fiber 162 coupled to the tubular 120. This type of flow can occur as the fluid 206 containing sand 202 flows within the tubular 120. Such flow would result in any sand flowing generally parallel to the inner surface 204 of the tubular 120, which would limit the generation of high frequency sounds as well as the intensity of any high frequency sounds that are generated. It is expected that the acoustic signals generated from the flow of the fluid 206 through the tubular 120 and/or sand screen 118 may be dominated by low frequency acoustic signals resulting from turbulent fluid flow.

In an embodiment, the acoustic signal due to fluid 206 containing sand 202 within the tubular 120 can be expected to have a rise in acoustic intensity from about 0 Hz to about 50 Hz, with a roll-off in power between about 20 Hz to about 50 Hz.

For the flow of fluid 206 without any sand 202 into the tubular 120 and/or sand screen 118, the proximity to the optical fiber 162 can result in a high likelihood that any acoustic signals generated would be detected by the acoustic sensor. As discussed herein, the flow of fluid 206 alone without any sand 202 is expected to produce an acoustic signal dominated by low frequency signals due to the acoustic signals being produced by turbulent fluid flow.

For the flow of fluid 206 with sand 202 into the tubular 120 and/or sand screen 118, the proximity to the optical fiber 162 can result in a high likelihood that any acoustic signals generated would be detected by the optical fiber 162. As further discussed herein, the flow of fluid 206 with the sand 202 would likely result in an acoustic signal having broadband characteristics with excitation frequencies extending up to the high frequency bands, for example, up to and beyond about 5 kHz.

Referring again to FIG. 1, the processor 168 within the acquisition device 160 may be configured to perform various data processing processes to detect the presence of sand within a fluid flow along the length of the wellbore 114 (more specifically along the length of optical fiber 162). For instance, the memory 170 may be configured to store an application or program (e.g., comprising machine-readable instructions, such as, for instance, non-transitory machine-readable instructions) to perform the data analysis. While shown as being contained within the acquisition device 160, the memory 170 can comprise one or more memories, any of which can be external to the acquisition device 160. In some embodiments, the processor 168 can execute the application, which can configure the processor 168 to filter the acoustic data set spatially, determine one or more frequency domain features of the acoustic signal. In addition, in some embodiments the processor 168 (as a result of executing the application) may further determine whether or not sand is present within a fluid inflow or fluid flow at the selected location based on the analysis described hereinbelow. The analysis can be repeated across various locations along the length of the wellbore 114 to determine the locations of sand ingress, the makeup of a fluid carrying the sand (e.g., gas, water, hydrocarbon liquid, etc.), and the flow rate or amount of some or all of the fluid and/or the sand along the length of the wellbore 114.

Figure 4:
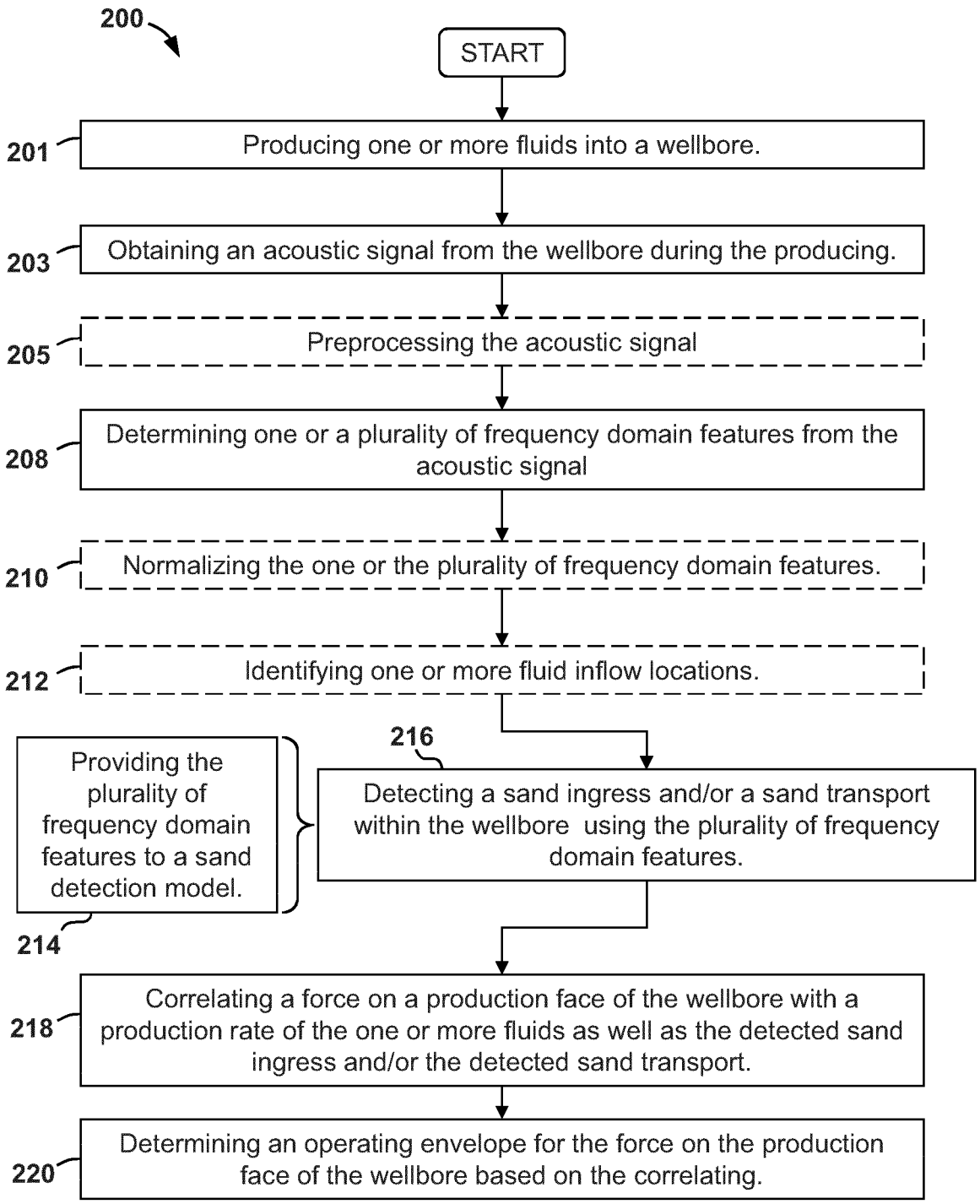
FIG. 4 is a flow diagram of a method of determining an operating envelope for a wellbore according to some embodiments.

Referring now to FIG. 4, a flow chart of a method 200 of determining an operating envelope for a wellbore is shown. As described herein, the described methods and related systems can be generally used to detect sand within a fluid flow. As used herein fluid flow can comprise fluid flow along or within a tubular within the wellbore such as fluid flow within a production tubular (e.g., production tubular 120 within wellbore 114). Fluid flow can also comprise fluid flow from the reservoir or formation into a wellbore tubular and/or an annular space between the wellbore tubular and the formation face. Such flow into the wellbore and/or a wellbore tubular can be referred to as fluid inflow. While fluid inflow may be separately identified at times in this disclosure, such fluid inflow is considered a part of fluid flow within the wellbore. In addition, as used herein "sand ingress," refers to the situation where a particulate and/or solid material (e.g., sand, gravel, solids, etc.) is entering into the wellbore from the subterranean formation (e.g., such as within a fluid inflow), and "sand transport" refers to the situation where the particulate material is flowing along a wellbore (e.g., such as within a fluid flow).

Generally speaking, method 200 may comprise producing one or more fluids into a wellbore at 201, obtaining an acoustic signal along the wellbore at 203, and determining one or a plurality of frequency domain features from the acoustic signal at 208, detecting a sand ingress and/or a sand transport within the wellbore using the plurality of frequency domain features at 216, correlating a force on a production face of the wellbore with the detected sand ingress and/or the detected sand transport at 218, and determining an operating envelope for a force on the production face of the wellbore based on the correlating at 220. In some embodiments, the force on the production face of the wellbore an optionally also be correlated with a production rate of one or more fluids. In some embodiments, method 200 includes identifying one or more fluid inflow locations at 212. In some embodiments, method 200 includes identifying a sand ingress and/or transport within a flow at the one or more fluid inflow locations using the plurality of frequency domain features at 216. In some embodiments method 200 may comprise preprocessing the acoustic signal at 205 prior to determining the one or the plurality of frequency domain features from the acoustic signal at 208. In addition, in some embodiments, method 200 may comprise normalizing the one or the plurality of frequency domain features at 210 and/or identifying the one or more fluid flow locations at 212 prior to identifying sand within a flow at 216. The above noted features of method 200 are now described in more detail below.

Initially, method 200 includes producing one or more fluids into a wellbore at 201. Referring briefly again to FIG. 1 in addition to FIG. 3, in some embodiments, producing the one or more fluids into the wellbore may comprise producing fluids into a wellbore 114 at one or more production zones 104*a*, 104*b* and flowing the produced fluids into and through a production tubular 120. As previously described above, the fluid produced at 201 may comprise a number of different components, such as, for instance, hydrocarbon liquids (e.g., oil), hydrocarbon gases (e.g., ethane, methane, propane, etc.), aqueous fluids (e.g., water, salt water, etc.). In addition, as was also previously mentioned above, the one or more fluids produced into the wellbore at 201 may include sand or other particulate matter produced from the formation 102.

Referring again to FIG. 3, method 200 next includes obtaining an acoustic signal at 203. Such an acoustic signal can be obtained via any suitable method. For instance, the acoustic signal may be obtained utilizing a DAS system, such as, for instance the DAS system 110 shown in FIG. 1, in the manner previously described above.

After the acoustic signal is obtained at 203, method 200 may proceed, in some embodiments, to pre-process the raw data at 205. The acoustic signal can be generated within the wellbore as previously described. Depending on the type of DAS system employed (e.g., DAS system 110 in FIG. 1), the optical data may or may not be phase coherent and may be pre-processed to improve the signal quality (e.g., denoised for opto-electronic noise normalization/de-trending single point-reflection noise removal through the use of median filtering techniques or even through the use of spatial moving average computations with averaging windows set to the spatial resolution of the acquisition unit, etc.). The raw optical data from the acoustic sensor can be received, processed, and generated by the sensor to produce the acoustic signal. The data rate generated by various acoustic sensors such as the DAS system can be large. For example, the DAS system may generate data on the order of 0.5 to about 2 terabytes per hour. This raw data can optionally be stored in a memory (e.g., memory 170 for DAS system 110 in FIG. 1).

A number of specific processing steps can be performed to determine the presence of fluid inflow (or flow), and to detect a sand ingress or sand transport within the detected fluid inflow (or flow). In some embodiments, a processor or collection of processors (e.g., processor 168 in FIG. 1) may be utilized to perform the preprocessing steps described herein. In an embodiment, the noise detrended "acoustic variant" data can be subjected to an optional spatial filtering step following the other pre-processing steps, if present. A spatial sample point filter can be applied that uses a filter to obtain a portion of the acoustic signal corresponding to a desired depth or depth range in the wellbore. Since the time the light pulse sent into the optical fiber returns as backscattered light can correspond to the travel distance, and therefore depth in the wellbore, the acoustic data can be processed to obtain a sample indicative of the desired depth or depth range. This may allow a specific location within the wellbore to be isolated for further analysis. The pre-processing at 205 may also include removal of spurious back reflection type noises at specific depths through spatial median filtering or spatial averaging techniques. This is an optional step and helps focus primarily on an interval of interest in the wellbore. For example, the spatial filtering step can be used to focus on a producing interval where there is high likelihood of sand ingress, for example. The resulting data set produced through the conversion of the raw optical data can be referred to as the acoustic sample data.

Filtering can provide several advantages. For instance, when the acoustic data set is spatially filtered, the resulting data, for example the acoustic sample data, used for the next step of the analysis can be indicative of an acoustic sample over a defined depth (e.g., the entire length of the optical fiber, some portion thereof, or a point source in the wellbore 114). In some embodiments, the acoustic data set can comprise a plurality of acoustic samples resulting from the spatial filter to provide data over a number of depth ranges. In some embodiments, the acoustic sample may contain acoustic data over a depth range sufficient to capture multiple points of interest. In some embodiments, the acoustic sample data contains information over the entire frequency range of the detected acoustic signal at the depth represented by the sample. This is to say that the various filtering steps, including the spatial filtering, do not remove the frequency information from the acoustic sample data.

In some embodiments, the filtered data may be additionally transformed from the time domain into the frequency domain using a transform at 205 (e.g., after it has been filtered—such as spatially filtered as described above). For example, Discrete Fourier transformations (DFT) or a short time Fourier transform (STFT) of the acoustic variant time domain data measured at each depth section along the fiber or a section thereof may be performed to provide the data from which the plurality of frequency domain features can be determined. The frequency domain features can then be determined from the acoustic data. Spectral feature extraction using the frequency domain features through time and space can be used to determine the spectral conformance (e.g., whether or not one or more frequency domain features match or conform to certain signature thresholds) and determine if an acoustic signature (e.g., a sand ingress signature, a sand flow signature, etc.) is present in the acoustic sample. Within this process, various frequency domain features can be calculated for the acoustic sample data.

Preprocessing at 205 can optionally include a noise normalization routine to improve the signal quality. This step can vary depending on the type of acquisition device used as well as the configuration of the light source, the sensor, and the other processing routines. The order of the aforementioned preprocessing steps can be varied, and any order of the steps can be used.

Preprocessing at 205 can further comprise calibrating the acoustic signal. Calibrating the acoustic signal can comprise removing a background signal from the acoustic signal, aligning the acoustic data with physical depths in the wellbore, and/or correcting the acoustic signal for signal variations in the measured data. In some embodiments, calibrating the acoustic signal comprises identifying one or more anomalies within the acoustic signal and removing one or more portions of the acoustic signal outside the one or more anomalies.

Following the preprocessing at 205, method 200 may determine one or a plurality of frequency domain features from the acoustic signal at 208. The use of frequency domain features to identify inflow locations, inflow discrimination, sand ingress and/or transport detection (e.g., within fluid inflow and/or fluid flow), and flow rate classification (e.g., for fluid inflow/flow and/or sand ingress/transport) can provide a number of advantages. First, the use of frequency domain features results in significant data reduction relative to the raw DAS data stream. Thus, a number of frequency domain features can be calculated and used to allow for event identification while the remaining data can be discarded or otherwise stored, and the remaining analysis can performed using the frequency domain features. Even when the raw DAS data is stored, the remaining processing power is significantly reduced through the use of the frequency domain features rather than the raw acoustic data itself. Further, the use of the frequency domain features can, with the appropriate selection of one or more of the frequency domain features, provide a concise, quantitative measure of the spectral character or acoustic signature of specific sounds pertinent to downhole fluid surveillance and other applications.

While a number of frequency domain features can be determined for the acoustic sample data, not every frequency domain feature may be used in the identifying fluid flow characteristics, inflow locations, flow type, sand ingress/transport detection, or flow rate classification or prediction. The frequency domain features represent specific properties or characteristics of the acoustic signals. There are a number of factors that can affect the frequency domain feature selection for each fluid inflow event. For example, a chosen descriptor should remain relatively unaffected by the interfering influences from the environment such as interfering noise from the electronics/optics, concurrent acoustic sounds, distortions in the transmission channel, and the like. In general, electronic/instrumentation noise is present in the acoustic signals captured on the DAS or any other electronic gauge, and it is usually an unwanted component that interferes with the signal. Thermal noise is introduced during capturing and processing of signals by analogue devices that form a part of the instrumentation (e.g., electronic amplifiers and other analog circuitry). This is primarily due to thermal motion of charge carriers. In digital systems additional noise may be introduced through sampling and quantization. The frequency domain features should have values that are significant for a given event in the presence of noise.

As a further consideration in selecting the frequency domain feature(s) for a sand ingress or sand transport event in some embodiments, the dimensionality of the frequency domain feature should be compact. A compact representation may be desired to decrease the computational complexity of subsequent calculations. It may also be desirable for the frequency domain feature to have discriminant power. For example, for different types of audio signals, the selected set of descriptors should provide altogether different values. A measure for the discriminant power of a feature is the variance of the resulting feature vectors for a set of relevant input signals. Given different classes of similar signals, a discriminatory descriptor should have low variance inside each class and high variance over different classes. The frequency domain feature should also be able to completely cover the range of values of the property it describes.

In some embodiments, combinations of frequency domain features can be used. This can include an event signature (e.g., such as a sand ingress signature or a sand transport signature, etc.) having multiple frequency domain features as indicators. In some embodiments, a plurality of frequency domain features can be transformed to create values that can be used to define various event signatures. This can include mathematical transformations including ratios, equations, rates of change, transforms (e.g., wavelets, Fourier transforms, other wave form transforms, etc.), other features derived from the feature set, and/or the like as well as the use of various equations that can define lines, surfaces, volumes, or multi-variable envelopes. The transformation can use other measurements or values outside of the frequency domain features as part of the transformation. For example, time domain features, other acoustic features, and non-acoustic measurements can also be used. In this type of analysis, time can also be considered as a factor in addition to the frequency domain features themselves. As an example, a plurality of frequency domain features can be used to define a surface (e.g., a plane, a three-dimensional surface, etc.) in a multivariable space, and the measured frequency domain features can then be used to determine if the specific readings from an acoustic sample fall above or below the surface. The positioning of the readings relative to the surface can then be used to determine if the event is present or not at that location in that detected acoustic sample.

As an example, the chosen set of frequency domain features should be able to uniquely identify the event signatures with a reasonable degree of certainty of each of the acoustic signals pertaining to a selected downhole surveillance application or fluid inflow event as described herein. Such frequency domain features can include, but are not limited to, the spectral centroid, the spectral spread, the spectral roll-off, the spectral skewness, the root mean square (RMS) band energy (or the normalized sub-band energies/band energy ratios), a loudness or total RMS energy, a spectral flatness, a spectral slope, a spectral kurtosis, a spectral flux, a spectral autocorrelation function, or a normalized variant thereof.

The spectral centroid denotes the "brightness" of the sound captured by the optical fiber (e.g., optical fiber 162 shown in FIG. 1) and indicates the center of gravity of the frequency spectrum in the acoustic sample. The spectral centroid can be calculated as the weighted mean of the frequencies present in the signal, where the magnitudes of the frequencies present can be used as their weights in some embodiments.

The spectral spread is a measure of the shape of the spectrum and helps measure how the spectrum is distributed around the spectral centroid. In order to compute the spectral spread, Si, one has to take the deviation of the spectrum from the computed centroid as per the following equation (all other terms defined above):

$$S_i = \sqrt{\frac{\sum_{k=1}^{N} (f(k) - C_i)^2 X_i(k)}{\sum_{k=1}^{N} X_i(k)}}. \quad \text{(Eq. 2)}$$

The spectral roll-off is a measure of the bandwidth of the audio signal. The Spectral roll-off of the $i^{th}$ frame, is defined as the frequency bin 'y' below which the accumulated magnitudes of the short-time Fourier transform reach a certain percentage value (usually between 85%-95%) of the overall sum of magnitudes of the spectrum.

$$\sum_{k=1}^{y} |X_i(k)| = \frac{c}{100} \sum_{k=1}^{N} |X_i(k)|, \quad \text{(Eq. 3)}$$

where c=85 or 95. The result of the spectral roll-off calculation is a bin index and enables distinguishing acoustic events based on dominant energy contributions in the frequency domain (e.g., between gas influx and liquid flow, etc.).

The spectral skewness measures the symmetry of the distribution of the spectral magnitude values around their arithmetic mean.

The RMS band energy provides a measure of the signal energy within defined frequency bins that may then be used for signal amplitude population. The selection of the bandwidths can be based on the characteristics of the captured acoustic signal. In some embodiments, a sub-band energy ratio representing the ratio of the upper frequency in the selected band to the lower frequency in the selected band can range between about 1.5:1 to about 3:1. In some embodiments, the sub-band energy ratio can range from about 2.5:1 to about 1.8:1, or alternatively be about 2:1 The total RMS energy of the acoustic waveform calculated in the time domain can indicate the loudness of the acoustic signal. In some embodiments, the total RMS energy can also be extracted from the temporal domain after filtering the signal for noise.

The spectral flatness is a measure of the noisiness/tonality of an acoustic spectrum. It can be computed by the ratio of the geometric mean to the arithmetic mean of the energy spectrum value and may be used as an alternative approach to detect broad-banded signals. For tonal signals, the spectral flatness can be close to 0 and for broader band signals it can be closer to 1.

The spectral slope provides a basic approximation of the spectrum shape by a linearly regressed line. The spectral slope represents the decrease of the spectral amplitudes from low to high frequencies (e.g., a spectral tilt). The slope, the y-intersection, and the max and media regression error may be used as features.

The spectral kurtosis provides a measure of the flatness of a distribution around the mean value.

The spectral flux is a measure of instantaneous changes in the magnitude of a spectrum. It provides a measure of the frame-to-frame squared difference of the spectral magnitude vector summed across all frequencies or a selected portion of the spectrum. Signals with slowly varying (or nearly constant) spectral properties (e.g., noise) have a low spectral flux, while signals with abrupt spectral changes have a high spectral flux. The spectral flux can allow for a direct measure of the local spectral rate of change and consequently serves as an event detection scheme that could be used to pick up the onset of acoustic events that may then be further analyzed using the feature set above to identify and uniquely classify the acoustic signal.

The spectral autocorrelation function provides a method in which the signal is shifted, and for each signal shift (lag) the correlation or the resemblance of the shifted signal with the original one is computed. This enables computation of the fundamental period by choosing the lag, for which the signal best resembles itself, for example, where the autocorrelation is maximized. This can be useful in exploratory signature analysis/even for anomaly detection for well integrity monitoring across specific depths where well barrier elements to be monitored are positioned.

Any of these frequency domain features, or any combination of these frequency domain features (including transformations of any of the frequency domain features and combinations thereof), can be used to detect sand ingress and/or sand transport within the wellbore as well as to potentially determine the location, type, and flow rate of fluid inflow or fluid flow as described herein. In an embodiment, a selected set of characteristics can be used to identify the presence or absence for each event, and/or all of the frequency domain features that are calculated can be used as a group in characterizing the presence or absence of an event. The specific values for the frequency domain features that are calculated can vary depending on the specific attributes of the acoustic signal acquisition system, such that the absolute value of each frequency domain feature can change between systems. In some embodiments, the frequency domain features can be calculated for each event based on the system being used to capture the acoustic signal and/or the differences between systems can be taken into account in determining the frequency domain feature values for each fluid inflow event between or among the systems used to determine the values and the systems used to capture the acoustic signal being evaluated.

One or a plurality of frequency domain features can be used to detect a sand ingress or sand transport event and/or to quantify an amount (e.g., flow rate) of sand associated with a sand ingress or sand transport event (which may be referred to herein as a sand ingress rate or sand transport rate, respectively). In some embodiments, one or a plurality of frequency domain features can also be used to detect a sand ingress or sand transport event and/or to identify component rate or amount associated with a sand ingress or sand transport event. In an embodiment, one, or at least two, three, four, five, six, seven, eight, etc. different frequency domain features can be used to detect a sand ingress or transport and/or quantify a flow rate of sand associated with the sand ingress or transport. The frequency domain features can be combined or transformed in order to define the event signatures for one or more events, such as, for instance, a sand ingress signature to indicate sand flowing into a wellbore, and/or a sand transport signature to indicate the transport or flowing of sand within and along the wellbore. While exemplary numerical ranges are provided herein, the actual numerical results may vary depending on the data acquisition system and/or the values can be normalized or otherwise processed to provide different results.

Referring still to FIG. 4, as previously described in some embodiments method 200 may also comprise normalizing the one or the plurality of frequency domain features at 210 and/or then identifying the one or more fluid inflow locations at 212 prior to detecting a sand ingress and/or a sand transport at 216. As shown in FIG. 3, in some embodiments, method 200 may proceed to identifying the one or more fluid inflow locations at 212 without first normalizing the frequency domain features at 210. The one or more fluid inflow locations at 212 may be determined via other data, knowledge or experience as known to those of having ordinary skill. For instance, in some embodiments, the one or more fluid inflow locations may be determined via PLS data at 212. In some embodiments, the one or more fluid inflow locations at 212 are determined as described hereinbelow.

For example, in some embodiments, block 212 may comprise identifying the one or more fluid flow and/or inflow locations using one or more of the frequency domain features to identify acoustic signals corresponding to the flow and/or inflow, and correlating the depths of those signals with locations within the wellbore. The one or more frequency domain features can comprise at least two different frequency domain features in some embodiments. In some embodiments, the one or more frequency domain features utilized to determine the one or more fluid inflow locations comprises at least one of a spectral centroid, a spectral spread, a spectral roll-off, a spectral skewness, an RMS band energy, a total RMS energy, a spectral flatness, a spectral slope, a spectral kurtosis, a spectral flux, a spectral autocorrelation function, as well as combinations, transformations, and/or normalized variant(s) thereof.

In some embodiments, block 212 of method 200 may comprise: identifying a background fluid flow signature using the acoustic signal; and removing the background fluid flow signature from the acoustic signal prior to identifying the one or more fluid inflow locations. In some embodiments, identifying the one or more fluid inflow locations comprises identifying one or more anomalies in the acoustic signal using the one or more frequency domain features of the plurality of frequency domain features; and selecting the depth intervals of the one or more anomalies as the one or more inflow locations. When a portion of the signal is removed (e.g., a background fluid flow signature, etc.), the removed portion can also be used as part of the event analysis. Thus, in some embodiments, identifying the one or more fluid inflow locations at block 212 comprises: identifying a background fluid flow signature using the acoustic signal; and using the background fluid flow signature from the acoustic signal to identify an event such as one or more fluid flow events.

Without being limited to this or any other theory, identifying one or more fluid inflow locations at 212 may be useful for identifying the locations within the wellbore that a sand ingress event may occur. Thus, further analysis to determine whether a sand ingress is occurring may be focused on these identified locations so as to potentially reduce processing power and data collection during operations.

Referring still to FIG. 4, in some embodiments, method 200 comprises detecting a sand ingress and/or a sand transport within the wellbore (e.g., an inflow and/or a fluid flow within a wellbore) using a plurality of frequency domain features at 216. In some embodiments, method 200 may progress to block 216 immediately following block 208 or following blocks 210 and/or 212 as previously described above and shown in FIG. 4. Thus, in some embodiments block 216 may comprise detecting a sand ingress and/or sand transport using the plurality of frequency domain features at the previously identified one or more fluid inflow locations from 212. In some embodiments, the plurality of frequency domain features utilized at block 216 may comprise one more of the frequency domain features described herein including combinations, variants (e.g., a normalized variant), and/or transformations thereof. For instance, in some embodiments, at least two such frequency domain features (and/or combinations, variants, or transformations thereof) are utilized at block 216. In some embodiments, the frequency domain features utilized within block 216 may comprise a ratio between at least two of the plurality of the frequency domain features.

In some embodiments, block 216 of method 200 may comprise providing the plurality of frequency domain features to a sand detection model (e.g., a logistic regression model) at 214 and detecting a sand ingress and/or sand transport within the wellbore based on the sand detection model. In some embodiments, the sand detection model can be developed using and/or may include machine learning such as a neural network, a Bayesian network, a decision tree, a logistical regression model, or a normalized logistical regression, or other supervised learning models. In some embodiments, the model at 214 may define a relationship between at least two of the plurality of the frequency domain features, including in some embodiments combinations, variations, and/or transformations of the frequency domain features and the presence or occurrence of sand ingress and/or a sand transport. Thus, the sand detection model at block 214 may comprise a multivariable model in which the two or more frequency domain features are variables that may be provided by acoustic data (e.g., such as acoustic data obtained from DAS system 110 as previously described above). Thus, the sand detection model may utilize one or more (e.g., at least two) of the frequency domain features as inputs therein. In some embodiments, block 216 (e.g., including block 214) may comprise utilizing the plurality of frequency domain features at the identified one or more fluid inflow locations (e.g., such as at the production zones 104*a*, 104*b* shown in FIG. 1) in the sand detection model and then comparing the plurality of frequency domain features to an output of the model(s); and detecting a sand ingress event based on the comparison(s).

The sand detection model at 214 may be configured to detect sand ingresses and/or sand transports in different fluid phases, at different sand amounts, in different orientations, and through different types of production assemblies, pipes, annuli, and the like. In some embodiments, the sand detection model at 214 may be trained to detect the sand ingress and/or sand transport events. Specifically, acoustic data from a known fluid flow (e.g., one in which the presence and/or amount of sand therein is known or otherwise determined) can be used in the sand detection model development process to determine one or more multivariate models indicative of the presence of sand in an inflowing fluid in one or more fluid phases and/or in a flowing fluid within the wellbore within one or more fluid phases. Such multivariate models may then be used with detected acoustic data at 214 and 216 to determine if a sand ingress and/or a sand transport is occurring within the wellbore.

In some embodiments, the sand detection model at 214 may define one or more event signatures based on selected frequency domain features (or combinations, transformations, or variants thereof). For instance, a sand detection model may define a first event signature for sand ingress from one or more production zones (e.g., productions zones 104*a*, 104*b* in FIG. 1), and a second event signature for sand transport along the wellbore. In some embodiments, the sand detection model may define a plurality of sand ingress signatures for determining if sand is flowing into the wellbore at multiple locations and/or under multiple fluid flow conditions. Similarly, the sand detection model may define a plurality of sand transport signatures for determining if sand flowing or being transported within different portions of the wellbore. Thus, during operations, the frequency domain features from the obtained acoustic signal may be compared against the predetermined event signatures, and a determination may be made that the particular event(s) are occurring if the selected frequency domain features substantially correspond with the event signature (e.g., the frequency domain features or combinations, variants, transformations thereof are within a threshold range, are greater than, equal to, or less than a predetermined decision threshold, etc. defined by the event signature, etc.).

In some embodiments, the sand detection model at 214 may not only be configured to detect the presence of a sand ingress and/or a sand transport within the wellbore, but may also be configured to determine or detect an amount or flow rate of sand associated with the detected sand ingress and/or sand transport. In some embodiments, a multivariable model (or a set of multivariable models) may then be utilized to determine an amount, or production rate of the sand that is associated with a given (e.g., detected) sand ingress and/or sand transport event. In some embodiments, the multivariable model(s) may utilize a plurality of frequency domain features (e.g., such as at least two frequency domain features) as inputs to determine a production rate or amount of the sand. For instance, the multivariable model(s) may classify the production rate or amount of sand within the sand ingress and/or sand transport into one or more predetermined ranges or buckets based on a plurality of decision boundaries that are dependents upon chosen sets or groups of frequency domain features. Thus, by applying the obtained acoustic data to the second multivariable model(s), one may determine whether sand production falls within a plurality of predetermined production rate ranges (e.g., such as a low, medium, and high range having preselected production rate boundaries).

In some embodiments, the sand detection model at 214 may be configured to determine or detect a sand ingress and/or sand transport event when the production rate or amount of sand within the particular event is above a predetermined threshold (e.g., a sand ingress threshold, a sand transport threshold, etc.). Thus, in these embodiments, the multivariable model at 214 may be constructed and trained so as to "detect" the sand ingress and/or sand transport when a production rate of the sand within the sand ingress and/or sand transport rises above some predetermined minimum value (e.g., such as a 5 million barrels per day—mbpd—in some embodiments). An operator may select the predetermined minimum value based on the production characteristics of the well, the design of the production equipment (e.g., both within the wellbore and at the surface), etc. Thus, the predetermined minimum or threshold value of sand may range greatly in various embodiments.

In some embodiments, the detection of the sand ingress and/or the sand transport may occur while simultaneously producing one or more fluids into and/or from the wellbore (e.g., hydrocarbon liquids, water, hydrocarbon gas, etc.). The components and/or flow rates of the one or more fluids may also be determined via a multivariable model which may be substantially similar to the sand detection model described above. In particular, in some embodiments, one or more multivariable models (e.g., logistic regression models) may utilize one or more frequency domain features (as well as combinations, variants, and/or transformations thereof) to detect a fluid inflow/flow, determine the one or more fluids within the fluid inflow/flow, and/or to classify the flow rates of the detected fluids of the one or more fluids.

In addition, in some embodiments, the one or more fluids produced into and/or from the wellbore may be detected and/or characterized via other methods that do not employ the use of multivariable models having frequency domain features as inputs. For instance, in some embodiments, the detection and characterization (e.g., including fluid types and flow rates therefor) may be determined via analysis of fluids emitted from the wellbore at or near the surface.

Referring still to FIG. 4, after detecting a sand ingress and/or a sand transport within wellbore at 216, method 200 proceeds to correlate a force on a production face of the wellbore (e.g., such as a force on a production face of one or more of the production zones in the wellbore) with the detected sand ingress and/or the detected sand transport at 218. As previously described, the force on the production face of the wellbore may be measured or characterized by at least one of a rate of pressure change in the production zone (e.g., production zones 104*a*, 104*b* in FIG. 1), a flux of the one or more fluids through the production face of the wellbore, or an acceleration of the one or more fluids between a reservoir and an interior of the wellbore at the production face of the wellbore. Thus, in some embodiments, the correlating at block 218 may comprise correlating one or more of the above listed parameters as the force on the production face, to the sand ingress and/or the sand transport. In some embodiments, the correlation at block 218 may comprise correlating a plurality of (i.e., two or more) of the above listed parameters to the production rate of the one or more fluids as well as the sand ingress and/or the sand transport. In some embodiments, the correlating at block 218 may comprise correlating one or more of the above listed parameters as the force on the production face, to the production rate of the one or more fluids in addition to the sand ingress and/or the sand transport.

In some embodiments, the sand monitoring system can provide information on the rate of sand ingress and/or sand transport along with fluid flow rates and phase information. For example, an acoustic monitoring system can be used to identify one or more fluid phases (e.g., a gas phase, a hydrocarbon phase, an aqueous phase) along with flow rate information. This information can also be correlated with the force on the production face of the wellbore and/or the sand ingress and/or sand transport locations to become part of the operating envelope.

In some embodiments, the force on the production face may be measured (e.g., particularly any one or more of the parameters listed above) with a pressure monitoring system comprising one or more pressure sensors disposed within the wellbore (e.g., such as pressure monitoring system 130 in FIG. 1). For instance, each of the above listed parameters for measuring the force on the production face may be determined, inferred, or directly measured at least partially through monitoring of a downhole pressure (e.g., wellbore pressure, a production zone pressure, formation pressure, drawdown pressure, etc.) via a pressure monitoring system as described herein.

A flux of the one or more fluids through the production face refers to an amount of fluid passing through an area defined by the production face within the production zone per time period. The flux can be measured using flow rate measurements obtained from the DAS or other sensors along with known geometric parameters of the wellbore and production face. The flux provides a measure of the force on the face of the formation by relating the amount of fluid being drawn across the face over time. In general, a larger fluid flow across the face of the formation (and thus a high flux) per each unit of time correlates to a larger force on the production face of the wellbore. The rate of change of the flux can also affect the amount of sand where a larger change in the flux (e.g., a larger increase in the flux) can result in a higher rate of sanding.

Similarly, an acceleration of the one or more fluids between the reservoir and the interior of the wellbore can be measured using flow and/or pressure measurements within a production zone. The acceleration of the one or more fluids can be related to a force on the formation wall, which can affect the rate of sand ingress into the wellbore.

In some embodiments, the correlation at block 218 may comprise correlating the sand ingress and/or the sand transport as a sand ingress rate and/or a sand transport rate, respectively. In these embodiments, the sand ingress rate and/or the sand transport rate may be determined via the sand detection model in the manner previously described above.

In some embodiments, the correlating at block 218 may comprise constructing a look up table and/or a mathematical relationship and/or model. In some embodiments, the correlating at block 218 may comprise constructing a plurality of look up tables and/or a plurality of mathematical relationships and/or models.

In addition, in some embodiments, the correlating at block 218 may comprise constructing a sand prediction model that correlates the sand ingress and/or the sand transport (including the sand ingress rate and/or the sand transport rate as described above) with the production rate of the one or more fluids from the wellbore, and one or more parameters listed above to characterize the force on the production face of the production zone. In some embodiments, the sand prediction model may correlate the sand ingress and/or the sand transport with one or more (or two or more) of the production rate of the one of more fluids, a rate of pressure change within the wellbore, a flux of the one or more fluids through the production face of the wellbore, an acceleration of the one more fluids between the reservoir and an interior of the wellbore at the production face of the wellbore, or one or more geophysical properties of the reservoir (e.g., such as a production zone within the reservoir). Thus, the sand prediction model may receive input (at least partially) from the output of the sand detection model described above (e.g., such as the detected sand ingress and/or sand transport events, and/or potentially the sand ingress rates and/or the sand transport rates).

In some embodiments, the sand prediction model can be developed using and/or may include machine learning such as a neural network, a Bayesian network, a decision tree, a logistical regression model, or a normalized logistical regression, or other supervised learning models. In some embodiments, the sand prediction model may predict a sand ingress and/or sand transport (including in some embodiments a sand ingress rate and/or a sand transport rate) based on a production rate of the one or more fluids from the production zone of the wellbore and the force on the production face as described above. In some embodiments, the sand prediction model may predict a sand ingress and/or a sand transport (including in some embodiments a sand ingress rate and/or a sand transport rate) based on one or more geophysical properties of the production zone either in lieu of or in addition to the other parameters described above. In some embodiments the one or more geophysical features may comprise porosity, permeability, a measure of consolidation of a formation material, a type of formation material, or any combination or variant thereof.

After correlating the force on the production face of the wellbore and the production rate of the one or more fluids with the sand ingress and/or sand transport at 218, method 200 proceeds to determine an operating envelope for the force on the production face of the wellbore based on the correlating at 220. In some embodiments, the operating envelope may be defined by an upper limit which may define a maximum force on the production face of the wellbore that does not also cause or result in sand ingress or at least results in sand ingress below a predetermined threshold.

As previously described, the force on the production face of the wellbore may be measured or characterized one or more of a variety of parameters, and thus the operating envelope may provide for minimum and maximum values of one or more of these particular parameters during production operations for the wellbore. For instance, in some embodiments, the force on the production face of the wellbore may comprise a rate of pressure change within the production zone (e.g., productions zones 104*a*, 104*b* in FIG. 1), which may be further characterized by a rate of change for the drawdown pressure as previously described above. Without being limited to this or any other theory, a rate of pressure change in the production zone of the well (and thus also a rate of drawdown pressure change) may drive the flux and/or acceleration of fluids through the production zone of the well during production operations. Thus, as the rate of pressure change increases (particularly as the pressure in the wellbore is decreased relative to the pressure within the production zone), the flux and acceleration of the fluids within the production zone toward and into the wellbore may increase so as to dislodge and fluidized greater amounts of sand within the production zone (e.g., production zones 104*a*, 104*b* in FIG. 1) into the wellbore. Therefore, the operating envelope determined at 220 may provide range of values for the rate of change for the production zone pressure and/or the drawdown pressure (or one or more of the other values that may be used to characterize or represent the force on the production face as described herein) that may avoid sand ingress within the wellbore.

In some embodiments, a boundary, such as for instance an upper boundary or limit, of the operating envelope may be a function of at least one of an absolute wellbore pressure and/or a production rate of the one of more fluids from the production zone(s) (e.g., production zones 104*a*, 104*b* in FIG. 1). As previously explained, both of these values are related to the previously listed parameters for measuring or characterizing the force on the production face of a production zone in the wellbore, and thus, during operations, the operating envelope determined at block 220 may be utilized to determine boundaries or limits for the absolute wellbore pressure and/or the production rate of the one or more fluids (e.g., hydrocarbon liquids, hydrocarbon gases, water, etc.).

In some embodiments, the upper limit of the operating envelope may comprise a limit of the force on the production face of the wellbore, above which sand ingress and/or sand transport may occur (e.g., sand ingress can occur above a threshold amount or rate). In some embodiments, the upper limit of the operating envelope may comprise a limit of the force on the production face of the wellbore, above which the sand ingress rate and/or sand transport may rise above a predetermined maximum threshold value may occur. For instance, a wellbore operator may choose to allow or accept some amount or rate of sand ingress and/or sand transport during operations. In some embodiments, an acceptable amount or rate of sand ingress or transport may comprise producing substantially no sand into the wellbore (i.e., a sand ingress rate and/or a sand transport rate of substantially zero); however, in other embodiments, an acceptable amount or rate of sand may comprise an amount or rate of sand that may be passed through the flow paths and/or production equipment of the wellbore without (or without significant, appreciable, or otherwise unacceptable) wear or damage thereto. Moreover, an acceptable amount or rate of sand (e.g., such as a sand ingress rate or a sand transport rate) may comprise an amount or rate of sand that may be lifted or produced to the surface with the other one or more produced fluids (e.g., such that there is little to no accumulation of sand within the wellbore overtime).

In some embodiments, the operating envelope may be defined by a lower limit which may define a minimum amount of production (that is an amount or rate of the one or more fluids described above) from the wellbore. The minimum amount of production from the wellbore may be defined by economics. Specifically, the minimum amount of production may comprise a minimum amount of produced fluids that may provide sufficient revenue to offset a cost of maintaining and producing the wellbore. In some embodiments, the minimum amount of production may be a minimum amount of production to prevent other problems or issues. For instance, the minimum amount of production may comprise a minimum amount or flow rate that will sufficiently lift liquid (e.g., water) from the wellbore such that water loading of the wellbore may be prevented or at least delayed.

In some embodiments, the operating window may be determined at block 220 utilizing the sand prediction model developed at 218. Thus, the sand prediction model may provide an operating envelope for the force on the production face (or operating envelopes for any one or more of the above listed parameters that may be used to measure or characterize the force on the production face) that may provide an acceptable amount or rate of sand ingress and/or sand transport from the wellbore (which may comprise substantially no sand ingress and/or transport as previously described above).

In some embodiments, a processor (e.g., processor 168 in FIG. 1) or other controller may be coupled to a choke valve or other pressure adjustment mechanism of the wellbore. Thus, during operations, the processor may automatically make adjustments to the position of the choke so as to maintain the well within the operating envelope. For instance, if a well operator desires to increase a drawdown pressure of the well, the processor may automatically adjust the position of the choke valve to achieve the desired drawdown pressure while maintaining the rate of change within the operating envelope so as to avoid or at least limit sand ingress from the production zones of the well.

In some embodiments, following the determination of the operating envelope at 220, method 200 may include updating or refining the operating envelope based on subsequently acquired data or observations (e.g., such as subsequently acquired acoustic signals as previously described above). In particular, in some embodiments, following block 220, the operating envelope may be updated by: detecting the sand ingress, sand transport, or both over a second time interval and then correlating the detected sand ingress and/or sand transport along with the production rate of fluids produced during the second time period with a force on the production face of the wellbore via the procedures previously described above (e.g., via blocks 201-218 in FIG. 4). Thereafter, the operating envelope may be updated or re-determined entirely based on the newly performed correlating (e.g., based on sand ingress/transport detection during the second time interval).

Thus, through use of method 200, a well operator may determine an operating envelope for operating (e.g., producing from) a subterranean wellbore while limiting or avoiding sand ingress. In some embodiments, a well operator may utilize the operating envelope to determine a drawdown pressure, a production rate of one or more fluids, and/or an absolute wellbore pressure (or other operational parameters) that will limit sand ingress during operations. In many instances, a well operator may wish to operate the wellbore at a limit of the drawdown pressure, absolute wellbore pressure, production rate that is associated with an upper limit of the operating envelope, so as to maximize potential production from the well (e.g., the production of hydrocarbon liquids and/or gases). Accordingly, the operating envelope may facilitate a maximum amount of production from the wellbore while still avoiding the equipment damage and/or plugging that is typically associated with the production of sand.

In some embodiments, a well operator may wish to remove sand that may have accumulated within the wellbore so as to ensure enhanced production operations thereafter. In some embodiments, sand may have accumulated within the wellbore due to temporary operation outside of the operating envelope (e.g., either intentionally or unintentionally), due to an unforeseeable or unpredictable influx of sand, etc. It is expected that an absolute flow rate of fluids through the wellbore will serve to remove any sand accumulations. In order to raise the fluid flow rate, an operator may increase the drawdown pressure (e.g., by decreasing the pressure within the wellbore relative to the formation pressure) to increase the fluid flow rates. In some embodiments, the drawdown pressure can be raised within the operating envelope to a point at which a sufficient fluid flow rate (e.g., a production rate) is reached to remove the accumulated sand. In some embodiments, the drawdown pressure can be raised fast enough so as to raise the force on the production face above the upper limit of the operating envelope. The relative rapid rise in the drawdown pressure may increase a fluid acceleration and/or flux through the production face and into the wellbore, so that an overall flow rate of fluids through the wellbore may be increased. The increase in fluid flow rate (or production rate) through the wellbore may work to fluidize sand that has accumulated within the wellbore, and therefore encourage the production of this previously accumulated sand to the surface. When the drawdown pressure is increased above the limit defined by the operating envelope, additional sand may be produced from the formation (i.e., additional sand ingress may occur); however, an overall amount of sand within the wellbore may be generally decreased due to producing the previously accumulated sand to the surface. Once all or some desired portion of the previously accumulated sand has been produced out of the wellbore, the drawdown pressure may be returned to a point that is within the operating envelope (e.g., by increasing the pressure within the wellbore relative to the formation pressure) so as to return the force on the production face of the well to within the operating envelope and therefore limit or avoid further sand ingress as previously described above.

In some embodiments, different operating envelopes may be determined for each production zone (e.g., production zones 104*a*, 104*b*) of a wellbore. For instance, a first operating envelope may be determined for a first production zone of a wellbore, a second operating envelope may be determined for a second production zone of the wellbore, and so on. The first, second, etc. operating envelopes may be determined in the manner described above for method 200, except that different sand prediction models and associated envelopes may be constructed (e.g., as previously described) for each production zone.

In some embodiments, an operating window and/or a sand prediction model developed for a first wellbore or one or more production zones therein may be utilized to determine an operating window for a second wellbore or one or more production zones therein. The second wellbore may be a second wellbore extending through the same subterranean formation as the first wellbore, or may be a second wellbore that extends through a different, and possibly remote, subterranean formation from the subterranean formation of the first wellbore. This may be advantageous as it may allow an operating envelope to be defined for a wellbore without obtaining sand detection measurements from that particular wellbore (e.g., such as via the DAS system 110 of FIG. 1). Thus, a second wellbore may be operated within an operating envelope so as to limit sand ingress as previously described above. For instance, reference is now made to FIG. 5 which shows a method 300 of determining an operating envelope for a second wellbore, based on predetermined operating envelopes from one or more first wellbores according to some embodiments.

Initially, method 300 includes determining operating envelopes for a force on the production face of the production zone(s) of one or more first wellbores at 302. The operating envelopes may be selected so as to limit sand ingress from the production zone into the one or more first wellbores from the corresponding production zone(s). Thus, in some embodiments, the operating envelopes may be determined for the production zones of the one or more first wellbores by applying the systems and methods (e.g., described above), such as, in particular the sand monitoring system 110 and the method 200. Accordingly, in some embodiments, the operating envelopes may be derived from sand prediction models for the production zone(s) of each of the one or more first wellbores in the manner previously described above (see e.g., method 200 in FIG. 4).

In some embodiments, an operating envelope may be determined for a single production zone (e.g., production zones 104*a*, 104*b*) of a single first wellbore at 302. In some embodiments, operating envelopes may be determined for production zone(s) (e.g., a single production zone or multiple production zones) for a plurality of first wellbores. The plurality of first wellbores may extend into a single reservoir, or some or all of the first wellbores may extend into different reservoirs. Thus, at block 302, operating envelopes (and sand predictions models) may be developed for one or a plurality of first wellbores (including potentially multiple production zones within each of the first wellbores).

Figure 5:
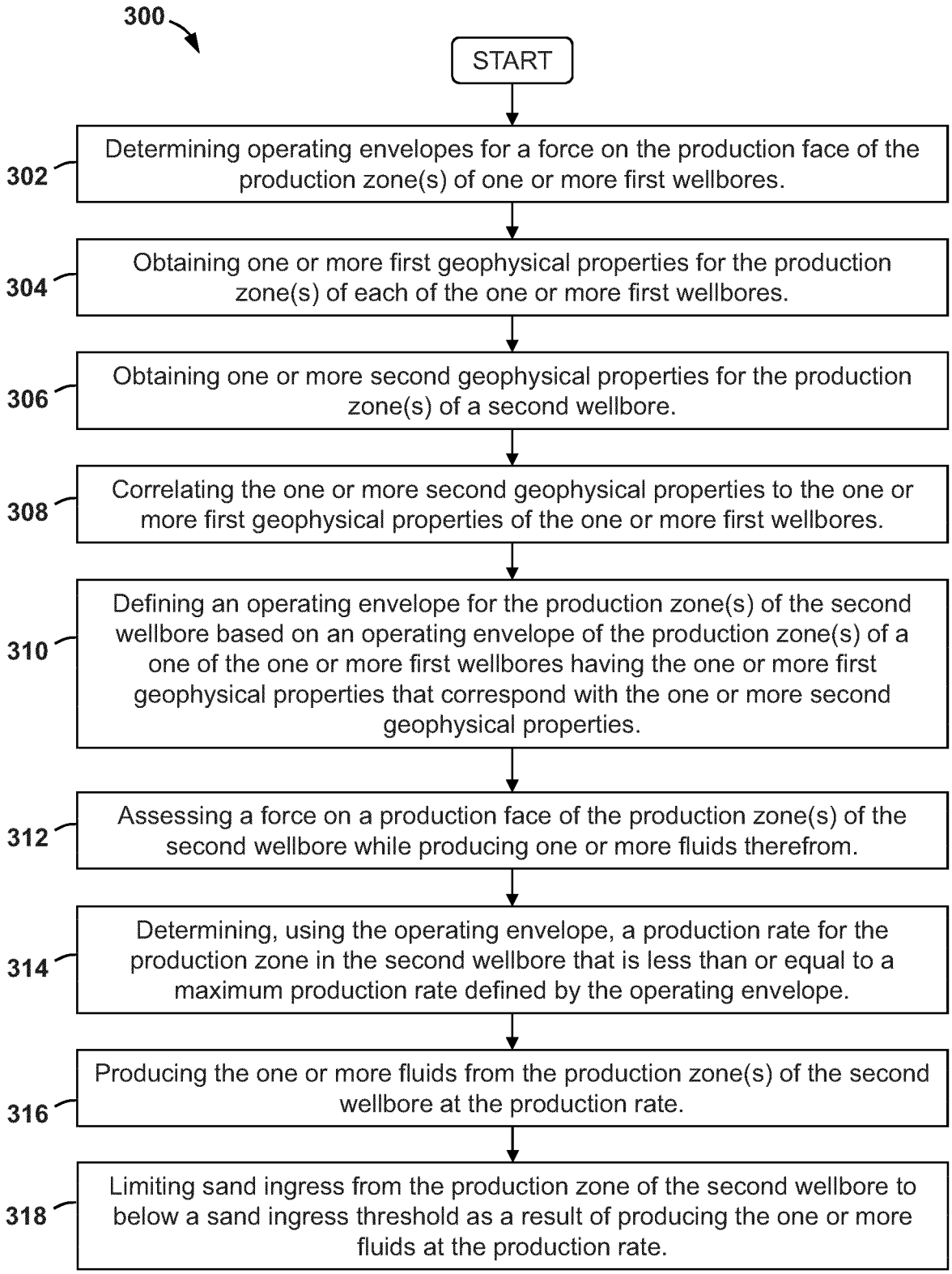
FIG. 5 is a flow diagram of a method of determining an operating envelope for a second wellbore, based on predetermined operating envelopes from one or more first wellbores according to some embodiments.

Referring still to FIG. 5, in addition to determining the operating envelopes (and sand prediction models) for the production zone(s) of the one or more first wellbores at 302, method 300 also includes obtaining one or more first geophysical properties for the production zone(s) of each of the one or more first wellbores at 304. The one or more first geophysical properties may include any suitable rock properties, reservoir properties, fluid properties, etc. associated with the production zone(s) of the one or more first wellbores. For instance, the one or more geophysical properties may include one or more of porosity, permeability, a measure of consolidation of a formation material, a type of formation material, or any combination or variant thereof. The one or more first geophysical properties may be obtained via any suitable method including, for example, direct measurement by sensors, testing (e.g., such as core sample testing), observation during production, drilling, completion, or other wellbore operations, etc.

The obtained one or more first geophysical properties may be associated with the production zone(s) of the one or more first wellbores as well as the operating envelopes (and underlying sand prediction models) previously determined for the production zone(s) of the one or more first wellbores. As previously described above, in some embodiments the sand prediction models that were constructed to determine the operating envelopes of the production zone(s) of the one or more first wellbores may utilize at least some of the one or more geophysical properties as a variable therein. Thus, in blocks 302, 304 the operating envelopes may each be associated with a corresponding set of the one or more first geophysical properties and vice versa. In embodiments where a plurality of operating envelopes are determined for the production zone(s) of a plurality of first wellbores, a catalogue or matrix may be constructed whereby the plurality of operating envelopes (including the underlying plurality of sand prediction models) are indexed by the one or more first geophysical properties. Thus, by searching this catalogue based on one or more geophysical properties of interest, one may obtain one or more operating envelopes (and/or sand prediction models) that correspond with the search criteria.

Method 300 also includes obtaining one or more geophysical properties from the production zone(s) of a second wellbore (e.g., second geophysical properties, etc.). The second wellbore may be different from each of the one or more first wellbores. For instance, the second wellbore may be a different wellbore extending into the same reservoir as at least one of the one or more first wellbores, or the second wellbore may extend into a different reservoir than all of the one or more first wellbores. As used herein, the first geophysical properties and the second geophysical properties can be the same properties through the values as defined by the first and second geophysical properties may vary between the two wellbores. For example, the one or more second geophysical properties of the production zone(s) of the second wellbore may include any or all of the same geophysical properties described above for the one or more first geophysical properties, and may be obtained, derived, inferred, measured, etc. via any of the methods described above. It should be appreciated that the one or more geophysical properties may be obtained prior to actually forming (e.g., drilling) and/or completing the second wellbore.

Once the one or more second geophysical properties of the production zone(s) of the second wellbore are obtained at 306, method 300 proceeds to correlate the one or more second geophysical properties to the one or more first geophysical properties. For instance, in some embodiments, block 306 may comprise comparing the one or more second geophysical properties to the one or more first geophysical properties. The comparison may be made so as to determine whether the one or more second geophysical properties correspond with the one or more first geophysical properties. For instance, the comparison may comprise determining whether the one or more second geophysical properties are within a predetermined range (e.g., +/−20%, +/−10%, +/−5%, +/−1%, etc.) of the one or more first geophysical properties. In embodiments where the one or more first geophysical properties are obtained for a plurality of first wellbores, the one or more second geophysical properties may be compared against some or all of the sets of the one or more first geophysical properties for each of the one or more first wellbores so as to determine which (if any) of the sets of one or more first geophysical properties corresponds (or best corresponds) to the one or more second geophysical properties according to previously determined criteria (e.g., such as that previously described).

Once the one or more second geophysical properties are correlated to the one or more first geophysical properties at 308, method 300 proceeds to determine an operating envelope for the production zone(s) of the second wellbore based on an operating envelope of the production zone(s) of a one of the one or more first wellbores having the one or more first geophysical properties that correspond with the one or more second geophysical properties at 310. In particular, block 310 may comprise applying the operating envelope (and potentially the sand prediction model utilized to originally derive the operating envelope) of the production zone(s) of a particular one of the one or more first wellbores that has one or more first geophysical properties that correspond (e.g., via the example criteria described above) with the one or more second geophysical properties. Without being limited to this or any other theory, if the geophysical properties of two wellbores (or production zones within the two wellbores) correspond in the manner described above, it may be assumed that the behavior of the two wellbores (or at least the two production zones) may be the same or at least comparable. Thus, an operating envelope for limiting sand ingress for a first of the two corresponding wellbores may be applied to provide an applicable operating envelope for the second of the two corresponding wellbores. In some embodiments, the operating envelope for the first wellbore can be modified based on any differences in properties identified in the second of the two wellbores, which can help to adjust for differences between the wellbores.

For some embodiments where operating envelopes and one or more first geophysical properties are obtained for a plurality of first wellbores at blocks 302 and 304, respectively, blocks 308 and 310 may comprise searching a database or catalogue of the operating envelopes (and sand prediction models) utilizing the obtained one or more second geophysical properties of the second wellbore, and returning a list of operating envelopes or a single operating envelope that is associated with the one or more geophysical properties that correspond, based on predetermined criteria as explained above, to the provided one or more second geophysical properties.

In some embodiments, a different operating envelope may be defined for some or all of the production zones of the second wellbore at block 310. Each operating envelope may be determined based on an operating envelope of a production zone of one of the first wellbores in which the one or more first geophysical properties correspond with the one or more second geophysical properties of the particular production zone of the second wellbore. Thus, in some embodiments the operating envelopes of at least some of the production zones of the second wellbore may be defined by operating envelopes from different ones of the first wellbores.

Referring still to FIG. 5, method 300 also includes assessing a force on a production face of the production zone(s) of the second wellbore while producing fluids therefrom at 312. As previously described, the force on the production face of a production zone may be measured or characterized by a number of different parameters. As is also described above, many (or all) of the above described parameters for measuring and/or characterizing the force on the production face of a production zone may be determined, measured, inferred, etc. via a pressure monitoring system including one or more pressure sensors disposed within the wellbore (e.g., such as pressure monitoring system 130 in FIG. 1). Therefore, at block 312, method may comprise taking one or more pressure measurements within the second wellbore via a suitable pressure monitoring system to assess the force on the production face of the production zone(s) therein during production of one or more fluids therefrom (e.g., hydrocarbons liquids, hydrocarbon gases, water, etc.).

After the operating envelope is defined at 310, method 300 also includes determining, using the defined operating envelope, a production rate for the production zone(s) of the second wellbore that is less than or equal to a maximum production rate defined by the defined operating envelope at 314. As previously described, a wellbore operating may wish to maximize the production rate from a given well so as to produce as much hydrocarbons (e.g., liquids and/or gases) therefrom as possible. However, producing a well at too high a production rate (or increasing the production rate too quickly) can cause or increase sand ingress as previously described above. Therefore, by applying a maximum production rate as defined by the operating envelope, a wellbore operating may maximize production from the wellbore while limiting (including avoiding entirely) sand ingress.

Accordingly, method 300 also includes (in some embodiments), producing the one or more fluids from the production zone(s) of the second wellbore at the production rate at 316, and limiting sand ingress from the production zone(s) of the second wellbore to below a sand ingress threshold or boundary as a result of producing the one or more fluids at the production rate at 318. In some embodiments, the sand ingress threshold may comprise a sand ingress rate (e.g., such as in mpbd). In some embodiments, the sand ingress threshold may be substantially zero (such that substantially no sand ingress is occurring); however, in some embodiments, the sand ingress threshold may comprise a non-zero value (e.g., such as 5 mpbd in some embodiments). The sand ingress threshold may be predetermined (e.g., by the well operator), and may be determined according to a variety of factors and considerations (e.g., the equipment disposed in the well, the propensity for the particular wellbore to experience plugging, the type of sand produced from the production zone(s), limitations of subterranean and surface equipment, etc.).

Accordingly, method 300 may be utilized to define operating envelope(s) for the production zone(s) of a second wellbore based on previously determined operating envelopes for production zone(s) in one or more first wellbores as described above. Therefore, an operating envelope may be determined for the production zone(s) of a second wellbore that does not have or employ a sand monitoring system (e.g., such as the DAS system 110 in FIG. 1).

In some embodiments, one or more of the blocks of method 300 may be carried out before the second wellbore is fully formed (e.g., drilled, completed, etc.). For instance, any one or more of blocks 302-310 and 314 may be performed prior to forming and/or completing second wellbore in some embodiments. In addition, following the completion of method 300, the defined operating window for the second wellbore may be updated in a similar manner to that described above. For instance, additional acoustic data may be obtained within the corresponding one of the one or more first wellbores (e.g., the corresponding one of the one or more wellbores as described for block 308, 310), and the corresponding operating envelope of the production zone(s) of the first wellbore may be updated in substantially the same manner as described above with respect to method 200 shown in FIG. 4. The updated operating envelope of the corresponding first wellbore may then be applied to the defined operating envelope of the second wellbore in a similar manner so that subsequent changes in the production rate may be made according to the updated envelope. In some embodiments, the additional acoustic data may be obtained from a third wellbore. In some of these embodiments, it may first be determined whether the production zone(s) of the third wellbore sufficiently correspond to the production zone(s) of the second wellbore in substantially the same manner as previously described above, prior to utilizing the acoustic data from the third wellbore to update the operating envelope of the second wellbore.

In some embodiments, observed sand ingress from a production zone of a wellbore may be higher than that predicted from the corresponding operating envelope or sand prediction model. This may be true for wellbores that include a sand monitoring system (e.g., such as DAS system 110 in FIG. 1) or for wellbores that do not include a sand monitoring system (e.g., such as the "second wellbore" described above in method 300 of FIG. 5). For wellbores with a sand monitoring system, the actual observed sand ingress may be determined via the sand monitoring system and an associated sand detection model as described above. For wellbores that do not include a sand monitoring system, the actual observed sand ingress may be determined via other methods (e.g., such as by analyzing fluids produced from the wellbore at the surface). In either case, if the observed actual sand ingress during production from a wellbore is sufficiently different (e.g., greater) than a predicted sand ingress via the operating envelope (or associated sand prediction model), then the operating envelope and/or sand prediction model may be updated based on the actual observed sand ingress. In some embodiments, the operating envelope may be updated when the difference between observed sand ingress and the predicted sand ingress is greater than a predetermined sand variance threshold. The variance threshold may range in various embodiments, depending on a number of factors, including a maximum sand ingress rate that may be acceptable within the particular wellbore. Without being limited to this or any other theory, by first determining whether and observe difference or variance between the predicted and observed sand ingress rates is above a threshold, minor or less significant variances may not trigger an update to the model so as to avoid unduly changing the operating envelope and/or sand prediction model during operations.

Figure 6:
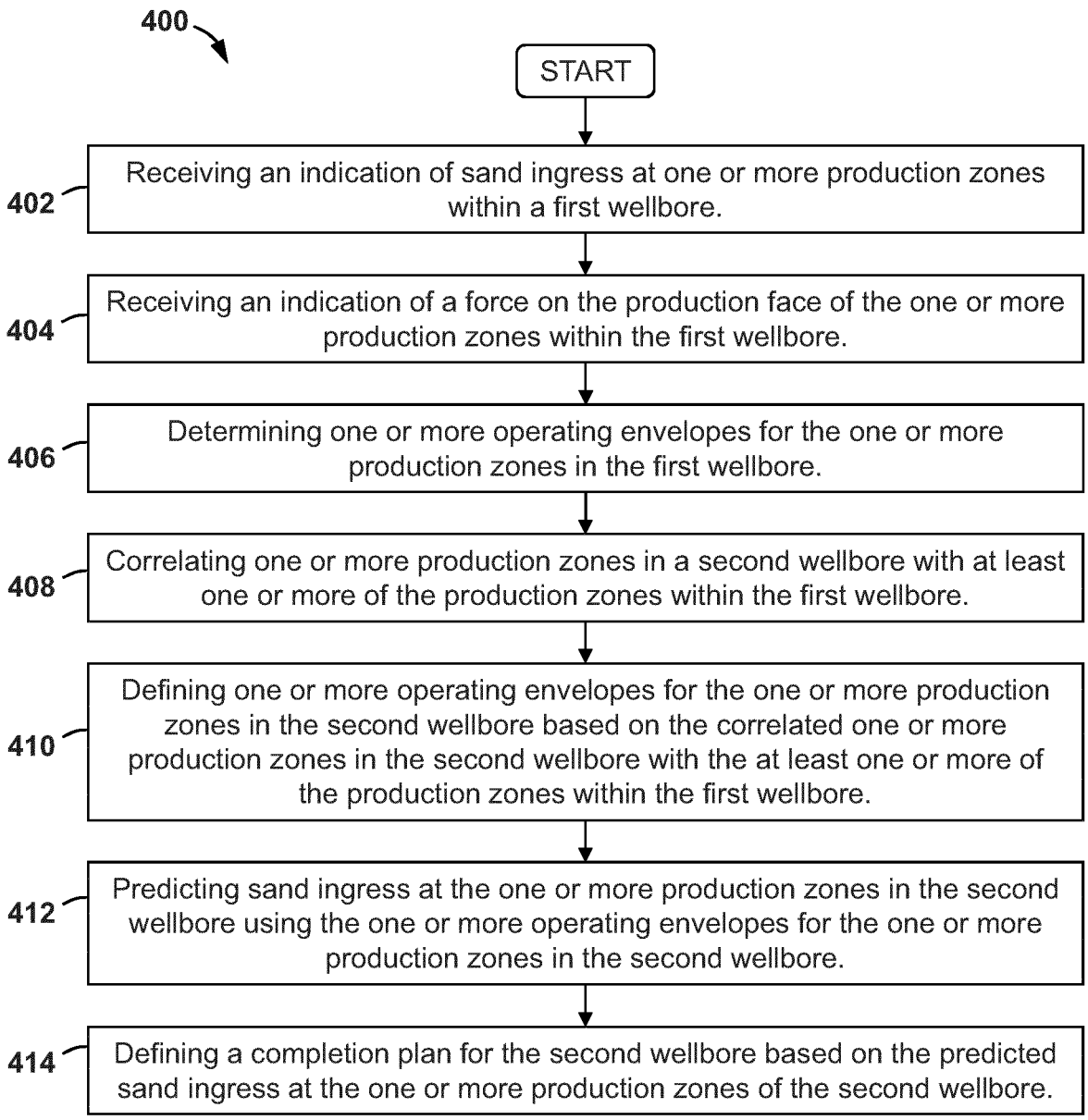
FIG. 6 is a flow diagram of a method of completing a wellbore according to some embodiments.

As previously described above, some of the blocks of method 300 in FIG. 5 may be performed prior to forming and/or completing the second wellbore. Thus, in some embodiments, a chosen operating envelope and associated sand prediction model (e.g., from a corresponding first wellbore as previously described above) may be utilized to influence various decisions and designs of the second wellbore. For instance, once a corresponding operating envelope and sand prediction model are selected, the chosen operating envelope and associated sand prediction model may then be utilized to make predictions regarding future sand ingress within the second wellbore (or at least a production zone of the second wellbore) so as to determine how or even whether to complete various production zone(s) of the second wellbore. Reference is now made to FIG. 6 which depicts a method 400 of completing a wellbore according to some embodiments disclosed herein.

Initially, method 400 includes receiving an indication of sand ingress at one or more production zones within a first wellbore at 402. In some embodiment, the indication of the sand ingress may be received or detected utilizing a sand monitoring system and a sand detection model in the manner previously described above for method 200. Thus, the indication of sand ingress may comprise acoustic data (and/or frequency domain features derived from the acoustic data) from a DAS system (e.g., DAS system 110 in FIG. 1), and a determination of the sand ingress may be made by providing the obtained acoustic data to an appropriate sand detection model in the manner previously described above.

Method 400 also includes receiving an indication of a force on the production face of the one or more production zones within the first wellbore at 404. The force on the production face may be determined for the production zone(s) within the first wellbore while one or more fluids are being produced from the production zone(s). As previously described above, the force on the production face may be measured or characterized by a number of different parameters (which are described above in more detail) and at least some of these parameters may be determined, measured, inferred, estimated, etc. from pressure measurements within the wellbore (e.g., such as wellbore pressure, a pressure within the production zone(s), etc.). Thus, at block 404, the indication of the force on the production face may comprise one or more pressure readings from a pressure monitoring system (e.g., such as pressure monitoring system 300 shown in FIG. 1) as previously described above.

Next, method 400 includes determining one or more operating envelopes for the one or more production zones in the first wellbore at 406. As previously described above for methods 300 and 400, the operating envelopes may be selected so as to limit sand ingress from the production zone(s) into the first wellbore. Thus, in some embodiments, the operating envelopes may be determined for the one or more production zones of the first wellbore by applying the systems and methods described above, such as, in particular the sand monitoring system 110 and the method 200. Accordingly, in some embodiments, the operating envelopes may be derived from sand prediction models for each of the one or more production zones of the first wellbore in the manner previously described above (see e.g., method 200 in FIG. 4).

Referring still to FIG. 6, method 400 also includes correlating one or more production zones in a second wellbore with at least one or more of the production zones within the first wellbore at block 408. In some embodiments, the correlating at block 408 may comprise correlating one or more geophysical properties (which may comprise any one or more of the geophysical properties previously described above) of the production zone(s) of the second wellbore with one or more geophysical properties of the production zone(s) of the first wellbore. Thus, as is similarly described for block 308 of method 300 in FIG. 5, block 408 may comprise comparing the one or more geophysical properties of the production zone(s) of the second wellbore to the one or more geophysical properties of the production zone(s) of the first wellbore, and this comparison may determine whether the one or more geophysical properties of the production zone(s) of the first and second wellbores are within a predetermined range (e.g., +/−20%, +/−10%, +/−5%, +/−1%, etc.) of one another.

In some embodiments, if the correlation of the geophysical features of the production zone(s) of the first and second wellbores yields a determination that the production zone(s) of the second wellbore do not ultimately correspond with the production zone(s) of the first wellbore (e.g., if the geophysical properties are not within the predefined ranges as described above), then method 400 may cease or blocks 402, 404, 406 may be performed for a different first wellbore having production zone(s) that do correspond with the production zone(s) of the second wellbore. If, conversely, the correlation of the geophysical features of the production zone(s) of the first and second wellbores yields a determination that the production zone(s) of the second wellbore do correspond with the production zone(s) of the first wellbore, then method may proceed to blocks 410-414 as described below.

In particular, following block 408, method 400 proceeds to define one or more operating envelopes for the one or more production zones in the second wellbore based on the operating envelopes of the correlated one or more production zones in the first wellbore at 410. Specifically, block 410 may comprise applying the operating envelope (and potentially the sand prediction model utilized to originally derive the operating envelope) of the production zone(s) of the first wellbore to the production zone(s) of the second wellbore that correspond therewith. As previously described, the one or more production zones of the second wellbore may correspond with the one or more production zones of the first wellbore when the geophysical properties of the respective production zones correspond with one another in the manner described above. In some embodiments, the selected one or more operating envelopes can be modified to account for differences between the geophysical properties of the first wellbore and the second wellbore.

Next, method 400 includes predicting sand ingress at the one or more production zones in the second wellbore using the one or more operating envelopes for the one or more production zones of the second wellbore at 412. Specifically, the one or more operating envelopes (and thus the underlying sand prediction models generating the operating envelopes) may correlate a force on the production face of the one or more production zones to the production rate of one or more fluids and a sand ingress (e.g., such as a sand ingress rate) as previously described above. Thus, utilizing operating envelopes (and underlying sand prediction model), predictions can be made as to whether sand ingress may occur at the one or more production zones under certain operating conditions (e.g., drawdown pressure, production rate, etc.). In some circumstances, one or more of the operating conditions for a well may be determined by other factors so that operation within the operating envelope is not possible (or at least no feasible) in certain scenarios. In some embodiments, the operating envelope generated by a sand prediction model may or shrink generally narrow over time as a result of a pressure reduction in the production zone and/or the overall reservoir. Further, in some situations, a particular production zone may be predisposed to produce sand regardless of the operating parameters applied thereto. As a result, at times, operation of a wellbore may be outside of the operating envelope such that sand ingress begins to occur or increases. However, the sand prediction model and/or the operating envelope may be used (e.g., at block 412) to predict the timing or even the severity of sand ingress for each of the one or more production zones in the second well, so that early action (e.g., such as prophylactic action) may be taken by a well operator so as to minimize or avoid the complications caused by the predicted sand ingress.

Therefore, at block 414, method 400 includes defining a completion plan for the second wellbore based on the predicted sand ingress at the one or more production zones of the second wellbore. For example, in some embodiments the prediction at block 412 may comprise predicting sand will ingress at a particular one or more of the production zones of the second wellbore for a given set of operating conditions. In some of these embodiments, the prediction at block 412 may comprise predicting a sand ingress rate above a predetermined threshold from the one or more production zones of the second wellbore. As a result, at block 414, method 400 may comprise defining a completion plan that includes placing a suitable sand screen, gravel packs, or other filtering device (e.g., such as screen assemblies 118 and gravel packs 122 in FIG. 1) at the one or more production zones of the second wellbore where sand ingress is predicted in block 412. In addition, in some embodiments, the prediction at block 412 may including predicting that a sufficiently high sand ingress rate is predicted for the expected operating conditions within the second wellbore that any production from these one or more production zones may be uneconomical. Thus, the completion plan defined at block 414 may comprise not completing or placing a blank pipe at these one or more production zones within the second wellbore. Further, in some embodiments, the prediction at block 412 may comprise predicting that substantially no (or relatively little) sand ingress is expected for one or more of the production zones of the second wellbore, such that the completion plan defined at block 414 may comprise not inserting a sand screen, gravel pack, or other filter device at the one or more production zones of the second wellbore.

In this regard, the completion plan provides a design or configuration for a wellbore that is not yet drilled or has been drilled but has not yet been completed. The plan can define the physical configuration of the equipment placed within the wellbore, the type of equipment or completion to be used, and/or the equipment locations. The completion plan can also comprise an operating plan paired with the completion plan to enable the drawdown of the new well to be improved or maximized within a certain operating time frame.

The ability to use the model to predict future sanding based on certain operating parameters can allow for a wellbore to be designed to improve the overall amount of fluid produced from the wellbore in an economical fashion. This can include avoiding the use of expensive completion equipment in some instances when the model indicates that certain zones, or in some embodiments entire wellbores, should not be completed in order to avoid sand and/or undesirable fluid ingress (e.g., water ingress, etc.).

Thus, through performance of the method 400, sand ingress may be predicted for a wellbore that does not include a sand monitoring system, and that may not even be formed (e.g., drilled) and/or completed. Thus, method 400 may allow a completion plan for the wellbore to be determined so as to limit and/or avoid the predicted sand ingresses. Thus, the economic return for the wellbore may be more readily and predictably achieved.

Figure 7:
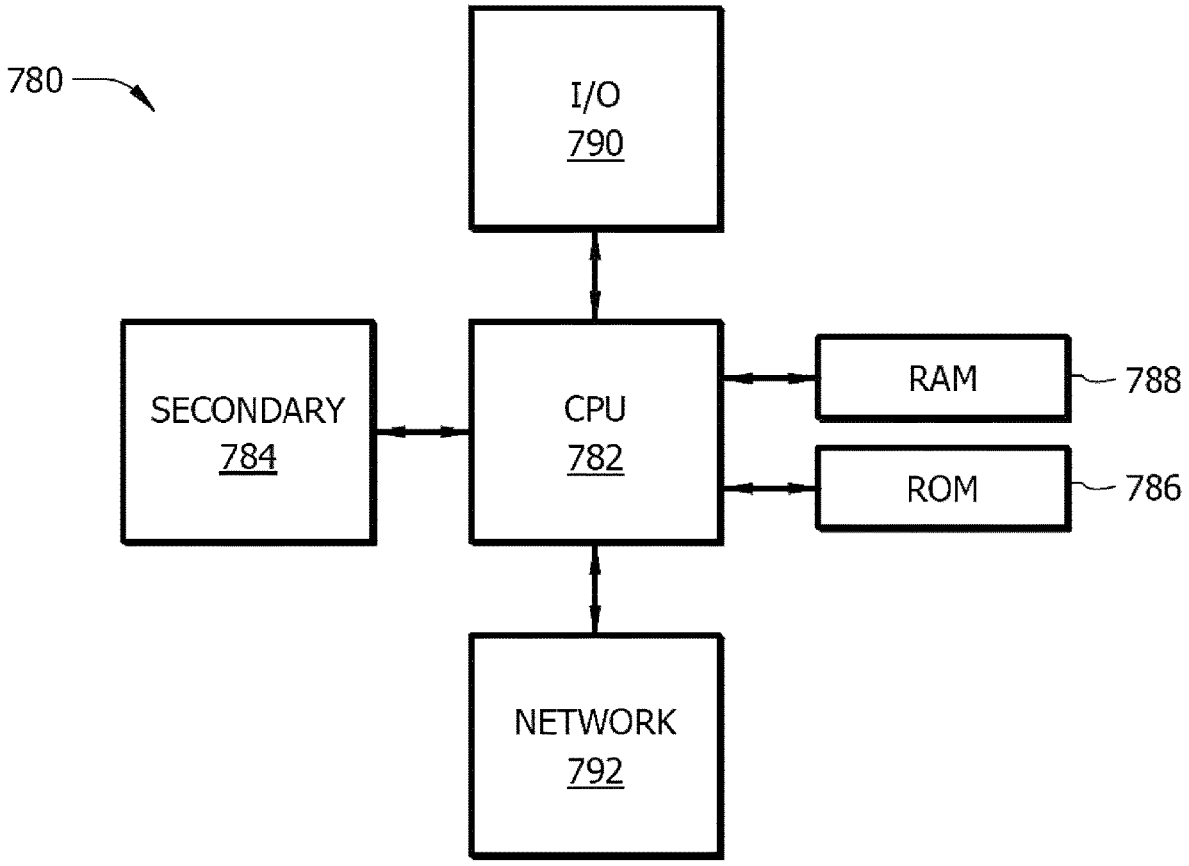
FIG. 7 schematically illustrates a computer that may be used to carry out various methods according to some embodiments.

Any of the systems and methods disclosed herein can be carried out on a computer or other device comprising a processor (e.g., a desktop computer, a laptop computer, a tablet, a server, a smartphone, or some combination thereof), such as the acquisition device 160 of FIG. 2. FIG. 7 illustrates a computer system 780 suitable for implementing one or more embodiments disclosed herein such as the acquisition device or any portion thereof. The computer system 780 includes a processor 782 (which may be referred to as a central processor unit or CPU) that is in communication with memory devices including secondary storage 784, read only memory (ROM) 786, random access memory (RAM) 788, input/output (I/O) devices 790, and network connectivity devices 792. The processor 782 may be implemented as one or more CPU chips.

It is understood that by programming and/or loading executable instructions onto the computer system 780, at least one of the CPU 782, the RAM 788, and the ROM 786 are changed, transforming the computer system 780 in part into a particular machine or apparatus having the novel functionality taught by the present disclosure. It is fundamental to the electrical engineering and software engineering arts that functionality that can be implemented by loading executable software into a computer can be converted to a hardware implementation by well-known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well-known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

Additionally, after the system 780 is turned on or booted, the CPU 782 may execute a computer program or application. For example, the CPU 782 may execute software or firmware stored in the ROM 786 or stored in the RAM 788. In some cases, on boot and/or when the application is initiated, the CPU 782 may copy the application or portions of the application from the secondary storage 784 to the RAM 788 or to memory space within the CPU 782 itself, and the CPU 782 may then execute instructions of which the application is comprised. In some cases, the CPU 782 may copy the application or portions of the application from memory accessed via the network connectivity devices 792 or via the I/O devices 790 to the RAM 788 or to memory space within the CPU 782, and the CPU 782 may then execute instructions of which the application is comprised. During execution, an application may load instructions into the CPU 782, for example load some of the instructions of the application into a cache of the CPU 782. In some contexts, an application that is executed may be said to configure the CPU 782 to do something, e.g., to configure the CPU 782 to perform the function or functions promoted by the subject application. When the CPU 782 is configured in this way by the application, the CPU 782 becomes a specific purpose computer or a specific purpose machine.

The secondary storage 784 is typically comprised of one or more disk drives or tape drives and is used for non-volatile storage of data and as an over-flow data storage device if RAM 788 is not large enough to hold all working data. Secondary storage 784 may be used to store programs which are loaded into RAM 788 when such programs are selected for execution. The ROM 786 is used to store instructions and perhaps data which are read during program execution. ROM 786 is a non-volatile memory device which typically has a small memory capacity relative to the larger memory capacity of secondary storage 784. The RAM 788 is used to store volatile data and perhaps to store instructions. Access to both ROM 786 and RAM 788 is typically faster than to secondary storage 784. The secondary storage 784, the RAM 788, and/or the ROM 786 may be referred to in some contexts as computer readable storage media and/or non-transitory computer readable media.

I/O devices 790 may include printers, video monitors, electronic displays (e.g., liquid crystal displays (LCDs), plasma displays, organic light emitting diode displays (OLED), touch sensitive displays, etc.), keyboards, keypads, switches, dials, mice, track balls, voice recognizers, card readers, paper tape readers, or other well-known input devices.

The network connectivity devices 792 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards that promote radio communications using protocols such as code division multiple access (CDMA), global system for mobile communications (GSM), long-term evolution (LTE), worldwide interoperability for microwave access (WiMAX), near field communications (NFC), radio frequency identity (RFID), and/or other air interface protocol radio transceiver cards, and other well-known network devices. These network connectivity devices 792 may enable the processor 782 to communicate with the Internet or one or more intranets. With such a network connection, it is contemplated that the processor 782 might receive information from the network, or might output information to the network (e.g., to an event database) in the course of performing the above-described method steps. Such information, which is often represented as a sequence of instructions to be executed using processor 782, may be received from and outputted to the network, for example, in the form of a computer data signal embodied in a carrier wave.

Such information, which may include data or instructions to be executed using processor 782 for example, may be received from and outputted to the network, for example, in the form of a computer data baseband signal or signal embodied in a carrier wave. The baseband signal or signal embedded in the carrier wave, or other types of signals currently used or hereafter developed, may be generated according to several known methods. The baseband signal and/or signal embedded in the carrier wave may be referred to in some contexts as a transitory signal.

The processor 782 executes instructions, codes, computer programs, scripts which it accesses from hard disk, floppy disk, optical disk (these various disk based systems may all be considered secondary storage 784), flash drive, ROM 786, RAM 788, or the network connectivity devices 792. While only one processor 782 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 784, for example, hard drives, floppy disks, optical disks, and/or other device, the ROM 786, and/or the RAM 788 may be referred to in some contexts as non-transitory instructions and/or non-transitory information.

In an embodiment, the computer system 780 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 780 to provide the functionality of a number of servers that is not directly bound to the number of computers in the computer system 780. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 780, at least portions of the contents of the computer program product to the secondary storage 784, to the ROM 786, to the RAM 788, and/or to other non-volatile memory and volatile memory of the computer system 780. The processor 782 may process the executable instructions and/or data structures in part by directly accessing the computer program product, for example by reading from a CD-ROM disk inserted into a disk drive peripheral of the computer system 780. Alternatively, the processor 782 may process the executable instructions and/or data structures by remotely accessing the computer program product, for example by downloading the executable instructions and/or data structures from a remote server through the network connectivity devices 792. The computer program product may comprise instructions that promote the loading and/or copying of data, data structures, files, and/or executable instructions to the secondary storage 784, to the ROM 786, to the RAM 788, and/or to other non-volatile memory and volatile memory of the computer system 780.

In some contexts, the secondary storage 784, the ROM 786, and the RAM 788 may be referred to as a non-transitory computer readable medium or a computer readable storage media. A dynamic RAM embodiment of the RAM 788, likewise, may be referred to as a non-transitory computer readable medium in that while the dynamic RAM receives electrical power and is operated in accordance with its design, for example during a period of time during which the computer system 780 is turned on and operational, the dynamic RAM stores information that is written to it. Similarly, the processor 782 may comprise an internal RAM, an internal ROM, a cache memory, and/or other internal non-transitory storage blocks, sections, or components that may be referred to in some contexts as non-transitory computer readable media or computer readable storage media.

Having described various systems and methods herein, specific embodiments can include those related to draw down of a well using an operating envelope, draw down across wellbores, sand ingress prediction for wellbores and across wellbores, and wellbore completion.

Various embodiments related to draw down of a well using an operating envelope can include, but are not limited to:

In a first embodiment, a method for determining an operating envelope for a wellbore comprises: receiving an indication of sand ingress into the wellbore from at least one production zone, sand transport along the wellbore, or both while producing one or more fluids from the wellbore from the at least one production zone; correlating a force on a production face of the at least one production zone of the wellbore with the sand ingress, the sand transport, or both; and determining an operating envelope based on the correlating, wherein the operating envelope defines a boundary for the force on the production face of the at least one production zone of the wellbore during a production of the one or more fluids from the at least one production zone.

A second embodiment can include the method of the first embodiment, wherein the force on the production face of the at least one production zone of the wellbore is further correlated with a production rate of the one or more fluids, and wherein the operating envelope is further based on the correlation of the force on the production face of the at least one production zone with the production rate of the one or more fluids.

A third embodiment can include the method of the first or second embodiment, further comprising: detecting the sand ingress into the wellbore from the at least one production zone, the sand transport along the wellbore, or both using a sand monitoring system disposed within the wellbore.

A fourth embodiment can include the method of the third embodiment, wherein the sand monitoring system comprises an acoustic monitoring system.

A fifth embodiment can include the method of the third or fourth embodiment, wherein detecting the sand ingress, the sand transport, or both using the sand monitoring system comprises: detecting an acoustic signal along the wellbore using a fiber optic cable disposed within the wellbore; comparing a sand ingress signature with the acoustic signal to produce a first output; comparing a sand flow signature with the acoustic signal to produce a second output; and detecting the sand ingress, the sand transport, or both based on the first output and the second output.

A sixth embodiment can include the method of any one of the third to fifth embodiments, further comprising controlling the production rate of the one or more fluids from the wellbore within the operating envelope based on the detecting of the sand ingress from the at least one production zone.

A seventh embodiment can include the method of the sixth embodiment, wherein controlling the production rate of the one or more fluids from the wellbore within the operating envelope comprises controlling the production rate of the one or more fluids without the use of the sand monitoring system.

An eighth embodiment can include the method of any one of the third to seventh embodiments, further comprising detecting, with a pressure monitoring system, a pressure within the wellbore while producing the one or more fluids and detecting the sand ingress, the sand transport, or both.

A ninth embodiment can include the method of the eighth embodiment, wherein the pressure monitoring system comprises a distributed pressure sensors system.

A tenth embodiment can include the method of the ninth embodiment, further comprising: monitoring a pressure in each of the at least one production zones with the pressure monitoring system.

An eleventh embodiment can include the method of any one of the eighth to tenth embodiments, further comprising: detecting the sand ingress, sand transport, or both over a second time interval using the sand monitoring system during production of the one or more fluids from the wellbore; detecting, with the pressure monitoring system, a pressure within the wellbore during the second time interval while producing the one or more fluids and detecting the sand ingress, the sand transport, or both; correlating the force on the production face of the at least one production zone of the wellbore during the second time interval; and re-determining the operating envelope based on the correlating, wherein the one or more fluids are produced within the re-determined operating envelope after the second time interval.

A twelfth embodiment can include the method of any one of the first to eleventh embodiments, wherein the force on the production face of the at least one production zone of the wellbore is measured by at least one of a rate of pressure change in the at least one production zone, a flux of the one or more fluids through the at least one production face of the wellbore, or an acceleration of the one or more fluids between a reservoir and an interior of the wellbore at the production face of the at least one production zone.

A thirteenth embodiment can include the method of any one of the second to twelfth embodiments, wherein the boundary for the force on the production face of the at least one production zone of the wellbore is a function of at least one of an absolute pressure within the wellbore or the production rate of the one or more fluids from the least one production zone.

A fourteenth embodiment can include the method of any one of the first to thirteenth embodiments, wherein the at least one production zone comprises at least two production zones, and wherein the boundary for the force on the production face of the wellbore is different between the at least two production zones.

A fifteenth embodiment can include the method of any one of the first to fourteenth embodiments, further comprising: increasing the production rate of the one or more fluids from the least one production zone while remaining within the operating envelope.

A sixteenth embodiment can include the method of any one of the first to fifteenth embodiments, further comprising: automatically controlling the force on the production face; and increasing the production rate of the one or more fluids in response to automatically controlling the force on the production face.

A seventeenth embodiment can include the method of the fifteenth or sixteenth embodiment, wherein increasing the production rate of the one or more fluids comprises producing the one or more fluids at a maximum production rate while remaining within the operating envelope.

An eighteenth embodiment can include the method of any one of the fifteenth to seventeenth embodiments, further comprising limiting sand accumulation within the wellbore based on the increasing of the production rate of the one or more fluids while remaining within the operating envelope.

A nineteenth embodiment can include the method of any one of the first to eighteenth embodiments, further comprising: decrease a pressure within the wellbore to increase the force on the production face of the at least one production zone above the operating envelope; increasing the production rate of the one or more fluids based on the decreasing of the pressure; removing at least a portion of sand accumulated within the wellbore based on the increase in the production rate; and increasing the pressure after removing at least the portion of the sand accumulated within the wellbore.

In a twentieth embodiment, a system for determining an operating envelope for a wellbore comprises: a monitoring assembly configured to detect one or more values related to the wellbore; a processor, wherein the processor is configured to execute an analysis program to: receive, from the monitoring assembly, a sensor signal, wherein the sensor signal is generated while producing one or more fluids from at least one production zone within the wellbore; detect sand ingress into the wellbore, sand transport along the wellbore, or both using the sensor signal; correlate a force on a production face of the at least one production zone of the wellbore with the sand ingress, the sand transport, or both; and determine an operating envelope based on the correlating, wherein the operating envelope defines a boundary for the force on the production face of the at least one production zone during a production of the one or more fluids from the at least one production zone.

A twenty first embodiment can include the system of the twentieth embodiment, wherein the processor is further configured to: correlate the force on the production face of the at least one production zone of the wellbore with a production rate of the one or more fluids.

A twenty second embodiment can include the system of the twentieth or twenty first embodiment, wherein the monitoring assembly comprises a sand monitoring system disposed within the wellbore.

A twenty third embodiment can include the system of any one of the twentieth to twenty second embodiments, wherein the sand monitoring system comprises: a fiber optic cable disposed in the wellbore; a receiver in signal communication with the fiber optical cable, wherein the sensor signal comprises an acoustic signal, and wherein the receiver is configured to use a light pulse to detect an acoustic signal within the wellbore along the length of the fiber optic cable; wherein the processor is configured to detect the sand ingress, the sand transport, or both by executing the analysis program to: detect the acoustic signal using the fiber optic cable disposed within the wellbore; compare a sand ingress signature with the acoustic signal to produce a first output; compare a sand flow signature with the acoustic signal to produce a second output; and detect the sand ingress, the sand transport, or both based on the first output and the second output.

A twenty fourth embodiment can include the system of any one of the twentieth to twenty third embodiments, wherein the force on the production face of the at least one production zone is measured by at least one of a rate of pressure change in the at least one production zone, a flux of the one or more fluids through the production face of at least one production zone, or an acceleration of the one or more fluids between a reservoir and an interior of the wellbore at the production face of the at least one production zone.

A twenty fifth embodiment can include the system of any one of the twentieth to twenty fourth embodiments, wherein the boundary for the force on the production face of the at least one production zone is a function of at least one of an absolute pressure within the wellbore, or a production rate of the one or more fluids from the wellbore.

A twenty sixth embodiment can include the system of any one of the twentieth to twenty fifth embodiments, wherein the monitoring assembly comprises a pressure monitoring system configured to detect a pressure within the wellbore, wherein the processor is configured to execute the analysis program to receive, from the pressure sensor, an indication of the pressure within the at least one production zone in the wellbore.

A twenty seventh embodiment can include the system of any one of the twentieth to twenty sixth embodiments, wherein the processor is further configured to execute the analysis program to generate a control signal configured to increase the production rate of the one or more fluids while remaining within the operating envelope, wherein the increase in the production rate limits sand accumulation within the wellbore.

A twenty eighth embodiment can include the system of the twenty seventh embodiment, wherein the processor is configured to execute the analysis program to generate the control signal automatically and automatically control the production rate of the one or more fluids.

A twenty ninth embodiment can include the system of any one of the twentieth to twenty eighth embodiments, wherein the processor is further configured to execute the analysis program to: monitor and detect sand ingress into the wellbore using the sensor signal during production from the wellbore; and control the production rate of the one or more fluids from the wellbore within the operating envelope based on the detection of the sand ingress from the at least one production zone.

A thirtieth embodiment can include the system of the twenty ninth embodiment, wherein the processor is configured to execute the analysis program to control the production rate of the one or more fluids at a maximum production rate of the one or more fluids within the operating envelope.

A thirty first embodiment can include the system of any one of the twentieth to thirtieth embodiments, wherein the processor is further configured to execute the analysis program to generate a series of control signals configured to: decrease a pressure within the wellbore to increase the force on a production face of the at least one production zone above the operating envelope, wherein the production rate of the one or more fluids increases based on decreasing of the pressure, and wherein at least a portion of sand accumulated within the wellbore is removed based on the increase in the production rate; and increase the pressure within the wellbore after at least the portion of the sand accumulated within the wellbore is removed.

In a thirty second embodiment, a method of controlling a drawdown pressure in a wellbore comprises: producing one or more fluids from a wellbore at a first production rate; increasing a production of the one or more fluids from the first production rate to a second production rate, wherein the first production rate is less than the second production rate, wherein the production rate increase is maintained within an operating envelope, wherein the operating envelope defines a boundary for a rate of pressure change during a production of the one or more fluids from the wellbore; and limiting sand ingress into the wellbore during the pressure increase based on maintaining the rate of pressure change within the operating envelope.

A thirty third embodiment can include the method of the thirty second embodiment, wherein the boundary for the rate of pressure change is a function of an absolute pressure within the wellbore.

A thirty fourth embodiment can include the method of the thirty second or thirty third embodiment, wherein the boundary for the rate of pressure change is a function of the production rate of the one or more fluids from the wellbore.

A thirty fifth embodiment can include the method of any one of the thirty second to thirty fourth embodiments, wherein the operating envelope is determined by: detecting sand ingress into the wellbore from a production zone, sand transport along the wellbore, or both using an acoustic monitoring system disposed within the wellbore, wherein the detecting of the sand ingress, the sand transport, or both occurs while producing the one or more fluids from the wellbore; detecting a pressure within the wellbore while producing the one or more fluids and detecting the sand ingress, the sand transport, or both; correlating a rate of pressure change with a production rate of the one or more fluids and the sand ingress, the sand transport, or both; and determining the operating envelope based on the correlating.

A thirty sixth embodiment can include the method of any one of the thirty second to thirty fifth embodiments, wherein the wellbore does not include an acoustic sensor while increasing the production of the one or more fluids from the first production rate to the second production rate.

Various embodiments related to draw down across wellbores can include, but are not limited to:

In a first embodiment, a method comprises: obtaining one or more first geophysical properties of a first production zone within a first wellbore; correlating the one or more first geophysical properties with a set of geophysical properties having a corresponding set of determined operating envelopes; defining an operating envelope for the first production zone based on the determined operating envelope of the set of determined operating envelopes that corresponds to the first geophysical properties; determining, using the operating envelope, a force on a production face of the first production zone in the first wellbore that is less than or equal to a maximum force on the production face of the first production zone defined by the operating envelope, wherein: the operating envelope defines a boundary for a sand ingress rate in relation to the force on the production face of the first production zone during production of one or more fluids from the first production zone, the force on the production face of the first production zone is measured by at least one of a rate of pressure change in the first production zone, a flux of the one or more fluids through the production face of the first production zone, or an acceleration of the one or more fluids between a reservoir and an interior of the first wellbore at the production face of the first production zone, and limiting sand ingress into the first wellbore at the first production zone to below a sand ingress threshold in response to producing the one or more fluids from the first production zone at the force on the production face.

A second embodiment can include the method of the first embodiment, further comprising: assessing the force on the production face of the first production zone during the production of one or more fluids, determining, using the operating envelope, a production rate for the first production zone in the first wellbore that is less than or equal to a maximum production rate defined by the operating envelope, wherein the operating envelope further defines a boundary for the sand ingress rate in relation to the force on the production face of the first production zone and the production rate within the first production zone during the production of the one or more fluids, and wherein the one or more fluids are produced from the first production zone at the production rate.

A third embodiment can include the method of the second embodiment, wherein the operating envelope is determined by: receiving an indication of sand ingress into a second production zone within a second wellbore, sand transport along the second wellbore, or both using a sand monitoring system disposed within the second wellbore, wherein the sand ingress, the sand transport, or both occurs while producing the one or more fluids from the second wellbore from the second production zone; receiving one or more second geophysical properties of the second production zone, wherein the second geophysical properties correspond to the first geophysical properties of the first production zone; receiving a pressure within the second wellbore while producing the one or more fluids and detecting the sand ingress, the sand transport, or both; correlating a force on a production face of the second production zone with a production rate of the one or more fluids and the sand ingress, the sand transport, or both; and determining the operating envelope based on the correlating.

A fourth embodiment can include the method of the third embodiment, wherein receiving the indication of the sand ingress, the sand transport, or both using the sand monitoring system comprises: receiving an acoustic signal originating along the second wellbore using a fiber optic cable disposed within the second wellbore; comparing a sand ingress signature with the acoustic signal to produce a first output; comparing a sand flow signature with the acoustic signal to produce a second output; and determining the sand ingress, the sand transport, or both based on the first output and the second output.

A fifth embodiment can include the method of any one of the first to fourth embodiments, wherein the boundary for the force on the production face of the first production zone is a function of at least one of an absolute pressure within the first production zone or the production rate of the one or more fluids from the first production zone.

A sixth embodiment can include the method of any one of the second to fifth embodiments, wherein the production rate of the one or more fluids is the maximum production rate defined by the operating envelope.

A seventh embodiment can include the method of any one of the first to sixth embodiments, wherein the first wellbore does not comprise a sand monitoring system.

An eighth embodiment can include the method of any one of the first to seventh embodiments, further comprising: determining, using a pressure monitoring system, a pressure within the second production zone of the second wellbore, wherein the pressure monitoring system comprises a distributed pressure sensors system.

A ninth embodiment can include the method of any one of the first to eighth embodiments, comprising: receiving the indication of the sand ingress, sand transport, or both over a first time interval during production of the one or more fluids from the second wellbore; receiving a pressure within the wellbore during the first time interval while producing the one or more fluids and detecting the sand ingress, the sand transport, or both; correlating the force on the production face of the second wellbore during the first time interval; and re-determining the operating envelope based on the correlating, wherein the one or more fluids are produced at a production rate within the re-determined operating envelope after the first time interval.

In a tenth embodiment, a system comprises: a processor; and a memory storing an analysis program, wherein the processor is configured to execute the analysis program to: receive one or more first geophysical properties of a first production zone within a first wellbore; correlate the one or more first geophysical properties with a set of geophysical properties having corresponding set of determined operating envelopes; define an operating envelope for the first production zone based on the determined operating envelope of the set of determined operating envelopes that corresponds to the first geophysical properties; determine, using the operating envelope, a for a force on a production face of the first production zone in the first wellbore that is less than or equal to a maximum force on the production face defined by the operating envelope, wherein: the operating envelope defines a boundary for a sand ingress rate in relation to the force on the production face of the first production zone during a production of one or more fluids at a production rate, and the force on the production face of the first production zone is measured by at least one of a rate of pressure change in the first production zone, a flux of the one or more fluids through the production face of the first production zone, or an acceleration of the one or more fluids between a reservoir and an interior of the wellbore at the production face of the wellbore; and generating an output with one or more parameters configured to allow the one or more fluids to be produced from the first production zone at the production rate, wherein sand ingress into the wellbore at the first production zone is limited to below a sand ingress threshold in response to production of the one or more fluids from the first production zone at the production rate.

An eleventh embodiment can include the system of the tenth embodiment, wherein the processor is further configured to: assess the force on the production face of the first production zone during the production of one or more fluids; determine, using the operating envelope, a production rate for the first production zone in the first wellbore that is less than or equal to a maximum production rate defined by the operating envelope, wherein the operating envelope further defines a boundary for the sand ingress rate in relation to the force on the production face of the first production zone and the production rate within the first production zone during the production of the one or more fluids at the production rate.

A twelfth embodiment can include the system of the tenth or eleventh embodiment, further comprising: a sand monitoring system disposed within a second wellbore; and a pressure monitoring system configured to detect a pressure within the second wellbore, wherein the processor is further configured to execute the analysis program to: receive a signal from the sand monitoring system; detect, using the signal from the sand monitoring system, sand ingress into a second production zone of the second wellbore, sand transport along the second wellbore, or both, wherein the detection of the sand ingress, the sand transport, or both occurs while one or more fluids are produced from the second production zone, and wherein the second production zone has one or more second geophysical properties corresponding to the one or more first geophysical properties of the first production zone; receive a pressure output from the pressure monitoring system; detect, based on the pressure output, a pressure within the second production zone; correlate a force on a production face of the second production zone with a production rate of the one or more fluids from the second production zone and the sand ingress, the sand transport, or both; and determine the operating envelope based on the correlating.

A thirteenth embodiment can include the system of the twelfth embodiment, wherein the sand monitoring system comprises a fiber optic cable disposed within the second wellbore, where the signal from the sand monitoring system comprises an indication of an acoustic signal generated within the second wellbore.

A fourteenth embodiment can include the system of any one of the tenth to thirteenth embodiments, wherein the boundary for the force on the production face of the first production zone is a function of an absolute pressure within the first production zone.

A fifteenth embodiment can include the system of any one of the tenth to fourteenth embodiments, wherein the boundary for the force on the production face of the first production zone is a function of the production rate of the one or more fluids from the first production zone.

A sixteenth embodiment can include the system of any one of the tenth to fifteenth embodiments, wherein the production rate of the one or more fluids is the maximum production rate defined by the operating envelope.

A seventeenth embodiment can include the system of any one of the tenth to sixteenth embodiments, wherein the first wellbore does not comprise a sand monitoring system.

An eighteenth embodiment can include the system of any one of the tenth to seventeenth embodiments, further comprising: a pressure monitoring system configured to detect a pressure within the second wellbore, wherein the processor is further configured to execute the analysis program to: determine, based on a signal from the pressure monitoring system, a pressure within the second production zone, wherein the pressure monitoring system comprises a distributed pressure sensors system.

Various embodiments related to sand ingress prediction for wellbores and across wellbores can include, but are not limited to:

In a first embodiment, a method of developing a predictive model for sand production from a wellbore comprises: receiving an indication of sand ingress at one or more production zones within a first wellbore using a sand monitoring system disposed within the first wellbore, wherein the sand ingress occurs while producing one or more fluids from the first wellbore; detecting, using a pressure monitoring system, a pressure within the first wellbore while producing the one or more fluids and detecting the sand ingress; determining one or more geophysical properties of the one or more production zones of the first wellbore; and determining a model that correlates sand ingress at each of the one or more production zones with a plurality of variables, wherein the plurality of variables include at least two of: a production rate of the one or more fluids from the first wellbore, a pressure within the first wellbore, a rate of change of the pressure within the first wellbore, a flux of the one or more fluids through the production face of the wellbore, or an acceleration of the one or more fluids between a reservoir and an interior of the wellbore at the production face of the wellbore, or one or more of the geophysical properties of the first wellbore.

A second embodiment can include the method of the first embodiment, comprising: identifying a production zone in a second wellbore as being one of the one or more production zones of the first wellbore; determine a pressure within the second wellbore and one or more geophysical properties of the production zone in the second wellbore; and predicting, using the model, sand ingress within the production zone in the second wellbore.

A third embodiment can include the method of the first or second embodiment, wherein the one or more geophysical properties comprise porosity, permeability, a measure of a consolidation of a formation material, a type of the formation material, or any combination thereof.

A fourth embodiment can include the method of any one of the first to third embodiments, wherein the model is a logistical regression model.

A fifth embodiment can include the method of any one of the first to fourth embodiments, wherein the second wellbore extends within a same reservoir as the first wellbore.

A sixth embodiment can include the method of any one of the first to fifth embodiments, comprising controlling a production rate of the one or more fluids from the second wellbore using the model.

A seventh embodiment can include the method of the sixth embodiment, wherein controlling the production rate of the one or more fluids comprises producing the one or more fluids at a maximum production rate while remaining below a sand ingress threshold rate as predicted by the model.

An eighth embodiment can include the method of any one of the first to seventh embodiments, wherein detecting the sand ingress at the one or more productions zones within the first wellbore comprises: detecting an acoustic signal along the wellbore using the sand monitoring system, wherein the sand monitoring system comprises a fiber optic cable disposed within the wellbore; comparing a sand ingress signature with the acoustic signal at each of the one or more production zones; and detecting the sand ingress at the one or more production zones within the first wellbore based on the comparison of the sand ingress signature with the acoustic signal.

A ninth embodiment can include the method of any one of the first to eighth embodiments, comprising: detecting sand ingress at one or more production zones within a third wellbore using a second sand monitoring system disposed within the third wellbore; detecting, using a second pressure monitoring system, a pressure within the third wellbore while producing the one or more fluids and detecting the sand ingress; determining one or more geophysical properties of the one or more production zones of the third wellbore; updating the model based on the sand ingress, pressure, and one or more geophysical properties of the third wellbore; and predicting, using the updated model, sand ingress within the production zone in the second wellbore.

A tenth embodiment can include the method of any one of the first to ninth embodiments, comprising: detecting sand production from the second wellbore; correlating the sand production from the second wellbore with the predicted sand ingress in the second wellbore; and updating the model when the sand production varies from the predicted sand ingress by more than a variance threshold.

In an eleventh embodiment, a system for operating a wellbore comprises: a memory storing an analysis program; and a processor configured to execute an analysis program to: receive, from a monitoring assembly, a sensor signal, wherein the sensor signal is generated while producing one or more fluids from at least one production zone within a first wellbore, wherein the monitoring assembly is configured to detect one or more values related to the first wellbore, wherein the first wellbore comprises the at least one production zone capable of producing one or more fluids; receive an indication of sand ingress into the first wellbore using the sensor signal; receive one or more geophysical properties for the at least one production zone; and determine a model that correlates sand ingress at the at least one production zone with a plurality of variables, wherein the plurality of variables include at least two of: a production rate of the one or more fluids from the first wellbore, a pressure within the first wellbore, a rate of change of the pressure within the first wellbore, a flux of the one or more fluids through the production face of the wellbore, or an acceleration of the one or more fluids between a reservoir and an interior of the wellbore at the production face of the wellbore, or the one or more of the geophysical properties of the at least one production zone.

A twelfth embodiment can include the system of the eleventh embodiment, wherein the monitoring assembly comprises: a sand monitoring system disposed within a first wellbore; and a pressure monitoring system configured to detect a pressure within the first wellbore.

A thirteenth embodiment can include the system of the eleventh or twelfth embodiment, wherein the processor is further configured to execute the analysis program to: receive pressure information and one or more geophysical properties for a production zone in a second wellbore; and predict, using the model, sand ingress into the production zone in the second wellbore based on the pressure information and the one or more geophysical properties.

A fourteenth embodiment can include the system of the thirteenth embodiment, wherein the processor is further configured to execute the analysis program to: receive production rate information for the second wellbore, wherein the prediction of the sand ingress is further based on the production rate information.

A fifteenth embodiment can include the system of the thirteenth or fourteenth embodiment, wherein the second wellbore extends into a same reservoir as the first wellbore.

A sixteenth embodiment can include the system of any one of the eleventh to fifteenth embodiments, wherein the model is a logistical regression model.

A seventeenth embodiment can include the system of any one of the twelfth to sixteenth embodiments, wherein the sand monitoring system comprises: a fiber optic cable disposed in the first wellbore; and a receiver in signal communication with the fiber optical cable, wherein the sensor signal comprises an acoustic signal, and wherein the receiver is configured to use a light pulse to detect an acoustic signal within the wellbore along the length of the fiber optic cable; wherein the processor is configured to detect the sand ingress, the sand transport, or both by executing the analysis program to: detect the acoustic signal using the fiber optic cable disposed within the wellbore; compare a sand ingress signature with the acoustic signal to produce a first output; compare a sand flow signature with the acoustic signal to produce a second output; and detect the sand ingress based on the first output and the second output.

An eighteenth embodiment can include the system of any one of the eleventh to seventeenth embodiments, wherein the processor is further configured to execute the analysis program to: generate a control signal configured to increase a production rate of the one or more fluids; monitor the sand ingress into the first wellbore; and control the production rate of the one or more fluids while retaining the sand ingress below a sand ingress threshold rate.

In a nineteenth embodiment, a method of predicting sand production from a wellbore comprises: detecting a production rate of one or more fluids from at least one production zone within a first wellbore; detecting, using a pressure monitoring system, a pressure within the first wellbore while producing the one or more fluids from at least one production zone within the first wellbore; determining one or more geophysical properties of the at least one production zone of the first wellbore; and predicting, using a sand prediction model, sand ingress within the at least one production zone in the first wellbore, wherein the sand prediction model correlates sand ingress at the at least one production zone with a plurality of variables, wherein the plurality of variables include at least two of: a production rate of the one or more fluids from the first wellbore, a pressure within the first wellbore, a rate of change of the pressure within the first wellbore, a flux of the one or more fluids through the production face of the at least one production zone of the first wellbore, an acceleration of the one or more fluids between a reservoir and an interior of the wellbore at the production face of the at least one production zone of the first wellbore, or one or more of the geophysical properties of the at least one production zone of the first wellbore, and wherein the sand prediction model is based on at least: sand ingress detected in a second wellbore having one or more production zones, a detected pressure within the one or more production zones of the second wellbore, and one or more geophysical properties of the second wellbore.

A twentieth embodiment can include the method of the nineteenth embodiment, comprising operating the first wellbore at or below a maximum production rate, wherein the maximum production rate is a production rate from at least one production zone within the first wellbore at which the sand ingress is at or below a threshold sand ingress rate.

A twenty first embodiment can include the method of the nineteenth or twentieth embodiment, wherein the one or more geophysical properties comprise porosity, permeability, a measure of a consolidation of a formation material, a type of the formation material, or any combination thereof.

A twenty second embodiment can include the method of any one of the nineteenth to twenty first embodiments, wherein the model is a logistical regression model.

A twenty third embodiment can include the method of any one of the nineteenth to twenty second embodiments, wherein the first wellbore extends into a same reservoir as the second wellbore.

A twenty fourth embodiment can include the method of any one of the nineteenth to twenty third embodiments, comprising controlling a production rate of the one or more fluids from the first wellbore using the sand prediction model.

A twenty fifth embodiment can include the method of the twenty fourth embodiment, wherein controlling the production rate of the one or more fluids comprises producing the one or more fluids at a maximum production rate while remaining below a sand ingress threshold rate as predicted by the sand prediction model.

A twenty sixth embodiment can include the method of any one of the nineteenth to twenty fifth embodiments, comprising detecting, using a sand monitoring system disposed in the first wellbore, sand ingress within the at least one production zone in the first wellbore.

A twenty seventh embodiment can include the method of the twenty sixth embodiment, wherein detecting the sand ingress comprises: detecting an acoustic signal along the first wellbore using the sand monitoring system, wherein the sand monitoring system comprises a fiber optic cable disposed within the wellbore; comparing a sand ingress signature with the acoustic signal at the at least one production zone; and detecting the sand ingress at the at least one production zone within the first wellbore based on the comparison of the sand ingress signature with the acoustic signal.

A twenty eighth embodiment can include the method of the twenty sixth or twenty seventh embodiment, comprising: comparing the detected sand ingress with the predicted sand ingress; and updating the sand prediction model when the detected sand ingress varies from the predicted sand ingress exceeds a variance threshold.

Various embodiments related to wellbore completions can include, but are not limited to:

In a first embodiment, a method of planning a wellbore completion comprises: receiving an indication of sand ingress at one or more production zones within a first wellbore; receiving an indication of a force on a production face of the one or more production zones within the first wellbore; determining one or more operating envelopes for the one or more production zones in the first wellbore, wherein the one or more operating envelopes define boundaries for a sand ingress rate in relation to the force on the production face of the one or more production zones during the production of one or more fluids from the corresponding one or more production zones; correlating one or more production zones in a second wellbore with at least one of the one or more production zones within the first wellbore; defining one or more operating envelopes for the one or more production zones in the second wellbore based on the correlated one or more production zones in the second wellbore with the at least one of the one or more production zones within the first wellbore; predicting sand ingress at the one or more production zones in the second wellbore using the one or more operating envelopes for the one or more production zones in the second wellbore; and defining a completion plan for the second wellbore based on the predicted sand ingress at the one or more production zones in the second wellbore.

A second embodiment can include the method of the first embodiment, wherein the one or more operating envelopes further define boundaries for the sand ingress rate in relation to the force on the production face of the one or more production zones and the production rate within each of the one or more production zones during the production of one or more fluids from the corresponding one or more production zones.

A third embodiment can include the method of the first or second embodiment, wherein predicting sand ingress at the one or more production zones in the second wellbore comprises predicting sand ingress in a first of the one or more production zones; and wherein the completion plan for the second wellbore comprises determining that a sand screen is to be placed at the first of the one or more production zones as a result of predicting sand ingress.

A fourth embodiment can include the method of any one of the first to third embodiments, wherein predicting sand ingress at the one or more production zones in the second wellbore comprises predicting that there will be substantially no sand ingress in a second of the one or more production zones; and wherein the completion plan for the second wellbore comprises determining that no sand screen is to be placed at the second of the one or more production zones as a result of predicting substantially no sand ingress.

A fifth embodiment can include the method of any one of the first to fourth embodiments, wherein the completion plan defines a physical configuration of completion equipment placed in the second wellbore.

A sixth embodiment can include the method of any one of the first to fifth embodiments, further comprising: completing the second wellbore using the completion plan, wherein completing the second wellbore occurs after defining the completion plan.

A seventh embodiment can include the method of any one of the first to sixth embodiments, wherein the second wellbore is drilled after defining the completion plan.

An eighth embodiment can include the method of any one of the first to seventh embodiments, wherein determining one or more operating envelopes for the one or more production zones of the first wellbore comprises: receiving an indication of sand ingress into the first wellbore, sand transport along the first wellbore, or both using a sand monitoring system disposed within the first wellbore, wherein the sand ingress, the sand transport, or both occurs while producing the one or more fluids from the second wellbore from the second production zone; receiving a pressure within the second wellbore while producing the one or more fluids and detecting the sand ingress, the sand transport, or both; correlating the force on a production face of the second wellbore within the second production zone with a production rate of the one or more fluids and the sand ingress, the sand transport, or both; and determining the one or more operating envelopes for the one or more production zones based on the correlating.

A ninth embodiment can include the method of any one of the first to eighth embodiments, wherein correlating the one or more production zones in the second wellbore with the at least one of the one or more production zones within the first wellbore comprises: obtaining one or more geophysical properties of the one or more production zones within the first wellbore; obtaining one or more geophysical properties of the one or more production zones within the second wellbore; and correlating the one or more geophysical properties of the one or more production zones within the first wellbore with the one or more geophysical properties of the one or more production zones within the second wellbore.

A tenth embodiment can include the method of the ninth embodiment, wherein the one or more geophysical properties comprise porosity, permeability, a measure of a consolidation of a formation material, a type of the formation material, or any combination thereof.

An eleventh embodiment can include the method of any one of the first to tenth embodiments, further comprising: determining a model that correlates sand ingress at each of the one or more production zones within the first wellbore with a plurality of variables, wherein the plurality of variables include at least two of: a production rate of the one or more fluids from the first wellbore, a pressure within the first wellbore, a rate of change of the pressure within the first wellbore, a flux of the one or more fluids through the production face of the wellbore, or an acceleration of the one or more fluids between a reservoir and an interior of the wellbore at the production face of the wellbore, or one or more of the geophysical properties of the first wellbore; and wherein predicting the sand ingress at the one or more production zones in the second wellbore further comprises using the model to predict the sand ingress at the one or more production zones in the second wellbore.

In a twelfth embodiment, a wellbore development system, the system comprises: a processor; and a memory storing an analysis program; wherein the processor is configured to execute an analysis program to: receive an indication of sand ingress at one or more production zones within a first wellbore; receive an indication of a force on a production face of the one or more production zones within the first wellbore; determine one or more operating envelopes for the one or more production zones in the first wellbore, wherein the one or more operating envelopes define boundaries for a sand ingress rate in relation to the force on the production face of the one or more production zones during the production of one or more fluids from the corresponding one or more production zones; correlate one or more production zones in a second wellbore with at least one of the one or more production zones within the first wellbore; define one or more operating envelopes for the one or more production zones in the second wellbore based on the correlated one or more production zones in the second wellbore with the at least one of the one or more production zones within the first wellbore; predict sand ingress at the one or more production zones in the second wellbore using the one or more operating envelopes for the one or more production zones in the second wellbore; and define a completion plan for the second wellbore based on the predicted sand ingress at the one or more production zones in the second wellbore.

thirteenth embodiment can include the system of the twelfth embodiment, wherein the one or more operating envelopes further define boundaries for the sand ingress rate in relation to the force on the production face of the one or more production zones and the production rate within each of the one or more production zones during the production of one or more fluids from the corresponding one or more production zones.

A fourteenth embodiment can include the system of the twelfth or thirteenth embodiment, wherein the processor is further configured to predict sand ingress in a first of the one or more production zones, wherein the completion plan for the second wellbore indicates that a sand screen is to be placed at the first of the one or more production zones as a result of predicting sand ingress.

A fifteenth embodiment can include the system of any one of the twelfth to fourteenth embodiments, wherein the processor is further configured to predict that there will be substantially no sand ingress in a second of the one or more production zones, wherein the completion plan for the second wellbore indicates that no sand screen is to be placed at the second of the one or more production zones as a result of predicting substantially no sand ingress.

A sixteenth embodiment can include the system of any one of the twelfth to fifteenth embodiments, wherein the completion plan defines a physical configuration of completion equipment placed in the second wellbore.

A seventeenth embodiment can include the system of any one of the twelfth to sixteenth embodiments, wherein the second wellbore is not drilled at the time the completion plan is defined.

An eighteenth embodiment can include the system of any one of the twelfth to seventeenth embodiments, wherein the process is configured to: receive an indication of sand ingress into the first wellbore, sand transport along the first wellbore, or both from a sand monitoring system disposed within the first wellbore, wherein the sand ingress, the sand transport, or both occurs while producing the one or more fluids from the second wellbore from the second production zone; receive a pressure within the second wellbore while the one or more fluids are produced and the sand ingress, the sand transport, or both are detected; correlate the force on a production face of the second wellbore within the second production zone with a production rate of the one or more fluids and the sand ingress, the sand transport, or both; and determine the one or more operating envelopes for the one or more production zones based on the correlating.

A nineteenth embodiment can include the system of any one of the twelfth to eighteenth embodiments, wherein the processor is configured to: obtain one or more geophysical properties of the one or more production zones within the first wellbore; obtain one or more geophysical properties of the one or more production zones within the second wellbore; and correlate the one or more geophysical properties of the one or more production zones within the first wellbore with the one or more geophysical properties of the one or more production zones within the second wellbore.

A twentieth embodiment can include the system of the nineteenth embodiment, wherein the one or more geophysical properties comprise porosity, permeability, a measure of a consolidation of a formation material, a type of the formation material, or any combination thereof.

A twenty first embodiment can include the system of any one of the twelfth to twentieth embodiments, wherein the processor is configured to: determine a model that correlates sand ingress at each of the one or more production zones within the first wellbore with a plurality of variables, wherein the plurality of variables include at least two of: a production rate of the one or more fluids from the first wellbore, a pressure within the first wellbore, a rate of change of the pressure within the first wellbore, a flux of the one or more fluids through the production face of the wellbore, or an acceleration of the one or more fluids between a reservoir and an interior of the wellbore at the production face of the wellbore, or one or more of the geophysical properties of the first wellbore; and wherein the sand ingress prediction at the one or more production zones in the second wellbore further uses the model to predict the sand ingress at the one or more production zones in the second wellbore.

The embodiments disclosed herein have included systems and methods for detecting and/or characterizing sand ingress and/or sand transport within a subterranean wellbore, or a plurality of such wellbores. Thus, through use of the systems and methods described herein, one may more effectively limit or avoid sand ingress and accumulation with a wellbore so as to enhance the economic production therefrom.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A method of developing a predictive model for sand production from a wellbore, the method comprising:

receiving an indication of sand ingress at one or more production zones within a first wellbore using a sand monitoring system disposed within the first wellbore, wherein the sand ingress occurs while producing one or more fluids from the first wellbore;

detecting, using a pressure monitoring system, a pressure within the first wellbore while producing the one or more fluids and detecting the sand ingress;

determining one or more geophysical properties of the one or more production zones of the first wellbore; and determining a model that correlates sand ingress at each of the one or more production zones with a plurality of variables, wherein the plurality of variables includes at least one of: a) a rate of change of the pressure within the first wellbore, a flux of the one or more fluids through the production face of the wellbore, or an acceleration of the one or more fluids between a reservoir and an interior of the wellbore at the production face of the wellbore, and at least one of b) a production rate of the one or more fluids from the first wellbore, a pressure within the first wellbore, or one or more of the geophysical properties of the first wellbore.

2. The method of claim 1, comprising:

identifying a production zone in a second wellbore as being one of the one or more production zones of the first wellbore;

determine a pressure within the second wellbore and one or more geophysical properties of the production zone in the second wellbore; and predicting, using the model, sand ingress within the production zone in the second wellbore.

3. The method of claim 2, wherein the second wellbore extends within a same reservoir as the first wellbore.

4. The method of claim 2, comprising controlling a production rate of the one or more fluids from the second wellbore using the model.

5. The method of claim 4, wherein controlling the production rate of the one or more fluids comprises producing the one or more fluids at a maximum production rate while remaining below a sand ingress threshold rate as predicted by the model.

6. The method of claim 2, comprising:

detecting sand ingress at one or more production zones within a third wellbore using a second sand monitoring system disposed within the third wellbore;

detecting, using a second pressure monitoring system, a pressure within the third wellbore while producing the one or more fluids and detecting the sand ingress;

determining one or more geophysical properties of the one or more production zones of the third wellbore;

updating the model based on the sand ingress, pressure, and one or more geophysical properties of the third wellbore; and predicting, using the updated model, sand ingress within the production zone in the second wellbore.

7. The method of claim 2, comprising:

detecting sand production from the second wellbore;

correlating the sand production from the second wellbore with the predicted sand ingress in the second wellbore; and updating the model when the sand production varies from the predicted sand ingress by more than a variance threshold.

8. The method of claim 1, wherein the one or more geophysical properties comprise porosity, permeability, a measure of a consolidation of a formation material, a type of the formation material, or any combination thereof.

9. The method of claim 1, wherein the model is a logistical regression model.

10. The method of claim 1, wherein detecting the sand ingress at the one or more productions zones within the first wellbore comprises:

detecting an acoustic signal along the wellbore using the sand monitoring system, wherein the sand monitoring system comprises a fiber optic cable disposed within the wellbore;

comparing a sand ingress signature with the acoustic signal at each of the one or more production zones; and detecting the sand ingress at the one or more production zones within the first wellbore based on the comparison of the sand ingress signature with the acoustic signal.

11. A system for operating a wellbore, the system comprising:

a memory storing an analysis program; and a processor configured to execute the analysis program to:

receive, from a monitoring assembly, a sensor signal, wherein the sensor signal is generated while producing one or more fluids from at least one production zone within a first wellbore, wherein the monitoring assembly is configured to detect one or more values related to the first wellbore, wherein the first wellbore comprises the at least one production zone capable of producing one or more fluids;

receive, from the monitoring assembly, an indication of the pressure within at least one production zone of the at least one production zone in the first wellbore;

receive an indication of sand ingress into the first wellbore using the sensor signal;

receive one or more geophysical properties for the at least one production zone; and determine a model that correlates sand ingress at the at least one production zone with a plurality of variables, wherein the plurality of variables includes at least one of: a) a rate of change of the pressure within the first wellbore, a flux of the one or more fluids through the production face of the wellbore, or an acceleration of the one or more fluids between a reservoir and an interior of the wellbore at the production face of the wellbore, and at least one of b) a production rate of the one or more fluids from the first wellbore, a pressure within the first wellbore, or the one or more of the geophysical properties of the at least one production zone.

12. The system of claim 11, wherein the monitoring assembly comprises:

a sand monitoring system disposed within a first wellbore; and a pressure monitoring system configured to detect a pressure within the first wellbore.

13. The system of claim 12, wherein the sand monitoring system comprises:

a fiber optic cable disposed in the first wellbore; and a receiver in signal communication with the fiber optical cable, wherein the sensor signal comprises an acoustic signal, and wherein the receiver is configured to use a light pulse to detect an acoustic signal within the first wellbore along the length of the fiber optic cable;

wherein the processor is configured to detect the sand ingress, the sand transport, or both by executing the analysis program to:

detect the acoustic signal using the fiber optic cable disposed within the first wellbore;

compare a sand ingress signature with the acoustic signal to produce a first output;

compare a sand flow signature with the acoustic signal to produce a second output; and detect the sand ingress based on the first output and the second output.

14. The system of claim 11, wherein the processor is further configured to execute the analysis program to:

receive pressure information and one or more geophysical properties for a production zone in a second wellbore; and predict, using the model, sand ingress into the production zone in the second wellbore based on the pressure information and the one or more geophysical properties.

15. The system of claim 14, wherein the processor is further configured to execute the analysis program to:

receive production rate information for the second wellbore, wherein the prediction of the sand ingress is further based on the production rate information.

16. The system of claim 14, wherein the second wellbore extends into a same reservoir as the first wellbore.

17. The system of claim 11, wherein the model is a logistical regression model.

18. The system of claim 11, wherein the processor is further configured to execute the analysis program to:

generate a control signal configured to increase a production rate of the one or more fluids;

monitor the sand ingress into the first wellbore; and control the production rate of the one or more fluids while retaining the sand ingress below a sand ingress threshold rate.

19. A method of predicting sand production from a wellbore, the method comprising:

detecting a production rate of one or more fluids from at least one production zone within a first wellbore;

detecting, using a pressure monitoring system, a pressure within the first wellbore while producing the one or more fluids from at least one production zone within the first wellbore;

determining one or more geophysical properties of the at least one production zone of the first wellbore; and predicting, using a sand prediction model, sand ingress within the at least one production zone in the first wellbore, wherein the sand prediction model correlates sand ingress at the at least one production zone with a plurality of variables, wherein the plurality of variables includes: at least one of: a)

a rate of change of the pressure within the first wellbore, a flux of the one or more fluids through the production face of the at least one production zone of the first wellbore, or an acceleration of the one or more fluids between a reservoir and an interior of the wellbore at the production face of the at least one production zone of the first wellbore, and at least one of: b) a production rate of the one or more fluids from the first wellbore, a pressure within the first wellbore, or one or more of the geophysical properties of the at least one production zone of the first wellbore; and wherein the sand prediction model is based on at least:

sand ingress detected in a second wellbore having one or more production zones, a detected pressure within the one or more production zones of the second wellbore, and one or more geophysical properties of the second wellbore.

20. The method of claim 19, comprising operating the first wellbore at or below a maximum production rate, wherein the maximum production rate is a production rate from at least one production zone within the first wellbore at which the sand ingress is at or below a threshold sand ingress rate.

21. The method of claim 19, wherein the one or more geophysical properties comprise porosity, permeability, a measure of a consolidation of a formation material, a type of the formation material, or any combination thereof.

22. The method of claim 19, wherein the model is a logistical regression model.

23. The method of claim 19, wherein the first wellbore extends into a same reservoir as the second wellbore.

24. The method of claim 19, comprising controlling a production rate of the one or more fluids from the first wellbore using the sand prediction model.

25. The method of claim 24, wherein controlling the production rate of the one or more fluids comprises producing the one or more fluids at a maximum production rate while remaining below a sand ingress threshold rate as predicted by the sand prediction model.

26. The method of claim 19, comprising detecting, using a sand monitoring system disposed in the first wellbore, sand ingress within the at least one production zone in the first wellbore.

27. The method of claim 26, wherein detecting the sand ingress comprises:

detecting an acoustic signal along the first wellbore using the sand monitoring system, wherein the sand monitoring system comprises a fiber optic cable disposed within the first wellbore;

comparing a sand ingress signature with the acoustic signal at the at least one production zone; and detecting the sand ingress at the at least one production zone within the first wellbore based on the comparison of the sand ingress signature with the acoustic signal.

28. The method of claim 26, comprising:

comparing the detected sand ingress with the predicted sand ingress; and updating the sand prediction model when the detected sand ingress varies from the predicted sand ingress exceeds a variance threshold.

* * * * *